US010697387B2

(12) United States Patent
Okazaki et al.

(10) Patent No.: US 10,697,387 B2
(45) Date of Patent: Jun. 30, 2020

(54) CONTROL SYSTEM OF INTERNAL COMBUSTION ENGINE

(71) Applicant: TOYOTA JIDOSHA KABUSHIKI KAISHA, Toyota-shi, Aichi (JP)

(72) Inventors: Shuntaro Okazaki, Sunto-gun (JP); Norihisa Nakagawa, Susono (JP); Yuji Yamaguchi, Susono (JP)

(73) Assignee: Toyota Jidosha Kabushiki Kaisha, Toyota-shi, Aichi (JP)

( * ) Notice: Subject to any disclaimer, the term of this patent is extended or adjusted under 35 U.S.C. 154(b) by 744 days.

(21) Appl. No.: 15/318,811

(22) PCT Filed: Jun. 19, 2015

(86) PCT No.: PCT/JP2015/003090
§ 371 (c)(1),
(2) Date: Dec. 14, 2016

(87) PCT Pub. No.: WO2015/194190
PCT Pub. Date: Dec. 23, 2015

(65) Prior Publication Data

US 2017/0122242 A1 May 4, 2017

(30) Foreign Application Priority Data

Jun. 19, 2014 (JP) ..... 2014-126244

(51) Int. Cl.
*F02D 41/24* (2006.01)
*F02D 41/02* (2006.01)
*F02D 41/14* (2006.01)

(52) U.S. Cl.
CPC ..... *F02D 41/2454* (2013.01); *F02D 41/0295* (2013.01); *F02D 41/1441* (2013.01); *F02D 41/1454* (2013.01); *F02D 2200/0814* (2013.01)

(58) Field of Classification Search
CPC ..... F02D 41/02; F02D 41/14; F02D 41/24; F02D 41/2454; F02D 41/2441;
(Continued)

(56) References Cited

U.S. PATENT DOCUMENTS 5,099,646 A * 3/1992 Nada ..... F01N 11/007 60/274
2010/0146936 A1 6/2010 Sawada
(Continued)

FOREIGN PATENT DOCUMENTS

CN 102301118 A 12/2011
EP 2 685 071 A1 1/2014
(Continued)

*Primary Examiner* — Mark A Laurenzi
*Assistant Examiner* — Mickey H France
(74) *Attorney, Agent, or Firm* — Finnegan, Henderson, Farabow, Garrett & Dunner, LLP

(57) ABSTRACT

An internal combustion engine comprises an exhaust purification catalyst and a downstream side air-fuel ratio sensor which is arranged at the downstream side of the exhaust purification catalyst. The control system performs feedback control so that the air-fuel ratio of the exhaust gas becomes the target air-fuel ratio, and performs learning control to correct the control center air-fuel ratio based on the output air-fuel ratio of the downstream side sensor. The target air-fuel ratio is switched to the lean air-fuel ratio when the output air-fuel ratio of the downstream side sensor becomes the rich judged air-fuel ratio and is switched to the rich air-fuel ratio when the output air-fuel ratio becomes the lean judged air-fuel ratio. When the learning promoting condition stands, the lean degree of the average target air-fuel ratio while the target air-fuel ratio is set to the lean air-fuel ratio and the rich degree of the average target air-fuel ratio while the target air-fuel ratio is set to the rich air-fuel ratio are increased.

2 Claims, 18 Drawing Sheets

(58) Field of Classification Search
CPC ..... F02D 41/0295; F02D 41/1441; F02D 41/1454; F02D 2200/0814; F01N 2430/06; F01N 2560/025
USPC ..... 60/267
See application file for complete search history.

(56) References Cited

U.S. PATENT DOCUMENTS

| | | | |
|---|---|---|---|
| 2012/0006307 | A1 | 1/2012 | Demura |
| 2012/0065870 | A1 | 3/2012 | Okazaki |
| 2013/0340410 | A1 | 12/2013 | Suzuki et al. |
| 2014/0283504 | A1 | 9/2014 | Fujiwara et al. |
| 2016/0017831 | A1 | 1/2016 | Nakagawa et al. |

FOREIGN PATENT DOCUMENTS

| | | | |
|---|---|---|---|
| EP | 2 711 519 | A1 | 3/2014 |
| JP | 2011-69337 | | 4/2011 |
| JP | 2012-17694 | | 1/2012 |
| JP | 2012-57572 | | 3/2012 |
| JP | 5494885 | B2 | 5/2014 |
| WO | WO 2010/139874 | A1 | 12/2010 |
| WO | WO2012/157059 | A1 | 11/2012 |
| WO | WO 2014/118889 | A1 | 8/2014 |

* cited by examiner

CONTROL SYSTEM OF INTERNAL COMBUSTION ENGINE

CROSS-REFERENCE TO RELATED APPLICATIONS

This application is a national phase application of International Application No. PCT/JP2015/003090, filed Jun. 19, 2015, and claims the priority of Japanese Application No. 2014-126244, filed Jun. 19, 2014, the content of both of which is incorporated herein by reference.

TECHNICAL FIELD

The present invention relates to a control system of an internal combustion engine.

BACKGROUND ART

Widely known in the past has been a control system of an internal combustion engine which is provided with an air-fuel ratio sensor in an exhaust passage of an internal combustion engine, and controls the amount of fuel supplied to the internal combustion engine based on the output of the air-fuel ratio sensor. As such a control system, one which is provided with an air-fuel ratio sensor at the upstream side of the exhaust purification catalyst provided in the engine exhaust passage and is provided with an oxygen sensor at the downstream side thereof is known (for example, PTLs 1 to 4, etc.)

For example, in the system described in PTL 1, feedback control is performed, based on the output of the upstream side air-fuel ratio sensor, so that the air-fuel ratio of the exhaust gas flowing into the exhaust purification catalyst becomes the stoichiometric air-fuel ratio. In addition, since deviation can occur in the output of the upstream side air-fuel ratio sensor, the output of the upstream side air-fuel ratio sensor is corrected based on the output of the downstream side oxygen sensor. Further, a correction amount of the output of the upstream side air-fuel ratio sensor based on the output of the downstream side oxygen sensor is incorporated to a learning value by a certain ratio every certain time interval, to update the learning value. The learning value is used for correction of the output of the upstream side air-fuel ratio sensor.

In addition, in the system described in PTL 1, when the mechanical compression ratio which is set by the variable compression ratio mechanism is high, the time interval for incorporating to the learning value made shorter and the ratio of incorporating to the learning value is made larger so as to increase the speed of incorporating to the learning value. Due to this, according to the system described in PTL 1, even when the mechanical compression ratio is high and thus the ratio of the unburned HC contained in the exhaust gas is high, it is made possible to make the learning value quickly converge.

CITATION LIST

Patent Literature

PTL 1: Japanese Patent Publication No. 2012-017694 A

PTL 2: Japanese Patent Publication No. 2011-069337 A

PTL 3: Japanese Patent Publication No. 2012-057572 A

SUMMARY OF INVENTION

Technical Problem

According to the inventors of the present application, a control system which performs control, which is different from that of the control system described in the above-mentioned PTL 1, is proposed. In this control system, when the air-fuel ratio detected by the downstream side air-fuel ratio sensor becomes a rich judged air-fuel ratio (air-fuel ratio slightly richer than stoichiometric air-fuel ratio) or less, the target air-fuel ratio is set to an air-fuel ratio which is leaner than the stoichiometric air-fuel ratio (below, referred to as a "lean air-fuel ratio"). In addition, while the target air-fuel ratio is set to the lean air-fuel ratio, the lean degree is changed smaller once. On the other hand, when the air-fuel ratio detected by the downstream side air-fuel ratio sensor becomes a lean judged air-fuel ratio (air-fuel ratio slightly leaner than the stoichiometric air-fuel ratio) or more, the target air-fuel ratio is set to an air-fuel ratio which is richer than the stoichiometric air-fuel ratio (below, referred to as a "rich air-fuel ratio"). In addition, while the target air-fuel ratio is set to the rich air-fuel ratio, the rich degree is changed smaller once. That is, in this control system, the target air-fuel ratio is alternately switched between the rich air-fuel ratio and the lean air-fuel ratio.

When performing control which alternately switches the target air-fuel ratio between the rich air-fuel ratio and the lean air-fuel ratio in this way, it is not possible to update the learning value by a method similar to that in the case of performing control so that the target air-fuel ratio becomes a stoichiometric air-fuel ratio or other certain air-fuel ratio. Similarly, it is not possible to change the speed of updating the learning value, by a method similar to that in the case of performing control so that the target air-fuel ratio becomes a certain air-fuel ratio when performing such control.

For this reason, when performing control which alternately switches a target air-fuel ratio between a rich air-fuel ratio and a lean air-fuel ratio, it is necessary to study a new method of changing the speed of updating the learning value. Note that even when performing control to alternately switch a target air-fuel ratio between a rich air-fuel ratio and a lean air-fuel ratio, it is possible to change the ratio of incorporating to the learning value, as the method of changing the speed of updating the learning value. However, if changing the speed of updating the learning value by this method, sometimes the learning value will be excessively incorporated and as a result convergence of the learning value will become slower.

Therefore, in consideration of the above problem, an object of the present invention is to provide an internal combustion engine which can suitably change a speed of updating a learning value, even when performing control which alternately switches a target air-fuel ratio between a rich air-fuel ratio and a lean air-fuel ratio.

Solution to Problem

To solve this problem, in a first aspect of the invention, there is provided a control system of an internal combustion engine, the engine comprising: an exhaust purification catalyst which is arranged in an exhaust passage of the internal combustion engine and which can store oxygen; and a downstream side air-fuel ratio sensor which is arranged at a downstream side, in the exhaust flow direction, of the exhaust purification catalyst and which detects an air-fuel ratio of exhaust gas which flows out from the exhaust purification catalyst, wherein the control system performs feedback control on the feed of fuel which is fed to the combustion chamber of the internal combustion engine so that the air-fuel ratio of the exhaust gas flowing into exhaust purification catalyst becomes a target air-fuel ratio, and performs learning control which corrects a parameter relating to feedback control based on the output air-fuel ratio of the downstream side air-fuel ratio sensor, the target air-fuel ratio is switched from a rich air-fuel ratio which is richer than the stoichiometric air-fuel ratio to a lean air-fuel ratio which is leaner than the stoichiometric air-fuel ratio when the output air-fuel ratio of the downstream side air-fuel ratio sensor becomes a rich judged air-fuel ratio, which is richer than the stoichiometric air-fuel ratio, or less, and is switched from the lean air-fuel ratio to the rich air-fuel ratio when the output air-fuel ratio of the downstream side air-fuel ratio sensor becomes a lean judged air-fuel ratio, which is leaner than the stoichiometric air-fuel ratio, or more, and, when a learning promotion condition stands, which stands when it is necessary to promote correction of the parameter by the learning control, compared with when the learning promoting condition does not stand, at least one of a lean degree of the average target air-fuel ratio while the target air-fuel ratio is set to the lean air-fuel ratio and a rich degree of the average target air-fuel ratio while the target air-fuel ratio is set to the rich air-fuel ratio is increased.

In a second aspect of the invention, there is provided the first aspect of the invention, wherein the target air-fuel ratio is switched from the rich air-fuel ratio to a lean set air-fuel ratio which is leaner than the stoichiometric air-fuel ratio, when the output air-fuel ratio of the downstream side air-fuel ratio sensor becomes the rich judged air-fuel ratio or less, the target air-fuel ratio is set to a lean air-fuel ratio with a smaller lean degree than the lean set air-fuel ratio, from a lean degree change timing after the target air-fuel ratio is set to the lean set air-fuel ratio and before the output air-fuel ratio of the downstream side air-fuel ratio sensor becomes the lean judged air-fuel ratio or more, to when the output air-fuel ratio of the downstream side air-fuel ratio sensor becomes a lean judged air-fuel ratio or more, the target air-fuel ratio is switched from the lean air-fuel ratio to a rich set air-fuel ratio which is richer than the stoichiometric air-fuel ratio, when the output air-fuel ratio of the downstream side air-fuel ratio sensor becomes the lean judged air-fuel ratio or more, and the target air-fuel ratio is set to a rich air-fuel ratio with a smaller rich degree than the rich set air-fuel ratio, from a rich degree change timing after the target air-fuel ratio is set to the rich set air-fuel ratio and before the output air-fuel ratio of the downstream side air-fuel ratio sensor becomes the rich judged air-fuel ratio or less, to when the output air-fuel ratio of the downstream side air-fuel ratio sensor becomes a rich judged air-fuel ratio or less.

In a third aspect of the invention, there is provided the first or second aspect of the invention, wherein when the learning promoting condition stands, if increasing the lean degree of the average target air-fuel ratio while the target air-fuel ratio is set to the lean air-fuel ratio, the extent of increasing the lean degree becomes smaller the longer the elapsed time from when switching the target air-fuel ratio from the rich air-fuel ratio to the lean air-fuel ratio and, when the learning promoting condition stands, if increasing the rich degree of the average target air-fuel ratio while the target air-fuel ratio is set to the rich air-fuel ratio, the extent of increasing the rich degree becomes smaller the longer the elapsed time from when switching the target air-fuel ratio from the lean air-fuel ratio to the rich air-fuel ratio.

In a fourth aspect of the invention, there is provided the second aspect of the invention, wherein even when the learning promoting condition stands, the lean degree of the air-fuel ratio from the lean degree change timing to when the output air-fuel ratio of the downstream side air-fuel ratio sensor becomes the lean judged air-fuel ratio or more and the rich degree of the air-fuel ratio from the rich degree change timing to when the output air-fuel ratio of the downstream side air-fuel ratio sensor becomes the rich judged air-fuel ratio or less are maintained as they are without being increased.

In a fifth aspect of the invention, there is provided any one of the first to fourth aspects of the invention, wherein when the learning promoting condition stands, compared with when the learning promoting condition does not stand, at least one time period of the time period from when the target air-fuel ratio is switched from the rich air-fuel ratio to the lean set air-fuel ratio until the lean degree change timing and the time period from when the target air-fuel ratio is switched from the lean air-fuel ratio to the rich set air-fuel ratio until the rich degree change timing is made longer.

In a sixth aspect of the invention, there is provided any one of the first to fifth aspects of the invention, wherein, in the learning control, based on a first cumulative amount of oxygen which is an absolute value of the cumulative oxygen excess/deficiency in a first time period from when switching the target air-fuel ratio to the lean air-fuel ratio to when the output air-fuel ratio of the downstream side air-fuel ratio sensor becomes the lean judged air-fuel ratio or more, and a second cumulative amount of oxygen which is an absolute value of the cumulative oxygen excess/deficiency in a second time period from when switching the target air-fuel ratio to the rich air-fuel ratio to when the output air-fuel ratio of the downstream side air-fuel ratio sensor becomes the rich judged air-fuel ratio less, a parameter relating to the feedback control is corrected so that a difference between the first cumulative amount of oxygen and the second cumulative amount of oxygen becomes smaller.

In a seventh aspect of the invention, there is provided the sixth aspect of the invention, wherein the learning promoting condition stands when the difference of the first cumulative amount of oxygen and the second cumulative amount of oxygen is a predetermined promotion judged reference value or more.

In a eighth aspect of the invention, there is provided any one of the first to seventh aspects of the invention, wherein the learning promoting condition stands when the target air-fuel ratio is set to either the rich air-fuel ratio or lean air-fuel ratio and the output air-fuel ratio of the downstream side air-fuel ratio sensor is maintained in a air-fuel ratio region close to the stoichiometric air-fuel ratio, which is between the rich judged air-fuel ratio and the lean judged air-fuel ratio, over a predetermined stoichiometric air-fuel ratio promotion judged time or more, or over a time period until the cumulative oxygen excess/deficiency becomes a predetermined value or more.

In a ninth aspect of the invention, there is provided the eight aspect of the invention, wherein the learning promoting condition stands when the target air-fuel ratio is set to a rich air-fuel ratio and the output air-fuel ratio of the downstream side air-fuel ratio sensor is maintained at the lean judged air-fuel ratio or more, over a rich air-fuel ratio promotion judged time, which is shorter than the stoichiometric air-fuel ratio promotion judged time, or more.

In a tenth aspect of the invention, there is provided the eighth or ninth aspect of the invention, wherein the learning promoting condition stands when the target air-fuel ratio is set to a lean air-fuel ratio and the output air-fuel ratio of the downstream side air-fuel ratio sensor is maintained at the rich judged air-fuel ratio or less, over a lean air-fuel ratio promotion judged time, which is shorter than the stoichiometric air-fuel ratio promotion judged time, or more.

In a 11th aspect of the invention, there is provided any one of the first to tenth aspects of the invention, wherein the parameter relating to the feedback control is any of the target air-fuel ratio, fuel feed rate, and air-fuel ratio serving as the center of control.

In a 12th aspect of the invention, there is provided any one of the first to tenth aspects of the invention, wherein the engine further comprises an upstream side air-fuel ratio sensor which is arranged at an upstream side, in the direction of exhaust flow, of the exhaust purification catalyst and which detects the air-fuel ratio of the exhaust gas which flows into the exhaust purification catalyst, feedback control is performed on the rate of feed of fuel which is fed to the combustion chamber of the internal combustion engine so that the output air-fuel ratio of the upstream side air-fuel ratio sensor becomes the target air-fuel ratio, and the parameter relating to the feedback control is the output value of the upstream side air-fuel ratio sensor.

Advantageous Effects of Invention

According to the present invention, there is provided an internal combustion engine which can suitably change a speed of updating a learning value, even when performing control which alternately switches a target air-fuel ratio between a rich air-fuel ratio and a lean air-fuel ratio.

DESCRIPTION OF EMBODIMENTS

Figure 1:
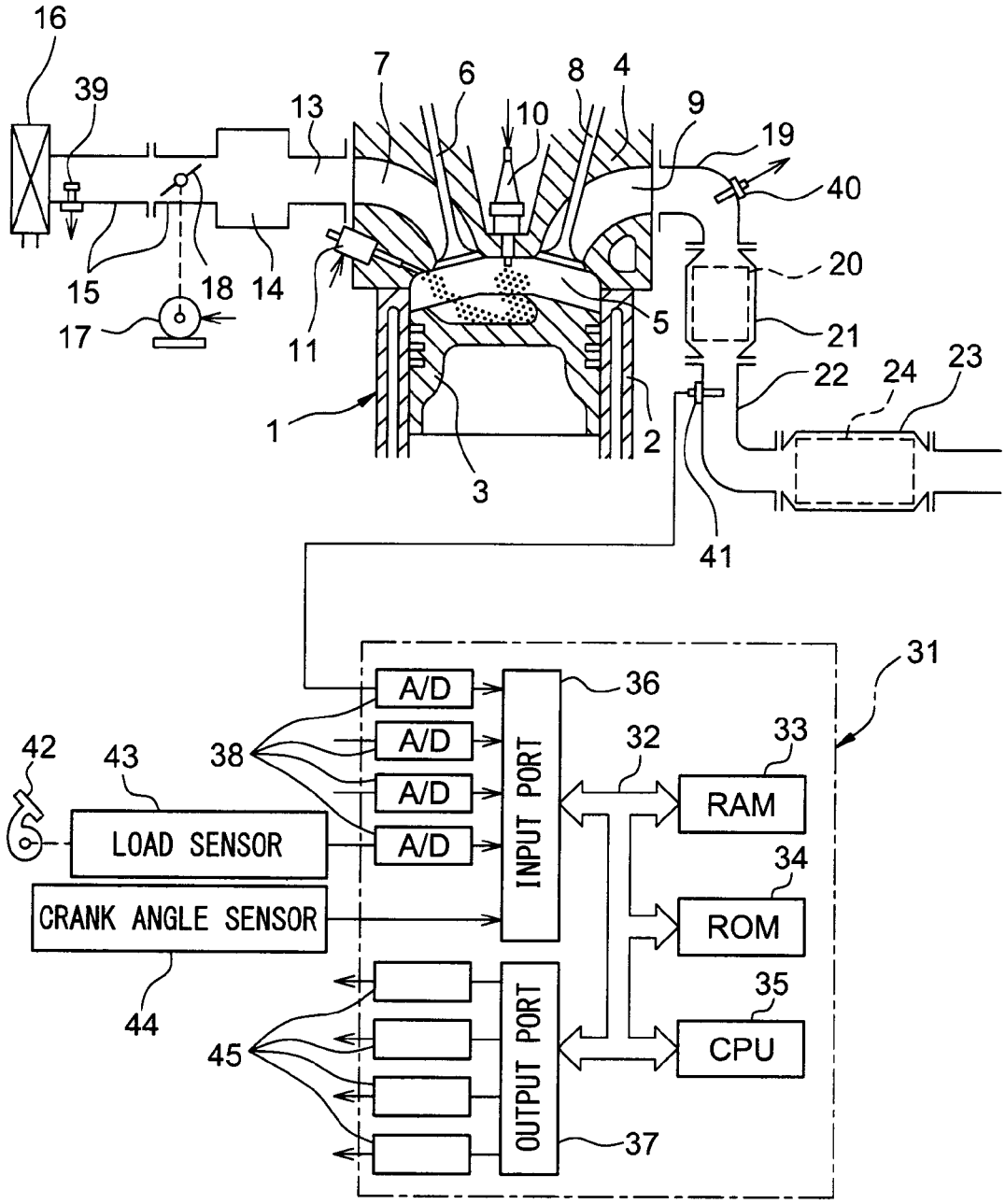
FIG. 1 is a view which schematically shows an internal combustion engine in which a control device of the present invention is used.

Below, referring to the drawings, embodiments of the present invention will be explained in detail. Note that, in the following explanation, similar component elements are assigned the same reference numerals.

<Explanation of Internal Combustion Engine as a Whole>

FIG. 1 is a view which schematically shows an internal combustion engine in which a control device according to the present invention is used. In FIG. 1, 1 indicates an engine body, 2 a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a side part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 is used. However, the internal combustion engine of the present embodiment may also use another fuel.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a header at which these runners are collected. The header of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 is arranged for detecting the flow rate of air which flows through the intake pipe 15. The output of this air flow meter 39 is input through a corresponding AD converter 38 to the input port 36. Further, at the header of the exhaust manifold 19, an upstream side air-fuel ratio sensor 40 is arranged which detects the air-fuel ratio of the exhaust gas which flows through the inside of the exhaust manifold 19 (that is, the exhaust gas which flows into the upstream side exhaust purification catalyst 20). In addition, in the exhaust pipe 22, a downstream side air-fuel ratio sensor 41 is arranged which detects the air-fuel ratio of the exhaust gas which flows through the inside of the exhaust pipe 22 (that is, the exhaust gas which flows out from the upstream side exhaust purification catalyst 20 and flows into the downstream side exhaust purification catalyst 24). The outputs of these air-fuel ratio sensors 40 and 41 are also input through the corresponding AD converters 38 to the input port 36.

Further, an accelerator pedal 42 has a load sensor 43 connected to it which generates an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that the ECU 31 functions as a control system for controlling the internal combustion engine.

Note that, the internal combustion engine according to the present embodiment is a non-supercharged internal combustion engine which is fueled by gasoline, but the internal combustion engine according to the present invention is not limited to the above configuration. For example, the internal combustion engine according to the present invention may have cylinder array, state of injection of fuel, configuration of intake and exhaust systems, configuration of valve mechanism, presence of supercharger, supercharged state, etc. which are different from the above internal combustion engine.

<Explanation of Exhaust Purification Catalyst>

The upstream side exhaust purification catalyst 20 and downstream side exhaust purification catalyst 24 in each case have similar configurations. The exhaust purification catalysts 20 and 24 are three-way catalysts which have oxygen storage abilities. Specifically, the exhaust purification catalysts 20 and 24 are comprised of carriers which are comprised of ceramic on which a precious metal which has a catalytic action (for example, platinum (Pt)) and a substance which has an oxygen storage ability (for example, ceria ($CeO_2$)) are carried. The exhaust purification catalysts 20 and 24 exhibit a catalytic action of simultaneously removing unburned gas (HC, CO, etc.) and nitrogen oxides ($NO_x$) when reaching a predetermined activation temperature and, in addition, an oxygen storage ability.

According to the oxygen storage ability of the exhaust purification catalysts 20 and 24, the exhaust purification catalysts 20 and 24 store the oxygen in the exhaust gas when the air-fuel ratio of the exhaust gas which flows into the exhaust purification catalysts 20 and 24 is leaner than the stoichiometric air-fuel ratio (lean air-fuel ratio). On the other hand, the exhaust purification catalysts 20 and 24 release the oxygen which is stored in the exhaust purification catalysts 20 and 24 when the inflowing exhaust gas has an air-fuel ratio which is richer than the stoichiometric air-fuel ratio (rich air-fuel ratio).

Figure 2A:
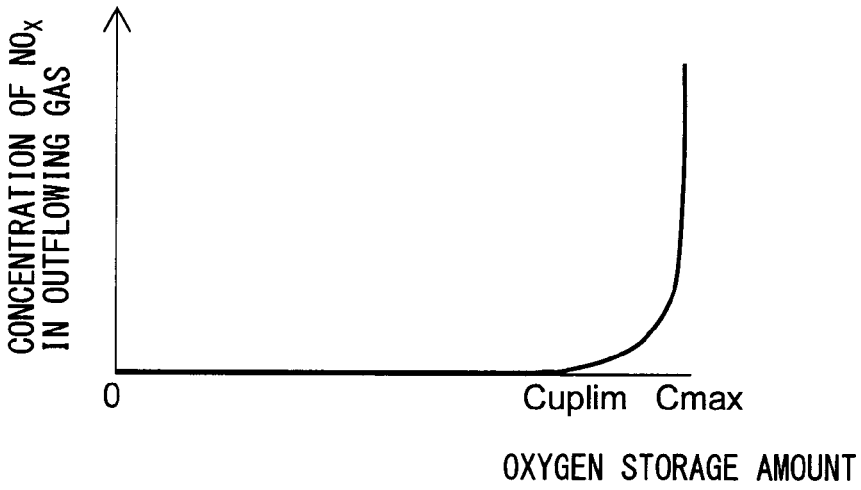
FIG. 2A is a view which shows the relationship between the oxygen storage amount of the exhaust purification catalyst and concentration of $NO_x$ in the exhaust gas which flows out from the exhaust purification catalyst.

The exhaust purification catalysts 20 and 24 have a catalytic action and oxygen storage ability and thereby have the action of removing $NO_x$ and unburned gas according to the oxygen storage amount. That is, in the case where the air-fuel ratio of the exhaust gas which flows into the exhaust purification catalysts 20 and 24 is a lean air-fuel ratio, as shown in FIG. 2A, when the oxygen storage amount is small, the exhaust purification catalysts 20 and 24 store the oxygen in the exhaust gas. Further, along with this, the $NO_x$ in the exhaust gas is removed by reduction. On the other hand, if the oxygen storage amount becomes larger, the exhaust gas flowing out from the exhaust purification catalysts 20 and 24 rapidly rises in concentration of oxygen and $NO_x$ at a certain stored amount (in the figure, Cuplim) near the maximum storable oxygen amount Cmax (upper limit storage amount).

Figure 2B:
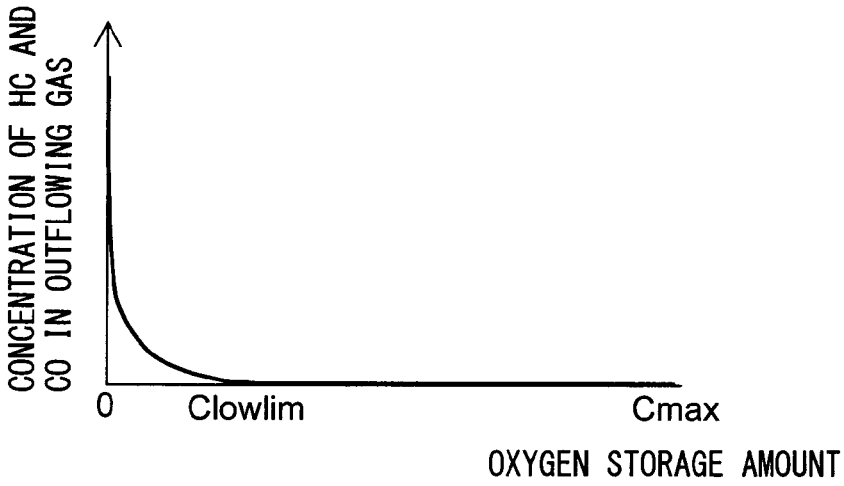
FIG. 2B is a view which shows the relationship between the oxygen storage amount of the exhaust purification catalyst and concentration of HC or CO in the exhaust gas which flows out from the exhaust purification catalyst.

On the other hand, in the case where the air-fuel ratio of the exhaust gas flowing into the exhaust purification catalysts 20 and 24 is the rich air-fuel ratio, as shown in FIG. 2B, when the oxygen storage amount is large, the oxygen stored in the exhaust purification catalysts 20 and 24 is released, and the unburned gas in the exhaust gas is removed by oxidation. On the other hand, if the oxygen storage amount becomes small, the exhaust gas flowing out from the exhaust purification catalysts 20 and 24 rapidly rises in concentration of unburned gas at a certain stored amount (in the figure, Clowlim) near zero (lower limit storage amount).

In the above way, according to the exhaust purification catalysts 20 and 24 which are used in the present embodiment, the characteristics of removal of $NO_x$ and unburned gas in the exhaust gas change depending on the air-fuel ratio and oxygen storage amount of the exhaust gas which flows into the exhaust purification catalysts 20 and 24. Note that, if having a catalytic action and oxygen storage ability, the exhaust purification catalysts 20 and 24 may also be catalysts different from three-way catalysts.

<Output Characteristic of Air-Fuel Ratio Sensor>

Figure 3:
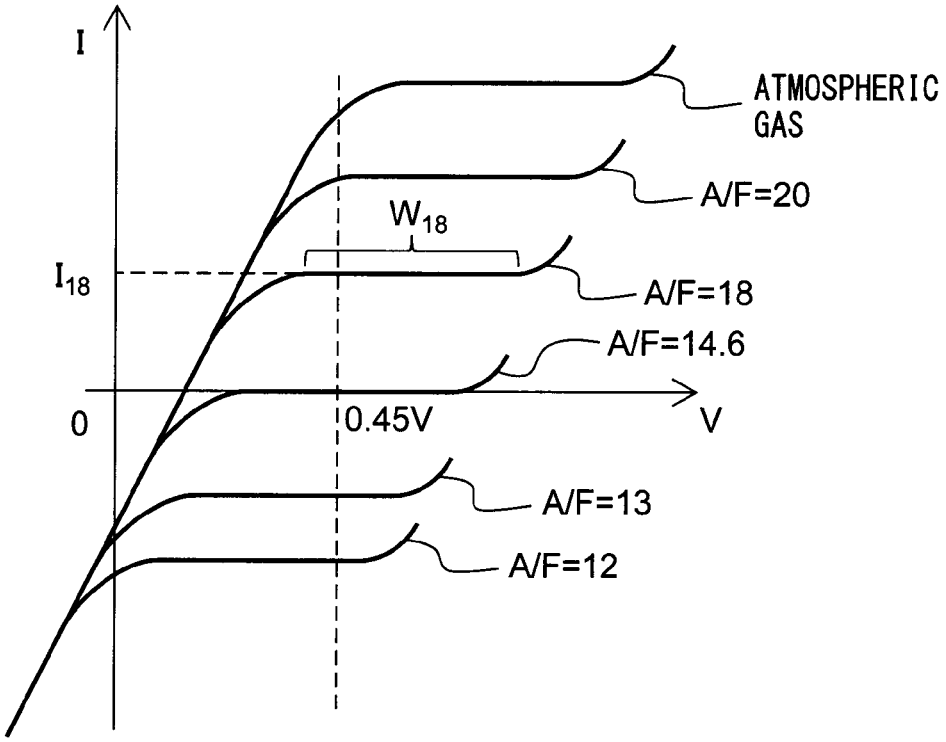
FIG. 3 is a view which shows the relationship between the voltage supplied to the sensor and output current at different exhaust air-fuel ratios.
Figure 4:
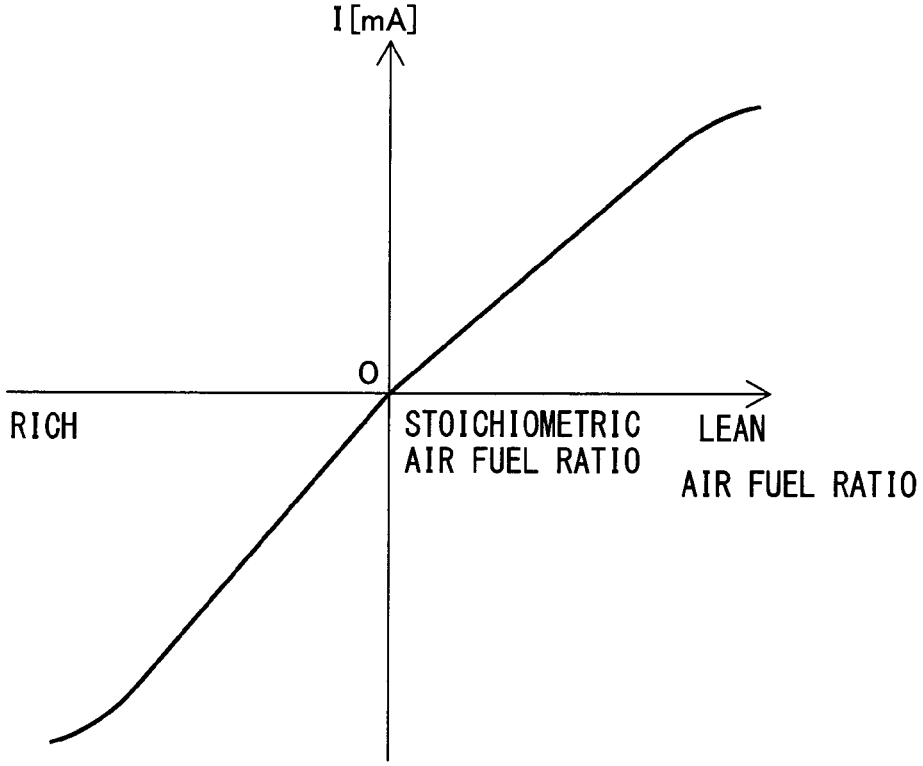
FIG. 4 is a view which shows the relationship between the exhaust air-fuel ratio and output current when making the voltage supplied to the sensor constant.

Next, referring to FIGS. 3 and 4, the output characteristic of air-fuel ratio sensors 40 and 41 in the present embodiment will be explained. FIG. 3 is a view showing the voltage-current (V-I) characteristic of the air-fuel ratio sensors 40 and 41 of the present embodiment. FIG. 4 is a view showing the relationship between air-fuel ratio of the exhaust gas (below, referred to as "exhaust air-fuel ratio") flowing around the air-fuel ratio sensors 40 and 41 and output current I, when making the applied voltage constant. Note that, in this embodiment, the air-fuel ratio sensor having the same configurations is used as both air-fuel ratio sensors 40 and 41.

As will be understood from FIG. 3, in the air-fuel ratio sensors 40 and 41 of the present embodiment, the output current I becomes larger the higher (the leaner) the exhaust air-fuel ratio. Further, the line V-I of each exhaust air-fuel ratio has a region substantially parallel to the V axis, that is, a region where the output current does not change much at all even if the applied voltage of the sensor changes. This voltage region is referred to as the "limit current region". The current at this time is referred to as the "limit current". In FIG. 3, the limit current region and limit current when the exhaust air-fuel ratio is 18 are shown by $W_{18}$ and $I_{18}$, respectively. Therefore, the air-fuel ratio sensors 40 and 41 can be referred to as "limit current type air-fuel ratio sensors".

FIG. 4 is a view which shows the relationship between the exhaust air-fuel ratio and the output current I when making the applied voltage constant at about 0.45V. As will be understood from FIG. 4, in the air-fuel ratio sensors 40 and 41, the output current I varies linearly (proportionally) with respect to the exhaust air-fuel ratio such that the higher (that is, the leaner) the exhaust air-fuel ratio, the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio. Further, when the exhaust air-fuel ratio becomes a certain value or more or when it becomes a certain value or less, the ratio of change of the output current to the change of the exhaust air-fuel ratio becomes smaller.

Note that, in the above example, as the air-fuel ratio sensors 40 and 41, limit current type air-fuel ratio sensors are used. However, as the air-fuel ratio sensors 40 and 41, it is also possible to use air-fuel ratio sensor not a limit current type or any other air-fuel ratio sensor, as long as the output current varies linearly with respect to the exhaust air-fuel ratio. Further, the air-fuel ratio sensors 40 and 41 may have structures different from each other.

<Summary of Basic Air-Fuel Ratio Control>

Next, the air-fuel ratio control in a control system of an internal combustion engine of the present invention will be summarized. In the present embodiment, feedback control is performed based on the output air-fuel ratio of the upstream side air-fuel ratio sensor 40 to control the fuel injection amount from the fuel injector 11 so that the output air-fuel ratio of the upstream side air-fuel ratio sensor 40 becomes the target air-fuel ratio. Note that, the "output air-fuel ratio" means the air-fuel ratio which corresponds to the output value of the air-fuel ratio sensor.

On the other hand, in the air-fuel ratio control of the present embodiment, target air-fuel ratio setting control is performed to set the target air-fuel ratio based on the output air-fuel ratio of the downstream side air-fuel ratio sensor 41, etc. In target air-fuel ratio setting control, when the output air-fuel ratio of the downstream side air-fuel ratio sensor 41 becomes a rich judged air-fuel ratio (for example, 14.55), which is slightly richer than the stoichiometric air-fuel ratio, or less, it is judged that the air-fuel ratio of the exhaust gas which is detected by the downstream side air-fuel ratio sensor 41 has become the rich air-fuel ratio. At this time, the target air-fuel ratio is set to a lean set air-fuel ratio. In this regard, the "lean set air-fuel ratio" is a predetermined air-fuel ratio which is leaner than the stoichiometric air-fuel ratio (air-fuel ratio serving as center of control) by a certain extent, and, for example, is 14.65 to 20, preferably 14.65 to 18, more preferably 14.65 to 16 or so.

After that, if, in the state where the target air-fuel ratio is set to the lean set air-fuel ratio, the output air-fuel ratio of the downstream side air-fuel ratio sensor 41 becomes an air-fuel ratio which is leaner than the rich judged air-fuel ratio (air-fuel ratio which is closer to the stoichiometric air-fuel ratio than the rich judged air-fuel ratio), it is judged that the air-fuel ratio of the exhaust gas which is detected by the downstream side air-fuel ratio sensor 41 has become substantially the stoichiometric air-fuel ratio. At this time, the target air-fuel ratio is set to a slight lean set air-fuel ratio. In this regard, the "slight lean set air-fuel ratio" is a lean air-fuel ratio with a smaller lean degree than the lean set air-fuel ratio (smaller difference from stoichiometric air-fuel ratio), and, for example, is 14.62 to 15.7, preferably 14.63 to 15.2, more preferably 14.65 to 14.9 or so.

On the other hand, when the output air-fuel ratio of the downstream side air-fuel ratio sensor 41 becomes a lean judged air-fuel ratio (for example, 14.65), which is slightly leaner than the stoichiometric air-fuel ratio, or more, it is judged that the air-fuel ratio of the exhaust gas which is detected by the downstream side air-fuel ratio sensor 41 has become the lean air-fuel ratio. At this time, the target air-fuel ratio is set to a rich set air-fuel ratio. In this regard, the "rich set air-fuel ratio" is a predetermined air-fuel ratio which is richer than the stoichiometric air-fuel ratio (air-fuel ratio serving as the center of control) by a certain extent, and, for example, is 10 to 14.55, preferably 12 to 14.52, more preferably 13 to 14.5 or so.

After that, if, in the state where the target air-fuel ratio is set to the rich set air-fuel ratio, the output air-fuel ratio of the downstream side air-fuel ratio sensor 41 becomes an air-fuel ratio which is richer than the lean judged air-fuel ratio (air-fuel ratio which is closer to the stoichiometric air-fuel ratio than the lean judged air-fuel ratio), it is judged that the air-fuel ratio of the exhaust gas which is detected by the downstream side air-fuel ratio sensor 41 has become substantially the stoichiometric air-fuel ratio. At this time, the target air-fuel ratio is set to a slight rich set air-fuel ratio. In this regard, the "slight rich set air-fuel ratio" is a rich air-fuel ratio with a smaller rich degree than the rich set air-fuel ratio (smaller difference from the stoichiometric air-fuel ratio), and, for example, is 13.5 to 14.58, preferably 14 to 14.57, more preferably 14.3 to 14.55 or so.

As a result, in the present embodiment, if the output air-fuel ratio of the downstream side air-fuel ratio sensor 41 becomes the rich judged air-fuel ratio or less, first, the target air-fuel ratio is set to the lean set air-fuel ratio. After that, if the output air-fuel ratio of the downstream side air-fuel ratio sensor 41 becomes larger than the rich judged air-fuel ratio, the target air-fuel ratio is set to the slight lean set air-fuel ratio. On the other hand, if the output air-fuel ratio of the downstream side air-fuel ratio sensor 41 becomes the lean judged air-fuel ratio or more, first, the target air-fuel ratio is set to the rich set air-fuel ratio. After that, if the output air-fuel ratio of the downstream side air-fuel ratio sensor 41 becomes smaller than the lean judged air-fuel ratio, the target air-fuel ratio is set to the slight rich set air-fuel ratio. After that, similar control is repeated.

Note that, the rich judged air-fuel ratio and lean judged air-fuel ratio are air-fuel ratios of within 1% of the stoichiometric air-fuel ratio, preferably within 0.5%, more preferably within 0.35%. Therefore, the difference of the rich judged air-fuel ratio and lean judged air-fuel ratio from the stoichiometric air-fuel ratio is, if the stoichiometric air-fuel ratio is 14.6, 0.15 or less, preferably 0.073 or less, more preferably 0.051 or less. Further, the difference of the target air-fuel ratio (for example, the slight rich set air-fuel ratio or lean set air-fuel ratio) from the stoichiometric air-fuel ratio is set to become larger than the above-mentioned difference.

<Explanation of Control Using Time Chart>

Figure 5:
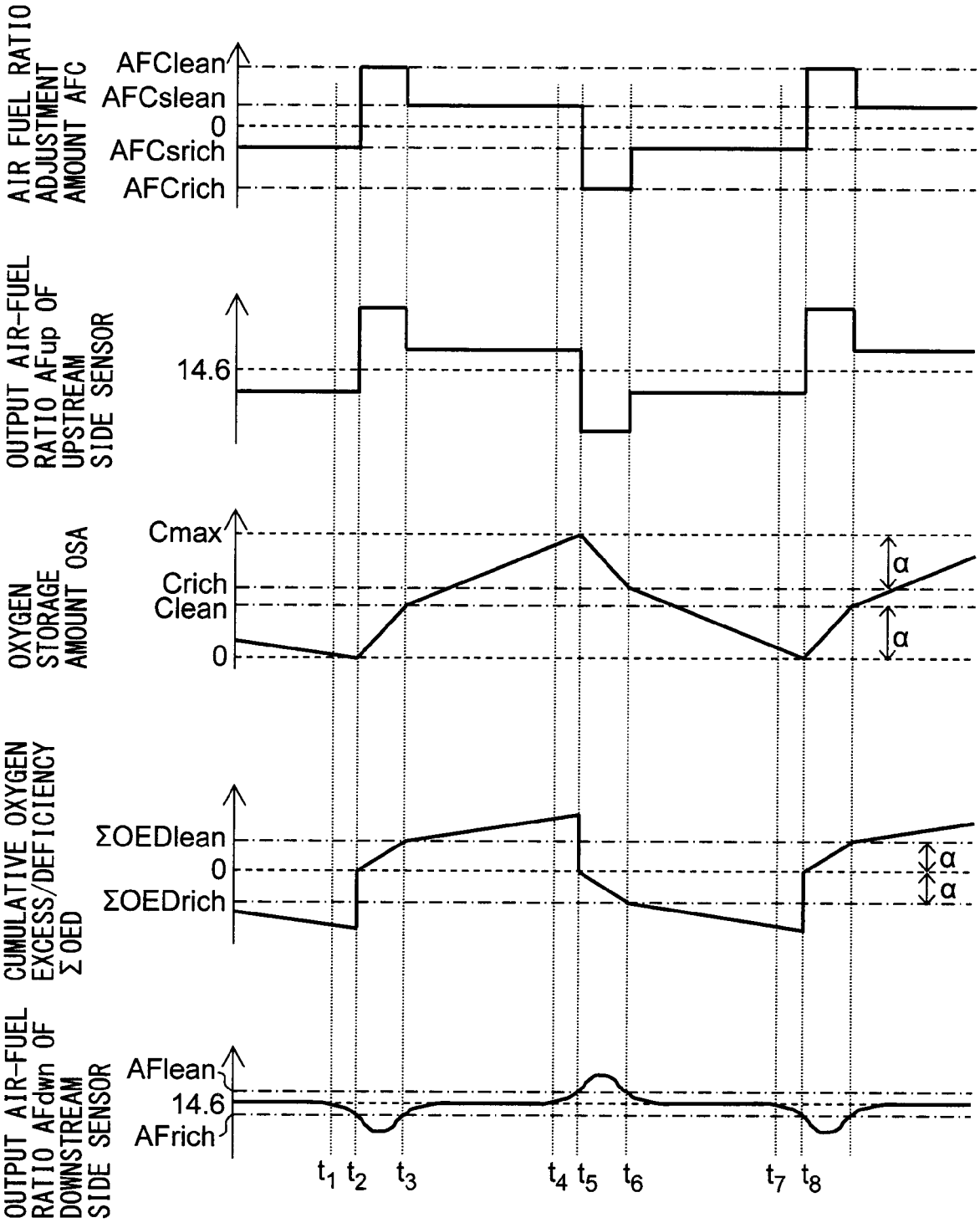
FIG. 5 is a time chart of air-fuel ratio adjustment amount, etc., when performing basic air-fuel ratio control by the control system of an internal combustion engine according to the present embodiment.

Referring to FIG. 5, the above-mentioned operation will be specifically explained. FIG. 5 is a time chart of the air-fuel ratio adjustment amount AFC, the output air-fuel ratio AFup of the upstream side air-fuel ratio sensor 40, the oxygen storage amount OSA of the upstream side exhaust purification catalyst 20, the cumulative oxygen excess/deficiency ΣOED in the exhaust gas flowing into the upstream side exhaust purification catalyst 20, and the output air-fuel ratio AFdwn of the downstream side air-fuel ratio sensor 41, in the case of performing basic air-fuel ratio control by the control system of an internal combustion engine according to the present embodiment.

Note that the air-fuel ratio adjustment amount AFC is a adjustment amount relating to the target air-fuel ratio of the exhaust gas flowing into the upstream side exhaust purification catalyst 20. When the air-fuel ratio adjustment amount AFC is 0, the target air-fuel ratio is set to an air-fuel ratio which is equal to the air-fuel ratio serving as the control center (below, referred to as the "control center air-fuel ratio") (in the present embodiment, basically, the stoichiometric air-fuel ratio). When the air-fuel ratio adjustment amount AFC is a positive value, the target air-fuel ratio becomes an air-fuel ratio leaner than the control center air-fuel ratio (in the present embodiment, the lean air-fuel ratio), while when the air-fuel ratio adjustment amount AFC is a negative value, the target air-fuel ratio becomes an air-fuel ratio richer than the control center air-fuel ratio (in the present embodiment, rich air-fuel ratio). Further, the "control center air-fuel ratio" means the air-fuel ratio to which of the air-fuel ratio adjustment amount AFC is added in accordance with the engine operating state, that is, the air-fuel ratio which is the reference when changing the target air-fuel ratio in accordance with the air-fuel ratio adjustment amount AFC.

In the illustrated example, in the state before the time $t_1$, the air-fuel ratio adjustment amount AFC is set to the slight rich set adjustment amount AFCsrich (corresponding to slight rich set air-fuel ratio). That is, the target air-fuel ratio is set to the rich air-fuel ratio. Along with this, the output air-fuel ratio of the upstream side air-fuel ratio sensor 40 becomes the rich air-fuel ratio. The unburned gas, which is contained in the exhaust gas flowing into the upstream side exhaust purification catalyst 20, is purified by the upstream side exhaust purification catalyst 20. Along with this, the oxygen storage amount OSA of the upstream side exhaust purification catalyst 20 gradually decreases. On the other hand, due to purification at the upstream side exhaust purification catalyst 20, the exhaust gas flowing out from the upstream side exhaust purification catalyst 20 does not contain unburned gas, and therefore the output air-fuel ratio AFdwn of the downstream side air-fuel ratio sensor 41 becomes substantially the stoichiometric air-fuel ratio.

If the oxygen storage amount OSA of the upstream side exhaust purification catalyst 20 gradually decreases, the oxygen storage amount OSA approaches zero (for example, Clowlim of FIG. 2B) at the time $t_1$. Along with this, part of the unburned gas flowing into the upstream side exhaust purification catalyst 20 starts to flow out without being purified by the upstream side exhaust purification catalyst 20. Due to this, after the time $t_1$, the output air-fuel ratio AFdwn of the downstream side air-fuel ratio sensor 41 gradually falls. As a result, in the illustrated example, at the time $t_2$, the oxygen storage amount OSA becomes substantially zero and the output air-fuel ratio AFdwn of the downstream side air-fuel ratio sensor 41 reaches the rich judged air-fuel ratio AFrich.

In the present embodiment, if the output air-fuel ratio AFdwn of the downstream side air-fuel ratio sensor 41 becomes the rich judged air-fuel ratio AFrich or less, in order to make the oxygen storage amount OSA increase, the air-fuel ratio adjustment amount AFC is switched to the lean set adjustment amount AFClean (corresponding to lean set air-fuel ratio). Therefore, the target air-fuel ratio is switched from the rich air-fuel ratio to the lean air-fuel ratio.

Note that, in the present embodiment, the air-fuel ratio adjustment amount AFC is not switched immediately after the output air-fuel ratio AFdwn of the downstream side air-fuel ratio sensor 41 changes from the stoichiometric air-fuel ratio to the rich air-fuel ratio, but is switched after the rich judged air-fuel ratio AFrich is reached. This is because even if the oxygen storage amount OSA of the upstream side exhaust purification catalyst 20 is sufficient, sometimes the air-fuel ratio of the exhaust gas flowing out from the upstream side exhaust purification catalyst 20 deviates very slightly from the stoichiometric air-fuel ratio. Conversely speaking, the rich judged air-fuel ratio is set to an air-fuel ratio which the air-fuel ratio of the exhaust gas flowing out from the upstream side exhaust purification catalyst 20 never reaches when the oxygen storage amount of the upstream side exhaust purification catalyst 20 is sufficient. Note that the same can be said for the above-mentioned lean judged air-fuel ratio.

If switching the target air-fuel ratio to the lean air-fuel ratio at the time $t_2$, the air-fuel ratio of the exhaust gas flowing into the upstream side exhaust purification catalyst 20 changes from the rich air-fuel ratio to the lean air-fuel ratio. Further, along with this, the output air-fuel ratio AFup of the upstream side air-fuel ratio sensor 40 becomes the lean air-fuel ratio (in actuality, a delay occurs from when switching the target air-fuel ratio to when the air-fuel ratio of the exhaust gas flowing into the upstream side exhaust purification catalyst 20 changes, but in the illustrated example, it is assumed for convenience that they change simultaneously). If the air-fuel ratio of the exhaust gas flowing into the upstream side exhaust purification catalyst 20 changes to the lean air-fuel ratio at the time $t_2$, the oxygen storage amount OSA of the upstream side exhaust purification catalyst 20 increases.

If the oxygen storage amount OSA of the upstream side exhaust purification catalyst 20 increases in this way, the air-fuel ratio of the exhaust gas flowing out from the upstream side exhaust purification catalyst 20 changes toward the stoichiometric air-fuel ratio. In the example shown in FIG. 5, at the time $t_3$, the output air-fuel ratio AFdwn of the downstream side air-fuel ratio sensor 41 becomes a value larger than the rich judged air-fuel ratio AFrich. That is, the output air-fuel ratio AFdwn of the downstream side air-fuel ratio sensor 41 becomes substantially the stoichiometric air-fuel ratio. This means that the oxygen storage amount OSA of the upstream side exhaust purification catalyst 20 has become larger by a certain extent.

Therefore, in the present embodiment, when the output air-fuel ratio AFdwn of the downstream side air-fuel ratio sensor 41 changes to a value larger than the rich judged air-fuel ratio AFrich, the air-fuel ratio adjustment amount AFC is switched to the slight lean set adjustment amount AFCslean (corresponding to slight lean set air-fuel ratio). Therefore, at the time $t_3$, the lean degree of the target air-fuel ratio falls. Below, the time $t_3$ will be referred to as the "lean degree change timing".

At the lean degree change timing of the time $t_3$, if switching the air-fuel ratio adjustment amount AFC to the slight lean set adjustment amount AFCslean, the lean degree of the exhaust gas flowing into the upstream side exhaust purification catalyst 20 also becomes smaller. Along with this, the output air-fuel ratio AFup of the upstream side air-fuel ratio sensor 40 becomes smaller and the speed of increase of the oxygen storage amount OSA of the upstream side exhaust purification catalyst 20 falls.

After the time $t_3$, the oxygen storage amount OSA of the upstream side exhaust purification catalyst 20 gradually increases, through the speed of increase is slow. If the oxygen storage amount OSA of the upstream side exhaust purification catalyst 20 gradually increases, the oxygen storage amount OSA will finally approach the maximum storable oxygen amount Cmax (for example, Cuplim of FIG. 2A). If at the time $t_4$ the oxygen storage amount OSA approaches the maximum storable oxygen amount Cmax, part of the oxygen flowing into the upstream side exhaust purification catalyst 20 will start to flow out without being stored at the upstream side exhaust purification catalyst 20. Due to this, the output air-fuel ratio AFdwn of the downstream side air-fuel ratio sensor 41 will gradually rise. As a result, in the illustrated example, at the time $t_5$, the oxygen storage amount OSA reaches the maximum storable oxygen amount Cmax and the output air-fuel ratio AFdwn of the downstream side air-fuel ratio sensor 41 reaches the lean judged air-fuel ratio AFlean.

In the present embodiment, if the output air-fuel ratio AFdwn of the downstream side air-fuel ratio sensor 41 becomes the lean judged air-fuel ratio AFlean or more, the air-fuel ratio adjustment amount AFC is switched to the rich set adjustment amount AFCrich so as to make the oxygen storage amount OSA decrease. Therefore, the target air-fuel ratio is switched from the lean air-fuel ratio to the rich air-fuel ratio.

If, at the time $t_5$, the target air-fuel ratio is switched to the rich air-fuel ratio, the air-fuel ratio of the exhaust gas flowing into the upstream side exhaust purification catalyst 20 changes from the lean air-fuel ratio to the rich air-fuel ratio. Further, along with this, the output air-fuel ratio AFup of the upstream side air-fuel ratio sensor 40 becomes the rich air-fuel ratio (in actuality, a delay occurs from when the target air-fuel ratio is switched to when the air-fuel ratio of the exhaust gas flowing into the upstream side exhaust purification catalyst 20 changes, but in the illustrated example, for convenience, it is assumed that they change simultaneously). If, at the time $t_5$, the air-fuel ratio of the exhaust gas flowing into the upstream side exhaust purification catalyst 20 changes to the rich air-fuel ratio, the oxygen storage amount OSA of the upstream side exhaust purification catalyst 20 decreases.

If the oxygen storage amount OSA of the upstream side exhaust purification catalyst 20 decreases in this way, the air-fuel ratio of the exhaust gas flowing out from the upstream side exhaust purification catalyst 20 changes toward the stoichiometric air-fuel ratio. In the example shown in FIG. 5, at the time $t_6$, the output air-fuel ratio AFdwn of the downstream side air-fuel ratio sensor 41 becomes a value which is smaller than the lean judged air-fuel ratio AFlean. That is, the output air-fuel ratio AFdwn of the downstream side air-fuel ratio sensor 41 becomes substantially the stoichiometric air-fuel ratio. This means that the oxygen storage amount OSA of the upstream side exhaust purification catalyst 20 has become smaller by a certain extent.

Therefore, in the present embodiment, when the output air-fuel ratio AFdwn of the downstream side air-fuel ratio sensor 41 changes to a value which is smaller than the lean judged air-fuel ratio AFlean, the air-fuel ratio adjustment amount AFC is switched from the rich set adjustment amount to the slight rich set adjustment amount AFCsrich (corresponding to slight rich set air-fuel ratio).

If, at the time $t_6$, the air-fuel ratio adjustment amount AFC is switched to the slight rich set adjustment amount AFCsrich, the rich degree of the air-fuel ratio of the exhaust gas flowing into the upstream side exhaust purification catalyst 20 also becomes smaller. Along with this, the output air-fuel ratio AFup of the upstream side air-fuel ratio sensor 40 increases and the speed of decrease of the oxygen storage amount OSA of the upstream side exhaust purification catalyst 20 falls.

After the time $t_6$, the oxygen storage amount OSA of the upstream side exhaust purification catalyst 20 gradually decreases, though the speed of decrease is slow. If the oxygen storage amount OSA of the upstream side exhaust purification catalyst 20 gradually decreases, the oxygen storage amount OSA finally approaches zero at the time $t_7$ in the same way as the time $t_1$ and decreases to the Cdwnlim of FIG. 2B. Then, at the time $t_8$, in the same way as the time $t_2$, the output air-fuel ratio AFdwn of the downstream side air-fuel ratio sensor 41 reaches the rich judged air-fuel ratio AFrich. After that, an operation similar to the operation of the times $t_1$ to $t_6$ is repeated.

<Advantages in Basic Control>

According to the above-mentioned basic air-fuel ratio control, right after the target air-fuel ratio is changed from the rich air-fuel ratio to the lean air-fuel ratio at the time $t_2$ and right after the target air-fuel ratio is changed from the lean air-fuel ratio to the rich air-fuel ratio at the time $t_5$, the difference from the stoichiometric air-fuel ratio is set large (that is, the rich degree or lean degree is set large). For this reason, it is possible to rapidly decrease the unburned gas which flowed out from the upstream side exhaust purification catalyst 20 at the time $t_2$ and the $NO_x$ which flowed out from the upstream side exhaust purification catalyst 20 at the time $t_5$. Therefore, it is possible to suppress the outflow of unburned gas and $NO_x$ from the upstream side exhaust purification catalyst 20.

Further, according to the air-fuel ratio control of the present embodiment, the target air-fuel ratio is set to the lean set air-fuel ratio at the time $t_2$, then the outflow of unburned gas from the upstream side exhaust purification catalyst 20 stops and the oxygen storage amount OSA of the upstream side exhaust purification catalyst 20 recovers to a certain extent, then at the time $t_3$, the target air-fuel ratio is switched to the slight lean set air-fuel ratio. By making the rich degree (difference from stoichiometric air-fuel ratio) of the target air-fuel ratio smaller, even if $NO_x$ flows out from the upstream side exhaust purification catalyst 20, it is possible to decrease the amount of outflow thereof per unit time. In particular, if performing the above air-fuel ratio control, at the time $t_5$, $NO_x$ flows out from the upstream side exhaust purification catalyst 20, but the amount of outflow at this time can be kept small.

In addition, according to the air-fuel ratio control of the present embodiment, the target air-fuel ratio is set to the rich set air-fuel ratio at the time $t_5$, then the outflow of $NO_x$ (oxygen) from the upstream side exhaust purification catalyst 20 stops and the oxygen storage amount OSA of the upstream side exhaust purification catalyst 20 decreases by a certain extent, then at the time $t_6$, the target air-fuel ratio is switched to the slight rich set air-fuel ratio. By making the rich degree (difference from stoichiometric air-fuel ratio) of the target air-fuel ratio smaller, even if unburned gas flows out from the upstream side exhaust purification catalyst 20, it is possible to decrease the amount of outflow thereof per unit time. In particular, according to the above air-fuel ratio control, during the times $t_2$ and $t_8$, unburned gas flows out from the upstream side exhaust purification catalyst 20, but the amount of outflow at this time can be kept small.

Furthermore, in the present embodiment, as the sensor which detects the air-fuel ratio of the exhaust gas at the downstream side, the air-fuel ratio sensor 41 is used. This air-fuel ratio sensor 41, unlike an oxygen sensor, does not have hysteresis. Therefore, the air-fuel ratio sensor 41 has a high response with respect to the actual exhaust air-fuel ratio, and thus it is possible to quickly detect the outflow of unburned gas and oxygen (and $NO_x$) from the upstream side exhaust purification catalyst 20. Therefore, by this as well, according to the present embodiment, it is possible to suppress the outflow of unburned gas and $NO_x$ (and oxygen) from the upstream side exhaust purification catalyst 20.

Further, in an exhaust purification catalyst which can store oxygen, if maintaining the oxygen storage amount substantially constant, the oxygen storage capacity will be dropped. Therefore, in order to maintain the oxygen storage capacity as much as possible, it is necessary to make the oxygen storage amount change up and down at the time of use of the exhaust purification catalyst. According to the air-fuel ratio control according to the present embodiment, the oxygen storage amount OSA of the upstream side exhaust purification catalyst 20 repeatedly changes up and down between near zero and near the maximum storable oxygen amount. For this reason, the oxygen storage capacity of the upstream side exhaust purification catalyst 20 can be maintained high as much as possible.

Note that, in the above embodiment, when, at the time $t_3$, the output air-fuel ratio AFdwn of the downstream side air-fuel ratio sensor 41 becomes a value larger than the rich judged air-fuel ratio AFrich, the air-fuel ratio adjustment amount AFC is switched from the lean set adjustment amount AFlean to the slight lean set adjustment amount AFCslean. Further, in the above embodiment, when, at the time $t_6$, the output air-fuel ratio AFdwn of the downstream side air-fuel ratio sensor 41 becomes a value smaller than the lean judged air-fuel ratio AFlean, the air-fuel ratio adjustment amount AFC is switched from the rich set adjustment amount AFCrich to the slight rich set adjustment amount AFCsrich. However, the timings for switching the air-fuel ratio adjustment amount AFC do not necessarily have to be set based on the output air-fuel ratio AFdwn of the downstream side air-fuel ratio sensor 41, and may also be determined based on other parameters.

For example, the timings for switching the air-fuel ratio adjustment amount AFC may also be determined based on the oxygen storage amount OSA of the upstream side exhaust purification catalyst 20. For example, as shown in FIG. 5, when, after the target air-fuel ratio is switched to the lean air-fuel ratio at the time $t_2$, the oxygen storage amount OSA of the upstream side exhaust purification catalyst 20 reaches the predetermined amount a, the air-fuel ratio adjustment amount AFC is switched to the slight lean set adjustment amount AFCslean. Further, when, after the target air-fuel ratio is switched to the rich air-fuel ratio at the time $t_5$, the oxygen storage amount OSA of the upstream side exhaust purification catalyst 20 is decreased by a predetermined amount a, the air-fuel ratio adjustment amount AFC is switched to the slight rich set adjustment amount.

In this case, the oxygen storage amount OSA of the upstream side exhaust purification catalyst 20 is estimated based on the cumulative oxygen excess/deficiency of exhaust gas flowing into the upstream side exhaust purification catalyst 20. The "oxygen excess/deficiency" means the oxygen which becomes in excess or the oxygen which becomes deficient (amount of excessive unburned gas, etc.) when trying to make the air-fuel ratio of the exhaust gas flowing into the upstream side exhaust purification catalyst 20 the stoichiometric air-fuel ratio. In particular, when the target air-fuel ratio becomes the lean set air-fuel ratio, oxygen in the exhaust gas flowing into the upstream side exhaust purification catalyst 20 becomes excessive. This excess oxygen is stored in the upstream side exhaust purification catalyst 20. Therefore, the cumulative value of the oxygen excess/deficiency (below, referred to as "cumulative oxygen excess/deficiency") can be said to express the oxygen storage amount OSA of the upstream side exhaust purification catalyst 20. As shown in FIG. 5, in the present embodiment, the cumulative oxygen excess/deficiency μOED is reset to zero when the target air-fuel ratio changes beyond the stoichiometric air-fuel ratio.

Note that, the oxygen excess/deficiency is calculated based on the output air-fuel ratio AFup of the upstream side air-fuel ratio sensor 40 and the estimated value of the amount of intake air to the inside of the combustion chamber 5 which is calculated based on the air flow meter 39, etc. or the amount of feed of fuel from the fuel injector 11, etc. Specifically, the oxygen excess/deficiency OED is, for example, calculated by the following formula (1):

$$OED=0.23\cdot Qi\cdot(AFup-14.6) \quad (1)$$

In this regard, 0.23 is the oxygen concentration in the air, Qi indicates the fuel injection amount, and AFup indicates the output air-fuel ratio of the upstream side air-fuel ratio sensor 40.

Alternatively, the timing of switching the air-fuel ratio adjustment amount AFC to the slight lean set adjustment amount AFCslean (lean degree change timing) may be determined based on the elapsed time from when switching the target air-fuel ratio to the lean air-fuel ratio (time $t_2$), or the cumulative amount of intake air, etc. Similarly, the timing of switching the air-fuel ratio adjustment amount AFC to the slight rich set adjustment amount AFCsrich (rich degree change timing) may be determined based on the elapsed time from when switching the target air-fuel ratio to the rich air-fuel ratio (time $t_5$), or the cumulative amount of intake air, etc.

In this way, the rich degree change timing or lean degree change timing is determined based on various parameters. Whatever the case, the lean degree change timing is set to a timing after the target air-fuel ratio is set to the lean set air-fuel ratio and before the output air-fuel ratio AFdwn of the downstream side air-fuel ratio sensor 41 becomes the lean judged air-fuel ratio or more. Similarly, the rich degree change timing is set to a timing after the target air-fuel ratio is set to the rich set air-fuel ratio and before the output air-fuel ratio AFdwn of the downstream side air-fuel ratio sensor 41 becomes the rich judged air-fuel ratio or less.

Further, in the above embodiment, during the times $t_2$ to $t_3$, the air-fuel ratio adjustment amount AFC is maintained constant at the lean set air-fuel ratio AFClean. However, during this time period, the air-fuel ratio adjustment amount AFC need not necessarily be maintained constant and may also change so as to gradually fall (approach the stoichiometric air-fuel ratio). Similarly, in the above embodiment, during the times $t_3$ to $t_5$, the air-fuel ratio adjustment amount AFC is maintained constant at the slight lean set air-fuel ratio AFClean. However, during this time period, the air-fuel ratio adjustment amount AFC does not necessarily have to be maintained constant. For example, it may also change so as to gradually fall (approach the stoichiometric air-fuel ratio). Further, the same can be said for the times $t_5$ to $t_6$ and the times $t_6$ to $t_8$.

<Deviation at Upstream Side Air Fuel Ratio Sensor>

In this regard, when the engine body 1 has a plurality of cylinders, sometimes a deviation occurs between the cylinders in the air-fuel ratio of the exhaust gas which is exhausted from the cylinders. On the other hand, the upstream side air-fuel ratio sensor 40 is arranged at the header of the exhaust manifold 19, but depending on the position of arrangement, the extent by which the exhaust gas which is exhausted from each cylinder is exposed to the upstream side air-fuel ratio sensor 40 differs between cylinders. As a result, the output air-fuel ratio of the upstream side air-fuel ratio sensor 40 is strongly affected by the air-fuel ratio of the exhaust gas which is exhausted from a certain specific cylinder. For this reason, when the air-fuel ratio of the exhaust gas which is exhausted from a certain specific cylinder becomes an air-fuel ratio which differs from the average air-fuel ratio of the exhaust gas which is exhausted from all cylinders, deviation occurs between the average air-fuel ratio and the output air-fuel ratio of the upstream side air-fuel ratio sensor 40. That is, the output air-fuel ratio of the upstream side air-fuel ratio sensor 40 deviates to the rich side or lean side from the average air-fuel ratio of the actual exhaust gas.

Further, hydrogen, among unburned gas, has a fast speed of passage through the diffusion regulation layer of the air-fuel ratio sensor. For this reason, if the concentration of hydrogen in the exhaust gas is high, the output air-fuel ratio of the upstream side air-fuel ratio sensor 40 deviates to the lower side with respect to the actual air-fuel ratio of the exhaust gas (that is, the rich side). If deviation occurs in the output air-fuel ratio of the upstream side air-fuel ratio sensor 40 in this way, the above mentioned control cannot be performed appropriately. Below, this phenomenon will be explained with reference to FIG. 6.

Figure 6:
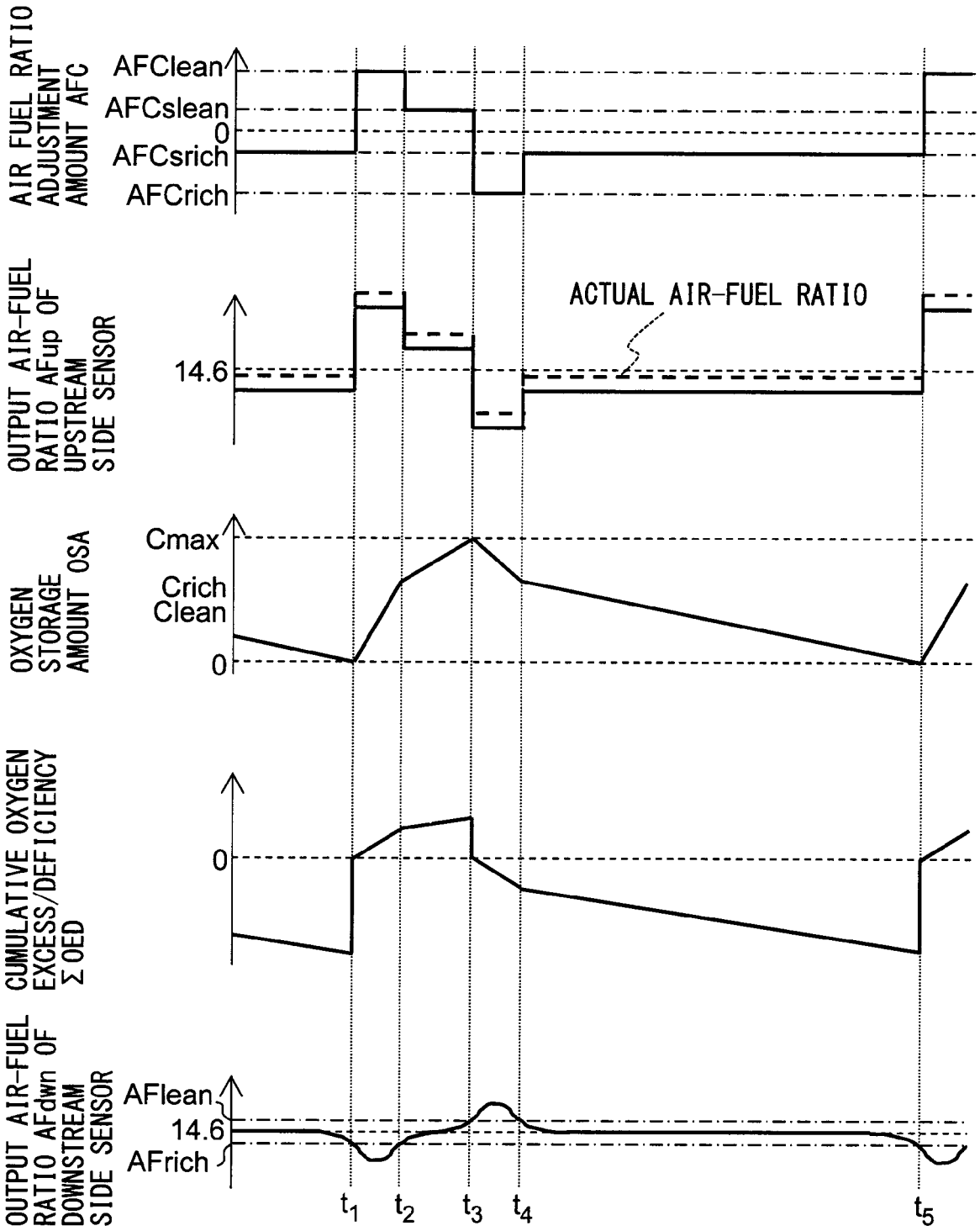
FIG. 6 is a time chart of air-fuel ratio adjustment amount, etc., when a deviation occurs in the output air-fuel ratio of the upstream side air-fuel ratio sensor.

FIG. 6 is a time chart of the air-fuel ratio adjustment amount AFC, etc., similar to FIG. 5. FIG. 6 shows the case where the output air-fuel ratio of the upstream side air-fuel ratio sensor 40 deviates to the rich side. In the figure, the solid line in the output air-fuel ratio AFup of the upstream side air-fuel ratio sensor 40 shows the output air-fuel ratio of the upstream side air-fuel ratio sensor 40. On the other hand, the broken line shows the actual air-fuel ratio of the exhaust gas flowing around the upstream side air-fuel ratio sensor 40.

In the example shown in FIG. 6 as well, in the state before the time $t_1$, the air-fuel ratio adjustment amount AFC is set to the slight rich set adjustment amount AFCsrich. Accordingly, the target air-fuel ratio is set to the slight rich set air-fuel ratio. Along with this, the output air-fuel ratio AFup of the upstream side air-fuel ratio sensor 40 becomes an air-fuel ratio equal to the slight rich set air-fuel ratio. However, since, as explained above, the output air-fuel ratio of the upstream side air-fuel ratio sensor 40 deviates to the rich side, the actual air-fuel ratio of the exhaust gas becomes an air-fuel ratio which is at the lean side from the slight rich set air-fuel ratio. That is, the output air-fuel ratio AFup of the upstream side air-fuel ratio sensor 40 becomes lower (richer) than the actual air-fuel ratio (broken line in figure).

Further, in the example shown in FIG. 6, if, at the time $t_1$, the air-fuel ratio adjustment amount AFC is switched to the lean set adjustment amount AFClean, the output air-fuel ratio AFup of the upstream side air-fuel ratio sensor 40 becomes an air-fuel ratio which is equal to the lean set air-fuel ratio. However, since, as explained above, the output air-fuel ratio of the upstream side air-fuel ratio sensor 40 deviates to the rich side, the actual air-fuel ratio of the exhaust gas becomes an air-fuel ratio which is leaner than the lean set air-fuel ratio. That is, the output air-fuel ratio AFup of the upstream side air-fuel ratio sensor 40 becomes lower (richer) than the actual air-fuel ratio (broken line in figure).

In this way, if the output air-fuel ratio of the upstream side air-fuel ratio sensor 40 deviates to the rich side, the actual air-fuel ratio of the exhaust gas flowing into the upstream side exhaust purification catalyst 20 will always become an air-fuel ratio leaner than the target air-fuel ratio. Therefore, for example, if the deviation in the output air-fuel ratio of the upstream side air-fuel ratio sensor 40 becomes larger than the example shown in FIG. 6, during the times $t_4$ to $t_5$, the actual air-fuel ratio of the exhaust gas flowing into the upstream side exhaust purification catalyst 20 will become the stoichiometric air-fuel ratio or lean air-fuel ratio.

If, during the times $t_4$ to $t_5$, the actual air-fuel ratio of the exhaust gas flowing into the upstream side exhaust purification catalyst 20 becomes the stoichiometric air-fuel ratio, after that, the output air-fuel ratio of the downstream side air-fuel ratio sensor 41 no longer becomes the rich judged air-fuel ratio or less, or the lean judged air-fuel ratio or more. Further, the oxygen storage amount OSA of the upstream side exhaust purification catalyst 20 is also maintained constant as it is. Further, if, during the times $t_4$ to $t_5$, the actual air-fuel ratio of the exhaust gas flowing into the upstream side exhaust purification catalyst 20 becomes the lean air-fuel ratio, the oxygen storage amount OSA of the upstream side exhaust purification catalyst 20 increases. As a result, the oxygen storage amount OSA of the upstream side exhaust purification catalyst 20 can no longer change between the maximum storable oxygen amount Cmax and zero and thus the oxygen storage ability of the upstream side exhaust purification catalyst 20 will fall.

Due to the above, it is necessary to detect the deviation of the output air-fuel ratio of the upstream side air-fuel ratio sensor 40 and is necessary to correct the output air-fuel ratio, etc., based on the detected deviation.

<Normal Learning Control>

Therefore, in an embodiment of the present invention, learning control is performed during normal operation (that is, when performing feedback control based on the above mentioned target air-fuel ratio) to compensate for deviation in the output air-fuel ratio of the upstream side air-fuel ratio sensor 40. At first, among the learning control, a normal learning control will be explained.

In this regard, the time period from when switching the target air-fuel ratio to the lean air-fuel ratio to when the output air-fuel ratio of the downstream side air-fuel ratio sensor 41 becomes the lean judged air-fuel ratio or more, is defined as the oxygen increase time period (first time period). Similarly, the time period from when the target air-fuel ratio is switched to the rich air-fuel ratio to when the output air-fuel ratio of the downstream side air-fuel ratio sensor 41 becomes the rich judgment air-fuel ratio or less, is defined as the oxygen decrease time period (second time period). In the normal learning control of the present embodiment, as the absolute value of the cumulative oxygen excess/deficiency μOED in the oxygen increase time period, the lean cumulative value of oxygen amount (first cumulative value of oxygen amount) is calculated. In addition, as the absolute value of the cumulative oxygen excess/deficiency in the oxygen decrease time period, the rich cumulative value of oxygen amount (second cumulative value of oxygen amount) is calculated. Further, the control center air-fuel ratio AFR is corrected so that the difference between the lean cumulative value of oxygen amount and rich cumulative value of oxygen amount becomes smaller. Below, FIG. 7 shows this state.

Figure 7:
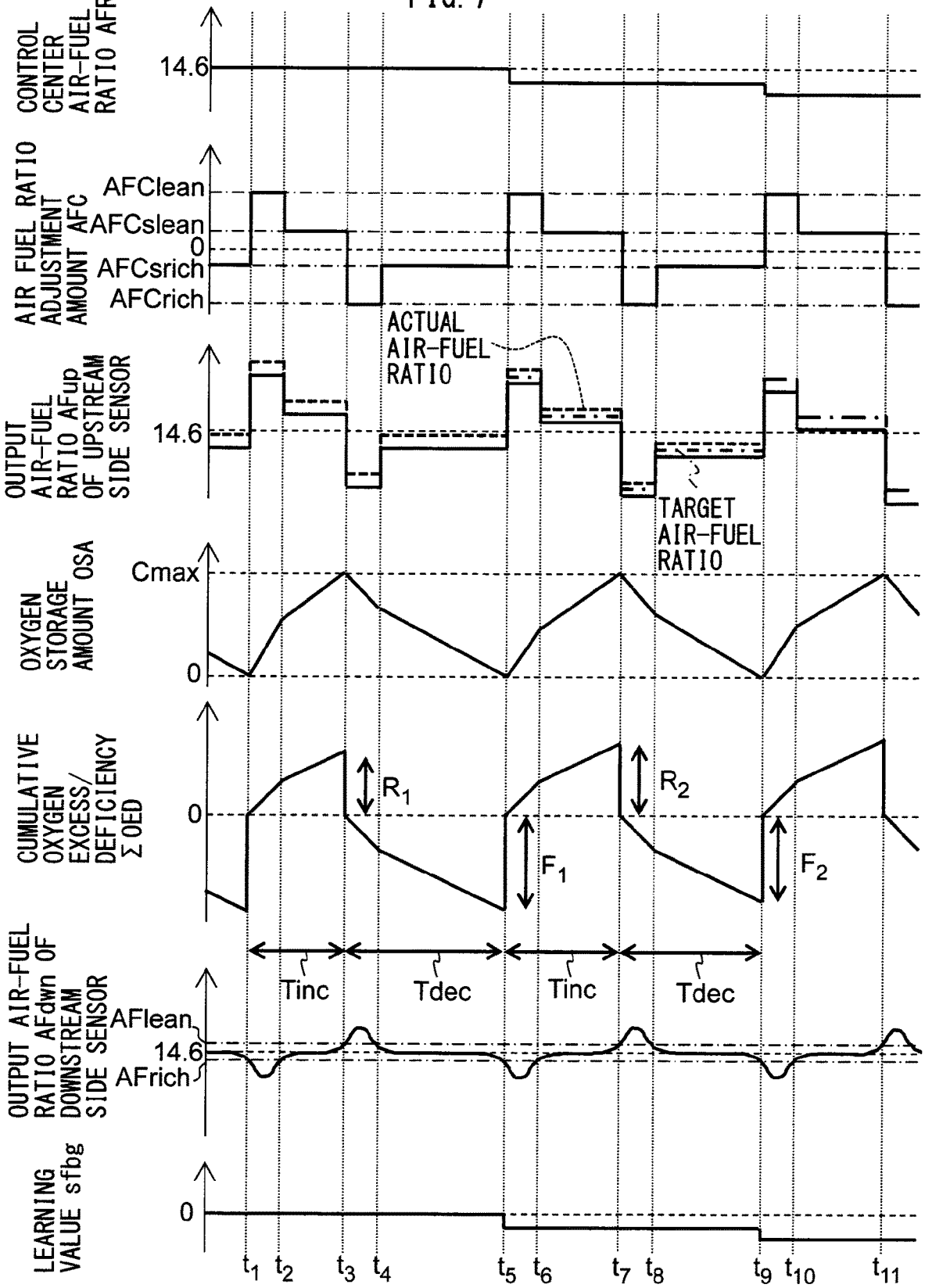
FIG. 7 is a time chart of air-fuel ratio adjustment amount, etc., when performing normal learning control.

FIG. 7 is a time chart of the control center air-fuel ratio AFr, the air-fuel ratio adjustment amount AFC, the output air-fuel ratio AFup of the upstream side air-fuel ratio sensor 40, the oxygen storage amount OSA of the upstream side exhaust purification catalyst 20, the cumulative oxygen excess/deficiency μOED, the output air-fuel ratio AFdwn of the downstream side air-fuel ratio sensor 41, and the learning value sfbg. FIG. 7 shows the case, like FIG. 6, where the output air-fuel ratio AFup of the upstream side air-fuel ratio sensor 40 deviates to the low side (rich side). Note that, the learning value sfbg is a value which changes in accordance with the deviation of the output air-fuel ratio (output current) of the upstream side air-fuel ratio sensor 40 and, in the present embodiment, is used for correction of the control center air-fuel ratio AFR. Further, in the figure, the solid line in the output air-fuel ratio AFup of the upstream side air-fuel ratio sensor 40 shows the output air-fuel ratio of the upstream side air-fuel ratio 40, while the broken line shows the actual air-fuel ratio of the exhaust gas flowing around the upstream side air-fuel ratio 40. In addition, one-dot chain line shows the target air-fuel ratio, that is, an air-fuel ratio corresponding to the air-fuel ratio adjustment amount AFC.

In the illustrated example, in the same way as FIG. 5 and FIG. 6, in the state before the time $t_1$, the control center air-fuel ratio is set to the stoichiometric air-fuel ratio and therefore the air-fuel ratio adjustment amount AFC is set to the slight rich set adjustment amount AFCsrich. At this time, the output air-fuel ratio AFup of the upstream side air-fuel ratio sensor 40, as shown by the solid line, becomes an air-fuel ratio which corresponds to the slight rich set air-fuel ratio. However, since the output air-fuel ratio AFup of the upstream side air-fuel ratio sensor 40 deviates, the actual air-fuel ratio of the exhaust gas becomes an air-fuel ratio which is leaner than the slight rich set air-fuel ratio (broken line in FIG. 7). However, in the example shown in FIG. 7, as will be understood from the broken line in FIG. 7, the actual air-fuel ratio of the exhaust gas before the time $t_1$ is a rich air-fuel ratio, while it is richer than the stoichiometric air-fuel ratio. Therefore, the upstream side exhaust purification catalyst 20 is gradually decreased in the oxygen storage amount.

At the time $t_1$, the output air-fuel ratio AFdwn of the downstream side air-fuel ratio sensor 41 reaches the rich judged air-fuel ratio AFrich. Due to this, as explained above, the air-fuel ratio adjustment amount AFC is switched to the lean set adjustment amount AFClean. After the time $t_1$, the output air-fuel ratio of the upstream side air-fuel ratio sensor 40 becomes an air-fuel ratio which corresponds to the lean set air-fuel ratio. However, due to deviation of the output air-fuel ratio of the upstream side air-fuel ratio sensor 40, the actual air-fuel ratio of the exhaust gas becomes an air-fuel ratio which is leaner than the lean set air-fuel ratio, that is, an air-fuel ratio with a larger lean degree (see broken line in FIG. 7). Therefore, the oxygen storage amount OSA of the upstream side exhaust purification catalyst 20 rapidly increases. Further, when the output air-fuel ratio AFdwn of the downstream side air-fuel ratio sensor 41 becomes larger than the rich judged air-fuel ratio AFrich at the time $t_2$, the air-fuel ratio adjustment amount AFC is switched to the slight lean set adjustment amount AFCslean. At this time as well, the actual air-fuel ratio of the exhaust gas becomes a lean air-fuel ratio which is leaner than the slight lean set air-fuel ratio.

Then, when the oxygen storage amount OSA of the upstream side exhaust purification catalyst 20 becomes greater and thus the output air-fuel ratio AFdwn of the downstream side air-fuel ratio sensor 41 becomes the lean judged air-fuel ratio AFlean or more at the time $t_3$, the air-fuel ratio adjustment amount AFC is switched to the rich set adjustment amount AFCrich. However, due to the deviation of the output air-fuel ratio of the upstream side air-fuel ratio sensor 40, the actual air-fuel ratio of the exhaust gas becomes an air-fuel ratio leaner than the rich set air-fuel ratio, that is, an air-fuel ratio with a small rich degree (see broken line in FIG. 7). Therefore, the speed of decrease of the oxygen storage amount OSA of the upstream side exhaust purification catalyst 20 is slow. Further, when the output air-fuel ratio AFdwn of the downstream side air-fuel ratio sensor 41 becomes smaller than the lean judged air-fuel ratio AFlean at the time $t_4$, the air-fuel ratio adjustment amount AFC is switched to the slight rich set adjustment amount AFCsrich. At this time as well, the actual air-fuel ratio of the exhaust gas becomes an air-fuel ratio which is leaner than the slight rich set air-fuel ratio, that is, an air-fuel ratio with a small rich degree.

In the present embodiment, as explained above, the cumulative oxygen excess/deficiency μOED is calculated from the time $t_1$ to the time $t_2$. In this regard, if referring to the time period from when the target air-fuel ratio is switched to the lean air-fuel ratio (time $t_1$) to when the output air-fuel ratio AFdwn of the downstream side air-fuel sensor 41 becomes the lean judged air-fuel ratio AFlean or more (time $t_3$) as the "oxygen increase time period Tinc", in the present embodiment, the cumulative oxygen excess/deficiency μOED is calculated in the oxygen increase time period Tinc. In FIG. 7, the absolute value of the cumulative oxygen excess/deficiency μOED in the oxygen increase time period Tinc from the time $t_1$ to time $t_3$ is shown as $R_1$.

The cumulative oxygen excess/deficiency $\Sigma OED(R_1)$ of this oxygen increase time period Tinc corresponds to the oxygen storage amount OSA at the time $t_3$. However, as explained above, the oxygen excess/deficiency is estimated by using the output air-fuel ratio AFup of the upstream side air-fuel ratio sensor 40, and deviation occurs in this output air-fuel ratio AFup. For this reason, in the example shown in FIG. 7, the cumulative oxygen excess/deficiency μOED in the oxygen increase time period Tinc from the time $t_1$ to time $t_3$ becomes smaller than the value which corresponds to the actual oxygen storage amount OSA at the time $t_3$.

Further, in the present embodiment, the cumulative oxygen excess/deficiency μOED is calculated even from the time $t_3$ to time $t_5$. In this regard, if referring to the time period from when the target air-fuel ratio is switched to the rich air-fuel ratio (time $t_3$) to when the output air-fuel ratio AFdwn of the downstream side air-fuel ratio sensor 41 becomes the rich judged air-fuel ratio AFrich or less (time $t_3$) as the "oxygen decrease time period Tdec", in the present embodiment, the cumulative oxygen excess/deficiency μOED is calculated in the oxygen decrease time period Tdec. In FIG. 7, the absolute value of the cumulative oxygen excess/deficiency μOED at the oxygen decrease time period Tdec from the time $t_3$ to time $t_5$ is shown as $F_1$.

The cumulative oxygen excess/deficiency $\Sigma OED(F_1)$ of this oxygen decrease time period Tdec corresponds to the total amount of oxygen which is released from the upstream side exhaust purification catalyst 20 from the time $t_3$ to the time $t_5$. However, as explained above, deviation occurs in the output air-fuel ratio AFup of the upstream side air-fuel ratio sensor 40. Therefore, in the example shown in FIG. 10, the cumulative oxygen excess/deficiency μOED in the oxygen decrease time period Tdec from the time $t_3$ to time $t_5$ is larger than the value which corresponds to the total amount of oxygen which is actually released from the upstream side exhaust purification catalyst 20 from the time $t_3$ to the time $t_5$.

In this regard, in the oxygen increase time period Tinc, oxygen is stored at the upstream side exhaust purification catalyst 20, while in the oxygen decrease time period Tdec, the stored oxygen is completely released. Therefore, the absolute value $R_1$ of the cumulative oxygen excess/deficiency at the oxygen increase time period Tinc and the absolute value $F_1$ of the cumulative oxygen excess/deficiency at the oxygen decrease time period Tdec must be basically the same value as each other. However, as explained above, when deviation occurs in the output air-fuel ratio AFup of the upstream side air-fuel ratio sensor 40, the cumulative values change in accordance with the deviation. As explained above, when the output air-fuel ratio of the upstream side air-fuel ratio sensor 40 deviates to the low side (rich side), the absolute value $F_1$ becomes greater than the absolute value $R_1$. Conversely, when the output air-fuel ratio of the upstream side air-fuel ratio sensor 40 deviates to the high side (lean side), the absolute value $F_1$ becomes smaller than the absolute value $R_1$. In addition, the difference ΔΣOED of the absolute value $R_1$ of the cumulative oxygen excess/deficiency at the oxygen increase time period Tinc and the absolute value $F_1$ of the cumulative oxygen excess/deficiency at the oxygen decrease time period Tdec ($=R_1-F_1$, below, also referred to as the "excess/deficiency error") expresses the extent of deviation at the output air-fuel ratio of the upstream side air-fuel ratio sensor 40. The larger the difference between these absolute values $R_1$ and $F_1$, the greater the deviation in the output air-fuel ratio of the upstream side air-fuel ratio sensor 40.

Therefore, in the present embodiment, the control center air-fuel ratio AFR is corrected based on the excess/deficiency error ΔΣOED. In particular, in the present embodiment, the control center air-fuel ratio AFR is corrected so that the difference ΔΣOED of the absolute value $R_1$ of the cumulative oxygen excess/deficiency at the oxygen increase time period Tinc and the absolute value $F_1$ of the cumulative oxygen excess/deficiency at the oxygen decrease time period Tdec becomes smaller.

Specifically, in the present embodiment, the learning value sfbg is calculated by the following formula (2), and the control center air-fuel ratio AFR is corrected by the following formula (3).

$$sfbg(n)=sfbg(n-1)+k_1\cdot\Delta\Sigma\mathrm{OED} \quad (2)$$

$$\mathrm{AFR}=\mathrm{AFRbase}+sfbg(n) \quad (3)$$

Note that, in the above formula (2), "n" expresses the number of calculations or time. Therefore, sfbg(n) is the current calculated or current learning value. In addition, "$k_1$" in the above formula (2) is the gain which shows the extent by which the excess/deficiency error ΔΣOED is reflected in the control center air-fuel ratio AFR. The larger the value of the gain "$k_1$", the larger the correction amount of the control center air-fuel ratio AFR. In addition, in the above formula (3), the base control center air-fuel ratio AFRbase is a control center air-fuel ratio which is used as base, and is the stoichiometric air-fuel ration in the present embodiment.

At the time $t_3$ of FIG. 7, as explained above, the learning value sfbg is calculated based on the absolute values $R_1$ and $F_1$. In particular, in the example shown in FIG. 7, the absolute value $F_1$ of the cumulative oxygen excess/deficiency at the oxygen decrease time period Tdec is larger than the absolute value $R_1$ of the cumulative oxygen excess/deficiency at the oxygen increase time period Tinc, and therefore at the time $t_3$, the learning value sfbg is decreased.

In this regard, the control center air-fuel ratio AFR is corrected based on the learning value sfbg by using the above formula (3). In the example shown in FIG. 7, since the learning value sfbg is a negative value, the control center air-fuel ratio AFR becomes a value smaller than the base control center air-fuel ratio AFRbase, that is, the rich side value. Due to this, the air-fuel ratio of the exhaust gas flowing into the upstream side exhaust purification catalyst 20 is corrected to the rich side.

As a result, after the time $t_5$, the deviation of the actual air-fuel ratio of the exhaust gas flowing into the upstream side exhaust purification catalyst 20 with respect to the target air-fuel ratio becomes smaller than before the time $t_5$. Therefore, the difference between the broken line showing the actual air-fuel ratio and the one-dot chain line showing the target air-fuel ratio after the time $t_5$ becomes smaller than the difference before the time $t_5$ (before the time $t_5$, since the target air-fuel ratio conforms to the output air-fuel ratio of the downstream side air-fuel ratio sensor 41, the one-dot chain line overlaps the solid line).

Further, after the time $t_5$ as well, an operation similar to the operation during the time $t_1$ to time $t_3$ is performed. Therefore, at the time $t_4$, if the cumulative oxygen excess/deficiency μOED reaches the switching reference value OEDref, the target air-fuel ratio is switched from the lean set air-fuel ratio to the rich set air-fuel ratio. After this, at the time $t_5$, when the output air-fuel ratio AFdwn of the downstream side air-fuel ratio sensor 41 reaches the rich judgment reference value Irrich, the target air-fuel ratio is again switched to the lean set air-fuel ratio.

The time $t_5$ to time $t_7$, as explained above, corresponds to the oxygen increase time period Tinc, and therefore, the absolute value of the cumulative oxygen excess/deficiency μOED during this period is expressed by $R_2$ of FIG. 7. Further, the time $t_7$ to time $t_9$, as explained above, corresponds to the oxygen decrease time period Tdec, and therefore the absolute value of the cumulative oxygen excess/deficiency μOED during this period is expressed by $F_2$ of FIG. 7. Further, the learning value sfbg is updated based on the difference ΔΣOED($=R_2-F_2$) of these absolute values $R_2$ and $F_2$ by using the above formula (2). In the present embodiment, similar control is repeated after the time $t_9$ and thus the learning value sfbg is repeatedly updated.

By updating the learning value sfbg in this way by means of normal learning control, the output air-fuel ratio AFup of the upstream side air-fuel ratio sensor 40 is gradually separated from the target air-fuel ratio, but the actual air-fuel ratio of the exhaust gas flowing into the upstream side exhaust purification catalyst 20 gradually approaches the target air-fuel ratio. Due to this, it is possible to compensate the deviation at the output air-fuel ratio of the upstream side air-fuel ratio sensor 40.

Note that, as explained above, the learning value sfbg is preferably updated based on the cumulative oxygen excess/deficiency μOED at the oxygen increase time period Tinc and the cumulative oxygen excess/deficiency μOED at the oxygen decrease time period Tdec which follows this oxygen increase time period Tinc. This is because, as explained above, the total amount of oxygen stored at the upstream side exhaust purification catalyst 20 in the oxygen increase time period Tinc and the total amount of oxygen released from the upstream side exhaust purification catalyst 20 in the directly following oxygen decrease time period Tdec, become equal.

In addition, in the above embodiment, the learning value sfbg is updated based on the cumulative oxygen excess/deficiency μOED in a single oxygen increase time period Tinc and the cumulative oxygen excess/deficiency μOED in a single oxygen decrease time period Tdec. However, the learning value sfbg may be updated based on the total value or average value of the cumulative oxygen excess/deficiency μOED in a plurality of oxygen increase time periods Tinc and the total value or average value of the cumulative oxygen excess/deficiency μOED in a plurality of oxygen decrease time periods Tdec.

Further, in the above embodiment, the control center air-fuel ratio is corrected based on the learning value sfbg. However, a parameter which is corrected based on the learning value sfbg may another parameter relating to the air-fuel ratio. The other parameter, for example, includes one of the amount of fuel fed to the inside of the combustion chamber 5, the output air-fuel ratio of the upstream side air-fuel ratio sensor 40, the air-fuel ratio adjustment amount, etc.

Note that, in the above embodiment, in the basic air-fuel ratio control, the rich set air-fuel ratio, slight rich set air-fuel ratio, lean set air-fuel ratio, and slight lean set air-fuel ratio are set constant. However, as explained above, these air-fuel ratio do not necessarily have to be maintained constant.

<Large Deviation in Upstream Side Air-Fuel Ratio Sensor>

In the example shown in FIG. 6, deviation occurs in the output air-fuel ratio of the upstream side exhaust purification catalyst 20, but the extent thereof is not that large. Therefore, as will be understood from the broken line of FIG. 6, when the target air-fuel ratio is set to the rich set air-fuel ratio, the actual air-fuel ratio of the exhaust gas becomes a rich air-fuel ratio while leaner than the rich set air-fuel ratio.

As opposed to this, if the deviation which occurs at the upstream side exhaust purification catalyst 20 becomes larger, as explained above, even if the target air-fuel ratio is set to the slight rich set air-fuel ratio, sometimes the actual air-fuel ratio of the exhaust gas becomes the stoichiometric air-fuel ratio. This state is shown in FIG. 8.

Figure 8:
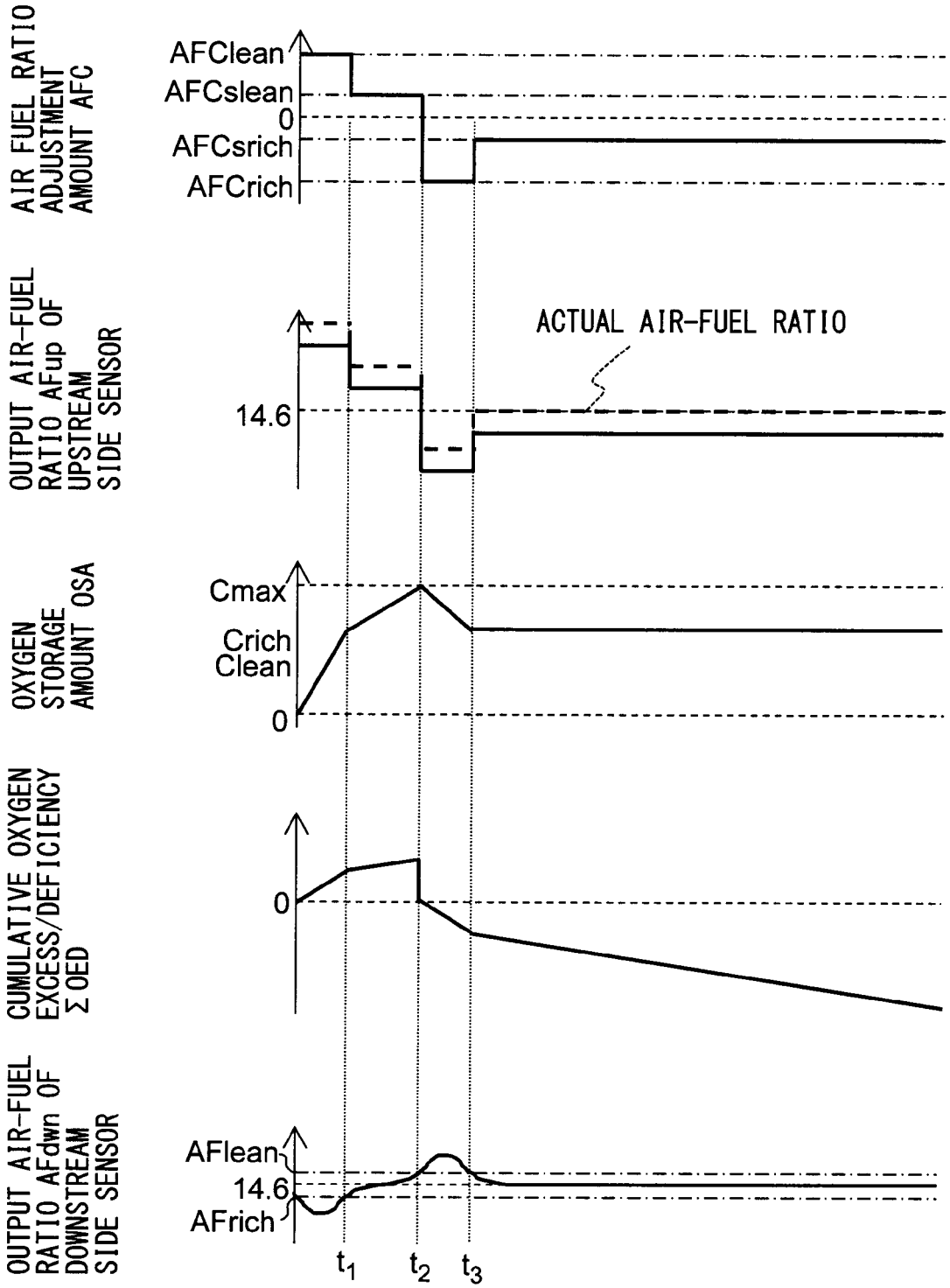
FIG. 8 is a time chart of air-fuel ratio adjustment amount, etc., when a large deviation occurs in the output air-fuel ratio of the upstream side air-fuel ratio sensor.

In the example shown in FIG. 8, if, at the time $t_2$, the output air-fuel ratio AFup of the upstream side air-fuel ratio sensor 40 becomes the lean judged air-fuel ratio AFlean or more, the air-fuel ratio adjustment amount AFC is switched to the rich set adjustment amount AFCrich. After that, if the output air-fuel ratio AFup of the upstream side air-fuel ratio sensor 40 becomes smaller than the rich judged air-fuel ratio AFlean, at the time $t_3$, the air-fuel ratio adjustment amount AFC is set to the slight rich set adjustment amount AFCsrich. Along with this, the output air-fuel ratio AFup of the upstream side air-fuel ratio sensor 40 becomes an air-fuel ratio which corresponds to the slight rich set air-fuel ratio. However, since the output air-fuel ratio of the upstream side air-fuel ratio sensor 40 greatly deviates to the rich side, the actual air-fuel ratio of the exhaust gas becomes the stoichiometric air-fuel ratio (broken line in figure).

As a result, the oxygen storage amount OSA of the upstream side exhaust purification catalyst 20 does not change, but is maintained at a constant value. Therefore, even if a long time elapses after the air-fuel ratio adjustment amount AFC is switched to the slight rich set adjustment amount AFCsrich, unburned gas is never discharged from the upstream side exhaust purification catalyst 20. Therefore, the output air-fuel ratio AFdwn of the downstream side air-fuel ratio sensor 41 is maintained at substantially the stoichiometric air-fuel ratio. As explained above, the air-fuel ratio adjustment amount AFC is switched from the slight rich set adjustment amount AFCsrich to the lean set adjustment amount AFClean when the output air-fuel ratio AFdwn of the downstream side air-fuel ratio sensor 41 reaches the rich judged air-fuel ratio AFrich. However, in the example shown in FIG. 8, since the output air-fuel ratio AFdwn of the downstream side air-fuel ratio sensor 41 is maintained at the stoichiometric air-fuel ratio as is, the air-fuel ratio adjustment amount AFC is maintained at the slight rich set adjustment amount AFCsrich over a long time. In this regard, the above-mentioned normal learning control is predicated on the target air-fuel ratio being alternately switched between the rich air-fuel ratio and the lean air-fuel ratio. Therefore, when the output air-fuel ratio of the upstream side air-fuel ratio sensor 40 greatly deviates, the above-mentioned normal learning control cannot be performed.

Figure 9:
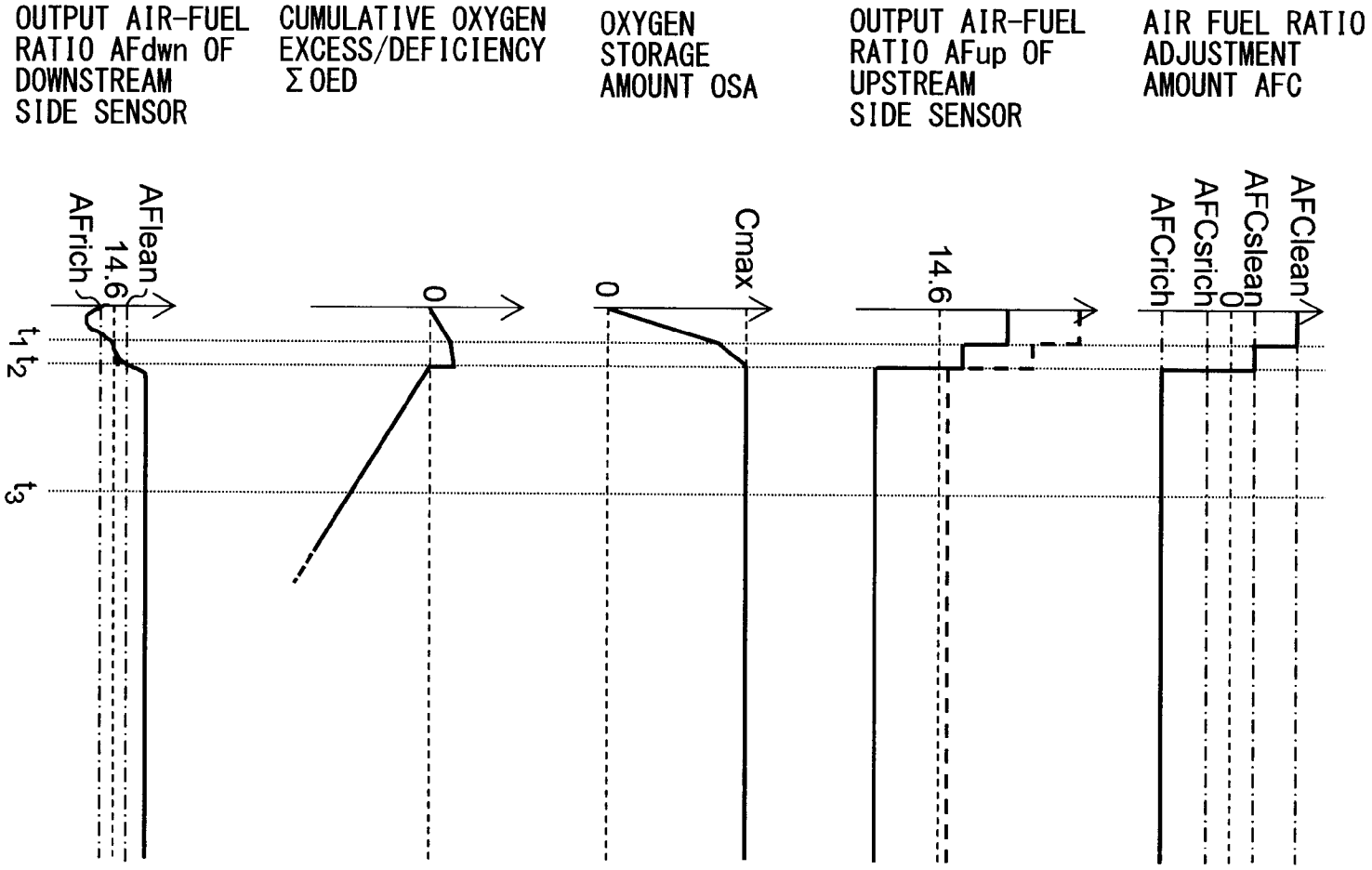
FIG. 9 is a time chart of air-fuel ratio adjustment amount, etc., when a large deviation occurs in the output air-fuel ratio of the upstream side air-fuel ratio sensor.

FIG. 9 is a view similar to FIG. 8, which shows the case where the output air-fuel ratio of the upstream side air-fuel ratio sensor 40 extremely greatly deviates to the rich side. In the example shown in FIG. 9, similarly to the example shown in FIG. 8, at the time $t_2$, the air-fuel ratio adjustment amount AFC is set to the rich set adjustment amount AFCrich. Along with this, the output air-fuel ratio AFup of the upstream side air-fuel ratio sensor 40 becomes an air-fuel ratio which corresponds to the rich set air-fuel ratio. However, due to deviation of the output air-fuel ratio of the upstream side air-fuel ratio sensor 40, the actual air-fuel ratio of the exhaust gas becomes a lean air-fuel ratio (broken line in the figure).

As a result, regardless of the air-fuel ratio adjustment amount AFC being set to the rich set adjustment amount AFCrich, exhaust gas of a lean air-fuel ratio flows into the upstream side exhaust purification catalyst 20. At this time, the oxygen storage amount OSA of the upstream side exhaust purification catalyst 20 reaches the maximum storable oxygen amount Cmax, and therefore the exhaust gas of the lean air-fuel ratio which flows into the upstream side exhaust purification catalyst 20, flows out as it is. Therefore, after the time $t_2$, the output air-fuel ratio AFdwn of the downstream side air-fuel ratio sensor 41 is maintained at the lean judged air-fuel ratio or more. Therefore, the air-fuel ratio adjustment amount AFC is maintained as is without being switched to the slight rich set adjustment amount AFCsrich or lean set adjustment amount AFClean. As a result, when the output air-fuel ratio of the upstream side air-fuel ratio sensor 40 deviates extremely greatly, the air-fuel ratio adjustment amount AFC is also not switched and therefore the above-mentioned normal control cannot be performed. In addition, in this case, exhaust gas containing $NO_x$ continues to flow out from the upstream side exhaust purification catalyst 20.

<Stuck Learning Control>

Therefore, in the present embodiment, even if the deviation of the output air-fuel ratio of the upstream side air-fuel ratio sensor 40 is large, to compensate that deviation, in addition to the above-mentioned normal learning control, stoichiometric air-fuel ratio stuck learning control, lean stuck learning control, and rich stuck learning control are performed.

<Stoichiometric Air-Fuel Ratio Stuck Learning>

First, the stoichiometric air-fuel ratio stuck learning control will be explained. The stoichiometric air-fuel ratio stuck learning control is learning control which is performed when the air-fuel ratio detected by the downstream side air-fuel ratio sensor 41 is stuck at the stoichiometric air-fuel ratio as shown in the example shown in FIG. 8.

Figure 10:
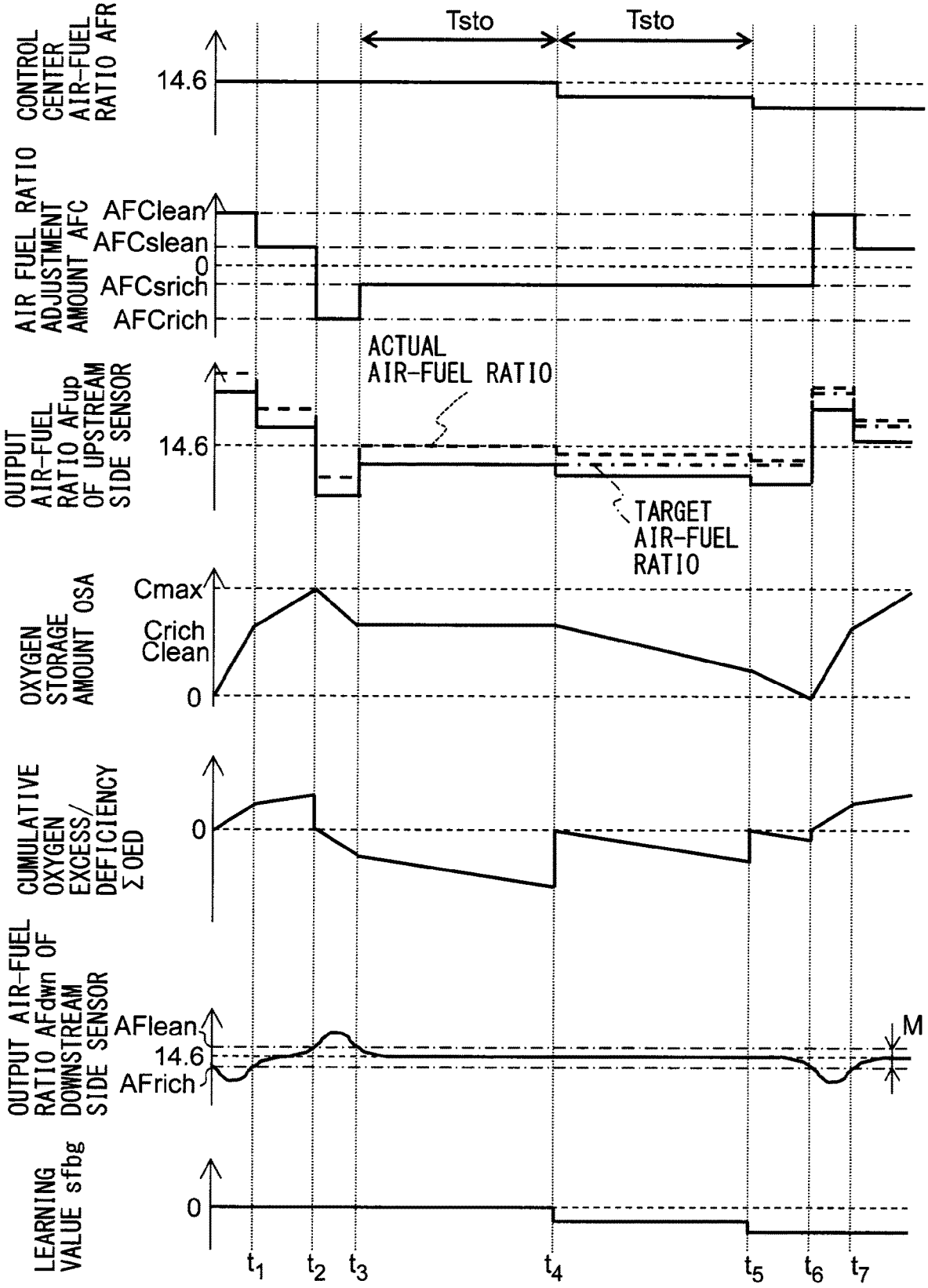
FIG. 10 is a time chart of the air-fuel ratio adjustment amount, etc., when performing stoichiometric air-fuel ratio stuck learning.

In this regard, the region between the rich judged air-fuel ratio AFrich and the lean judged air-fuel ratio AFlean will be referred to as the "middle region M". This middle region M corresponds to a "stoichiometric air-fuel ratio proximity region" which is the air-fuel ratio region between the rich judged air-fuel ratio and the lean judged air-fuel ratio. In stoichiometric air-fuel ratio-stuck learning control, after the air-fuel ratio adjustment amount AFC is switched to the rich set adjustment amount AFCrich, that is, in the state where the target air-fuel ratio is set to the rich air-fuel ratio, it is judged if the output air-fuel ratio AFdwn of the downstream side air-fuel ratio sensor 41 has been maintained in the middle region M over a predetermined stoichiometric air-fuel ratio maintenance judged time or more. Alternatively, after the air-fuel ratio adjustment amount AFC is switched to the lean set adjustment amount AFClean, that is, in the state where the target air-fuel ratio is set to the lean air-fuel ratio, it is judged if the output air-fuel ratio AFdwn of the downstream side air-fuel ratio sensor 41 has been maintained in the middle region M over the predetermined stoichiometric air-fuel ratio maintenance judged time or more. Further, if it has been maintained in the middle region M over the stoichiometric air-fuel ratio maintenance judged time or more, the learning value sfbg is changed so that the air-fuel ratio of the exhaust gas flowing into the upstream side exhaust purification catalyst 20 changes. At this time, when the target air-fuel ratio has been set to the rich air-fuel ratio, the learning value sfbg is decreased so that the air-fuel ratio of the exhaust gas flowing into the upstream side exhaust purification catalyst 20 changes to the rich side. On the other hand, when the target air-fuel ratio has been set to the lean air-fuel ratio, the learning value sfbg is increased so that the air-fuel ratio of the exhaust gas flowing into the upstream side exhaust purification catalyst 20 changes to the lean side. FIG. 10 shows this state.

FIG. 10 is a view similar to FIG. 7 which shows a time chart of the air-fuel ratio adjustment amount AFC, etc. FIG. 10, similarly to FIG. 8, shows the case where the output air-fuel ratio AFup of the upstream side air-fuel ratio sensor 40 greatly deviates to the low side (rich side).

In the illustrated example, similarly to FIG. 8, at the time $t_3$, the air-fuel ratio adjustment amount AFC is set to the slight rich set adjustment amount AFCsrich. However, since the output air-fuel ratio of the upstream side air-fuel ratio sensor 40 greatly deviates to the rich side, similarly to the example shown in FIG. 8, the actual air-fuel ratio of the exhaust gas is substantially the stoichiometric air-fuel ratio. Therefore, after the time $t_3$, the oxygen storage amount OSA of the upstream side exhaust purification catalyst 20 is maintained at a constant value. As a result, the output air-fuel ratio AFdwn of the downstream side air-fuel ratio sensor 41 is maintained near the stoichiometric air-fuel ratio and accordingly is maintained in the middle region M, over a long time period.

Therefore, in the present embodiment, when the target air-fuel ratio is set to a rich air-fuel ratio, if the output air-fuel ratio AFdwn of the downstream side air-fuel ratio sensor 41 is maintained in the middle region M over a predetermined stoichiometric air-fuel ratio maintenance judged time Tsto or more, the control center air-fuel ratio AFR is corrected. In particular, in the present embodiment, the learning value sfbg is updated so that the air-fuel ratio of the exhaust gas flowing into the upstream side exhaust purification catalyst 20 changes to the rich side.

Specifically, in the present embodiment, the learning value sfbg is calculated by the following formula (4), and the control center air-fuel ratio AFR is corrected by the above formula (3).

$$sfbg(n)=sfbg(n-1)+k_2\cdot\mathrm{AFC} \tag{4}$$

Note that in the above formula (4), $k_2$ is the gain which shows the extent of correction of the control center air-fuel ratio AFR ($0<k_2\leq 1$). The larger the value of the gain $k_2$, the larger the correction amount of the control center air-fuel ratio AFR becomes. Further, the current air-fuel ratio adjustment amount AFC is plugged in for AFC in formula (4), and in the case of the time $t_4$ of FIG. 10, this is the slight rich set adjustment amount AFCsrich.

In this regard, as explained above, when the target air-fuel ratio is set to the rich air-fuel ratio, if the output air-fuel ratio AFdwn of the downstream side air-fuel ratio sensor 41 is maintained in the middle region M over a long period of time, the actual air-fuel ratio of the exhaust gas becomes a value close to substantially the stoichiometric air-fuel ratio. Therefore, the deviation at the upstream side air-fuel ratio sensor 40 becomes the same extent as the difference between the control center air-fuel ratio (stoichiometric air-fuel ratio) and the target air-fuel ratio (in this case, the rich set air-fuel ratio). In the present embodiment, as shown in the above formula (4), the learning value sfbg is updated based on the air-fuel ratio adjustment amount AFC corresponding to the difference between the control center air-fuel ratio and the target air-fuel ratio. Due to this, it is possible to more suitably compensate for deviation in the output air-fuel ratio of the upstream side air-fuel ratio sensor 40.

In the example shown in FIG. 10, at the time $t_4$, the air-fuel ratio adjustment amount AFC is set to the slight rich set adjustment amount AFCsrich. Therefore, if using formula (4), at the time $t_4$, the learning value sfbg is decreased. As a result, the actual air-fuel ratio of the exhaust gas flowing into the upstream side exhaust purification catalyst 20 changes to the rich side. Due to this, after the time $t_4$, the deviation of the actual air-fuel ratio of the exhaust gas flowing into the upstream side exhaust purification catalyst 20 from the target air-fuel ratio becomes smaller compared with before the time $t_4$. Therefore, after the time $t_4$, the difference between the broken line which shows the actual air-fuel ratio and the one-dot chain line which shows the target air-fuel ratio becomes smaller than the difference before the time $t_4$.

In the example shown in FIG. 10, the gain $k_2$ is set to a relatively small value. For this reason, even if the learning value sfbg is updated at the time $t_4$, deviation of the actual air-fuel ratio of the exhaust gas flowing into the upstream side exhaust purification catalyst 20, from the target air-fuel ratio, remains. Therefore, the actual air-fuel ratio of the exhaust gas becomes an air-fuel ratio which is leaner than the slight rich set air-fuel ratio, that is, an air-fuel ratio with a small rich degree (see broken line of FIG. 10). For this reason, the decreasing speed of the oxygen storage amount OSA of the upstream side exhaust purification catalyst 20 is slow.

As a result, from the time $t_4$ to the time $t_5$ when the stoichiometric air-fuel ratio maintenance judged time Tsto elapses, the output air-fuel ratio AFdwn of the downstream side air-fuel ratio sensor 41 is maintained close to the stoichiometric air-fuel ratio, and accordingly is maintained in the middle region M. Therefore, in the example shown in FIG. 10, even at the time $t_5$, the learning value sfbg is updated by using formula (4).

In the example shown in FIG. 10, after that, at the time $t_6$, the output air-fuel ratio AFdwn of the downstream side air-fuel ratio sensor 41 becomes the rich judged air-fuel ratio AFrich or less. After the output air-fuel ratio AFdwn becomes the rich judged air-fuel ratio AFrich or less in this way, as explained above, the target air-fuel ratio is alternately set to the lean air-fuel ratio and the rich air-fuel ratio. Along with this, the above-mentioned normal learning control is performed.

By updating the learning value sfbg by the stoichiometric air-fuel ratio stuck learning control in this way, the learning value can be updated even when the deviation of the output air-fuel ratio AFup of the upstream side air-fuel ratio sensor 40 is large. Due to this, it is possible to compensate deviation at the output air-fuel ratio of the upstream side air-fuel ratio sensor 40.

<Modification of Stoichiometric Air-Fuel Ratio Stuck Learning>

Note that in the above embodiment, the stoichiometric air-fuel ratio maintenance judged time Tsto is a predetermined time. In this case, the stoichiometric air-fuel ratio maintenance judged time is set to not less than the usual time taken from when switching the target air-fuel ratio to the rich air-fuel ratio to when the absolute value of the cumulative oxygen excess/deficiency μOED reaches the maximum storable oxygen amount of the upstream side exhaust purification catalyst 20 at the time of new product. Specifically, it is preferably set to two to four times that time.

Alternatively, the stoichiometric air-fuel ratio maintenance judged time Tsto may be changed in accordance with other parameters, such as the cumulative oxygen excess/deficiency μOED in the period while the output air-fuel ratio AFdwn of the downstream side air-fuel ratio sensor 41 is maintained in the middle region M. Specifically, for example, the greater the cumulative oxygen excess/deficiency μOED, the shorter the stoichiometric air-fuel ratio maintenance judged time Tsto is set. Due to this, it is also possible to update the above-mentioned learning value sfbg when the cumulative oxygen excess/deficiency μOED in the period while the output air-fuel ratio AFdwn of the downstream side air-fuel ratio sensor 41 is maintained in the middle region M becomes a predetermined amount. Further, in this case, the above predetermined amount in the cumulative oxygen excess/deficiency μOED has to be set to not less than the maximum storable oxygen amount of the upstream side exhaust purification catalyst 20 at the time of a new product. Specifically, an amount of about two to four times the maximum storable oxygen amount is preferable.

Further, in the above-mentioned stoichiometric air-fuel ratio stuck learning control, the learning value is updated if the air-fuel ratio detected by the downstream side air-fuel ratio sensor 41 is maintained in the air-fuel ratio region close to stoichiometric air-fuel ratio over the stoichiometric air-fuel ratio maintenance judged time Tsto or more. However, stoichiometric air-fuel ratio stuck learning may be performed based on a parameter other than time.

For example, when the air-fuel ratio detected by the downstream side air-fuel ratio sensor 41 is stuck to the stoichiometric air-fuel ratio, the cumulative oxygen excess/deficiency becomes greater after the target air-fuel ratio is switched between the lean air-fuel ratio and the rich air-fuel ratio. Therefore, it is also possible to update the learning value in the above-mentioned way if the absolute value of the cumulative oxygen excess/deficiency after switching the target air-fuel ratio or the absolute value of the cumulative oxygen excess/deficiency in the period when the output air-fuel ratio AFdwn of the downstream side air-fuel ratio sensor 41 is maintained in the middle region M becomes larger than a predetermined value or more.

Furthermore, the example shown in FIG. 10 shows the case where the target air-fuel ratio is switched to the rich air-fuel ratio, and then the output air-fuel ratio AFdwn of the downstream side air-fuel ratio sensor 41 is maintained in the air-fuel ratio region close to stoichiometric air-fuel ratio, over the stoichiometric air-fuel ratio maintenance judged time Tsto or more. However, similar control is possible even where the target air-fuel ratio is switched to the lean air-fuel ratio, and then the output air-fuel ratio AFdwn of the downstream side air-fuel ratio sensor 41 is maintained in the air-fuel ratio region close to the stoichiometric air-fuel ratio, over the stoichiometric air-fuel ratio maintenance judged time Tsto or more.

Therefore, if expressing these together, in the present embodiment, when the target air-fuel ratio is set to an air-fuel ratio deviating from the stoichiometric air-fuel ratio to one side (that is, the rich air-fuel ratio or lean air-fuel ratio), if the air-fuel ratio detected by the downstream side air-fuel ratio sensor 41 is maintained in the air-fuel ratio region close to the stoichiometric air-fuel ratio, over the stoichiometric air-fuel ratio maintenance judged time Tsto or more or during the time period when the cumulative oxygen excess/deficiency becomes a predetermined value or more, the learning means performs "stoichiometric air-fuel ratio-stuck learning" in which the parameter relating to feedback control is corrected so that in the feedback control, the air-fuel ratio of the exhaust gas flowing into the upstream side exhaust purification catalyst 20 changes to the one side.

<Rich/Lean Stuck Learning>

Figure 11:
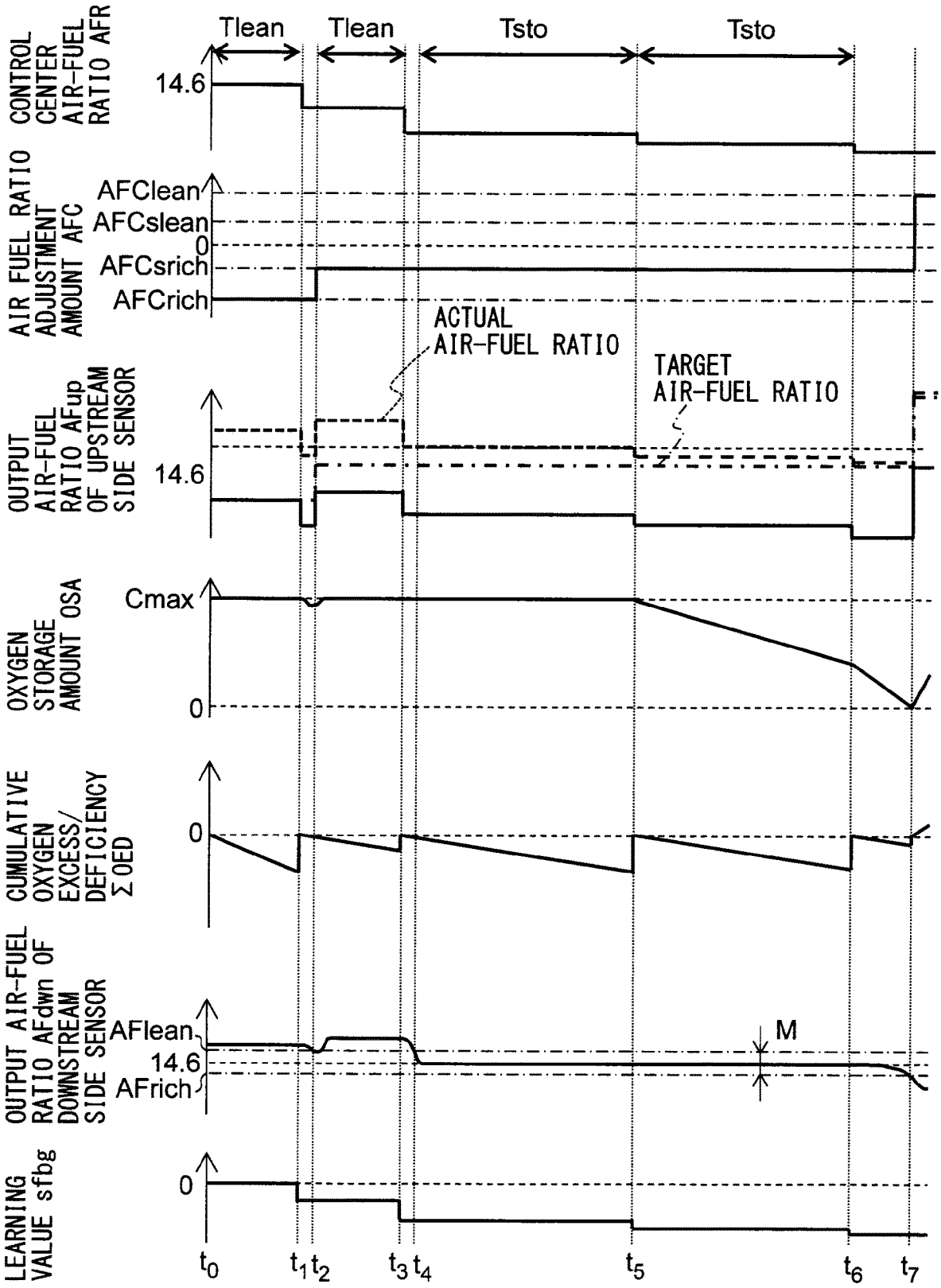
FIG. 11 is a time chart of air-fuel ratio adjustment amount etc. when performing lean stuck learning, etc.

Next, lean stuck learning control will be explained. The lean stuck learning control is learning control which is performed where, as shown in the example of FIG. 9, although the target air-fuel ratio is set to the rich air-fuel ratio, the air-fuel ratio detected by the downstream side air-fuel ratio sensor 41 is stuck at the lean air-fuel ratio. In lean stuck learning control, it is judged if the output air-fuel ratio AFdwn of the downstream side air-fuel ratio sensor 41 has been maintained at the lean air-fuel ratio over a predetermined lean air-fuel ratio maintenance judged time or more after the air-fuel ratio adjustment amount AFC is switched to the rich set adjustment amount AFCrich, that is, in the state where the target air-fuel ratio is set to the rich air-fuel ratio. Further, when it is maintained at the lean air-fuel ratio over the lean air-fuel ratio maintenance judged time or more, the learning value sfbg is decreased so that the air-fuel ratio of the exhaust gas flowing into the upstream side exhaust purification catalyst 20 changes to the rich side. FIG. 11 shows this state.

FIG. 11 is a view, similar to FIG. 9, which shows a time chart of the air-fuel ratio adjustment amount AFC, etc. FIG. 11, like FIG. 9, shows the case where the output air-fuel ratio AFup of the upstream side air-fuel ratio sensor 40 deviates extremely greatly to the low side (rich side).

In the illustrated example, at the time $t_0$, the air-fuel ratio adjustment amount AFC is switched from the slight lean set adjustment amount AFCslean to the rich set adjustment amount AFCrich. However, since the output air-fuel ratio of the upstream side air-fuel ratio sensor 40 deviates extremely greatly to the rich side, similarly to the example shown in FIG. 9, the actual air-fuel ratio of the exhaust gas becomes the lean air-fuel ratio. Therefore, after the time $t_0$, the output air-fuel ratio AFdwn of the downstream side air-fuel ratio sensor 41 is maintained at the lean air-fuel ratio.

Therefore, in the present embodiment, when the output air-fuel ratio AFdwn of the downstream side air-fuel ratio sensor 41 has been maintained at the lean air-fuel ratio for the predetermined lean air-fuel ratio maintenance judged time Tlean or more after the air-fuel ratio adjustment amount AFC is set to the rich set adjustment amount AFCrich, the control center air-fuel ratio AFR is corrected. In particular, in the present embodiment, the learning value sfbg is corrected so that the air-fuel ratio of the exhaust gas flowing into the upstream side exhaust purification catalyst 20 changes to the rich side.

Specifically, in the present embodiment, the learning value sfbg is calculated by using the following formula (5) and the control center air-fuel ratio AFR is corrected based on the learning value sfbg by using the above formula (3).

$$sfbg(n)=sfbg(n-1)+k_3\cdot(\mathrm{AFCrich}-(\mathrm{AFdwn}-14.6)) \quad (5)$$

Note that in the above formula (5), $k_3$ is the gain which expresses the extent of correction of the control center air-fuel ratio AFR ($0<k_3\leq 1$). The larger the value of the gain $k_3$, the larger the correction amount of the control center air-fuel ratio AFR.

In this regard, in the example shown in FIG. 11, when the air-fuel ratio adjustment amount AFC is set at the rich set adjustment amount AFCrich, the output air-fuel ratio AFdwn of the downstream side air-fuel ratio sensor 41 is maintained at the lean air-fuel ratio. In this case, the deviation at the upstream side air-fuel ratio sensor 40 corresponds to the difference between the target air-fuel ratio and the output air-fuel ratio of the downstream side air-fuel ratio sensor 41. If breaking this down, the deviation at the upstream side air-fuel ratio sensor 40 can be said to be of the same extent as the difference between the target air-fuel ratio and the stoichiometric air-fuel ratio (corresponding to rich set adjustment amount AFCrich) and the difference between the stoichiometric air-fuel ratio and the output air-fuel ratio of the downstream side air-fuel ratio sensor 41 added together. Therefore, in the present embodiment, as shown in the above formula (5), the learning value sfbg is updated based on the value acquired by adding the rich set adjustment amount AFCrich to the difference between the output air-fuel ratio of the downstream side air-fuel ratio sensor 41 and the stoichiometric air-fuel ratio. In particular, in the above-mentioned stoichiometric air-fuel ratio stuck learning, the learning value is corrected by an amount corresponding to the rich set adjustment amount AFCrich, while in lean stuck learning, the learning value is corrected by this amount plus a value corresponding to the output air-fuel ratio AFdwn of the downstream side air-fuel ratio sensor 41. Further, the gain $k_3$ is set to a similar extent to the gain $k_2$. For this reason, the correction amount in the lean stuck learning is larger than the correction amount in stoichiometric air-fuel ratio stuck learning.

In the example shown in FIG. 11, if using formula (5), the learning value sfbg is decreased at the time $t_1$. As a result, the actual air-fuel ratio of the exhaust gas flowing into the upstream side exhaust purification catalyst 20 changes to the rich side. Due to this, after the time $t_1$, the deviation of the actual air-fuel ratio of the exhaust gas flowing into the upstream side exhaust purification catalyst 20 from the target air-fuel ratio becomes smaller, compared with before the time $t_1$. Therefore, after the time $t_1$, the difference between the broken line which shows the actual air-fuel ratio and the one-dot chain line which shows the target air-fuel ratio becomes smaller than the difference before the time $t_1$.

In the example shown in FIG. 11, if the learning value sfbg is updated at the time $t_1$, the actual air-fuel ratio of the exhaust gas flowing into the upstream side exhaust purification catalyst 20 becomes the rich air-fuel ratio. As a result, at the time $t_2$, the air-fuel ratio of the exhaust gas flowing out from the upstream side exhaust purification catalyst 20 becomes substantially the stoichiometric air-fuel ratio and the output air-fuel ratio AFdwn of the downstream side air-fuel ratio sensor 41 becomes smaller than the lean judged air-fuel ratio AFlean. For this reason, at the time $t_2$, the air-fuel ratio adjustment amount AFC is switched from the rich set adjustment amount AFCrich to the slight rich set adjustment amount AFCsrich.

However, the output air-fuel ratio of the upstream side air-fuel ratio sensor 40 still greatly deviates to the rich side, and therefore the actual air-fuel ratio of the exhaust gas becomes the lean air-fuel ratio. As a result, in the illustrated example, after the time $t_2$, the output air-fuel ratio AFdwn of the downstream side air-fuel ratio sensor 41 is maintained at the lean air-fuel ratio over the lean air-fuel ratio maintenance judged time Tlean. For this reason, in the illustrated example, at the time $t_3$ when the lean air-fuel ratio maintenance judged time Tlean elapses, due to the lean stuck learning, the learning value sfbg is corrected by using the following formula (6) similar to the above formula (5).

$$sfbg(n)=sfbg(n-1)+k_3\cdot(\mathrm{AFCsrich}-(\mathrm{AFdwn}-14.6)) \quad (6)$$

If, at the time $t_3$, the learning value sfbg is corrected, the deviation of the actual air-fuel ratio of the exhaust gas flowing into the upstream side exhaust purification catalyst 20, from the target air-fuel ratio, becomes smaller. Due to this, in the illustrated example, after the time $t_3$, the actual air-fuel ratio of the exhaust gas becomes substantially the stoichiometric air-fuel ratio. Along with this, the output air-fuel ratio AFdwn of the downstream side air-fuel ratio sensor 41 changes from the lean air-fuel ratio to substantially the stoichiometric air-fuel ratio. In particular, in the example shown in FIG. 11, from the time $t_4$ to the time $t_5$, the output air-fuel ratio AFdwn of the downstream side air-fuel ratio sensor 41 is maintained at substantially the stoichiometric air-fuel ratio, that is, in the middle region M, over the stoichiometric air-fuel ratio maintenance judged time Tsto. For this reason, at the time $t_5$, stoichiometric air-fuel ratio stuck learning is performed by using the above formula (4) to correct the learning value sfbg.

By updating the learning value sfbg in this way by lean stuck learning control, it is possible to update the learning value even when the deviation of the output air-fuel ratio AFup of the upstream side air-fuel ratio sensor 40 is extremely large. Due to this, it is possible to reduce the deviation in the output air-fuel ratio of the upstream side air-fuel ratio sensor 40.

Note that, in the above embodiment, the lean air-fuel ratio maintenance judged time Tlean is a predetermined time. In this case, the lean air-fuel ratio maintenance judged time Tlean is set to not less than the delayed response time of the downstream side air-fuel ratio sensor which is usually taken from when switching the target air-fuel ratio to the rich air-fuel ratio to when, according to this, the output air-fuel ratio of the downstream side air-fuel ratio sensor 41 changes. Specifically, it is preferably set to two times to four times that time. Further, the lean air-fuel ratio maintenance judged time Tlean is shorter than the time usually taken from when switching the target air-fuel ratio to the rich air-fuel ratio to when the absolute value of the cumulative oxygen excess/deficiency μOED reaches the maximum storable oxygen amount of the upstream side exhaust purification catalyst 20 at the time of non-use. Therefore, the lean air-fuel ratio maintenance judged time Tlean is set shorter than the above-mentioned stoichiometric air-fuel ratio maintenance judged time Tsto.

Alternatively, the lean air-fuel ratio maintenance judged time Tlean may be changed in accordance with another parameter, such as the cumulative exhaust gas flow amount in the period while the output air-fuel ratio AFdwn of the downstream side air-fuel ratio sensor 41 is the lean judged air-fuel ratio or more. Specifically, for example, the larger the cumulative exhaust gas flow amount ΣGe, the shorter the lean air-fuel ratio maintenance judged time Tlean is set. Due to this, when the cumulative exhaust gas flow from when switching the target air-fuel ratio to the rich air-fuel ratio becomes a predetermined amount, the above-mentioned learning value sfbg can be updated. Further, in this case, the predetermined amount has to be not less than the total amount of flow of the exhaust gas which is required from when switching the target air-fuel ratio to when the output air-fuel ratio of the downstream side air-fuel ratio sensor 41 changes according to the switch. Specifically, it is preferably set to an amount of 2 to 4 times that total flow.

Next, rich stuck learning control will be explained. The rich stuck learning control is control similar to the lean stuck learning control, and is learning control which is performed when although the target air-fuel ratio is set to the lean air-fuel ratio, the air-fuel ratio detected by the downstream side air-fuel ratio sensor 41 is stuck at the rich air-fuel ratio. In rich stuck learning control, in the state where the target air-fuel ratio is set to the lean air-fuel ratio, it is judged if the output air-fuel ratio AFdwn of the downstream side air-fuel ratio sensor 41 is maintained at the rich air-fuel ratio over a predetermined rich air-fuel ratio maintenance judged time (similar to lean air-fuel ratio maintenance judged time) or more. Further, when maintained at the rich air-fuel ratio for the rich air-fuel ratio maintenance judged time or more, the learning value sfbg is increased so that the air-fuel ratio of the exhaust gas flowing into the upstream side exhaust purification catalyst 20 changes to the lean side. That is, in rich stuck learning control, control is performed with rich and lean reversed from the above lean stuck learning control.

<Learning Promotion Control>

If a large deviation occurs in the output air-fuel ratio AFup of the upstream side air-fuel ratio sensor 40, in order to quickly eliminate this deviation, it becomes necessary to promote updating of the learning value sfbg by learning control.

Therefore, in the present embodiment, when it is necessary to promote updating of the learning value sfbg by learning control, compared with when it is not necessary to promote it, the rich degrees of the rich set air-fuel ratio and slight rich set air-fuel ratio are increased. In addition, when it is necessary to promote updating of the learning value sfbg by learning control, compared with when it is not necessary to promote it, the lean degrees of the lean set air-fuel ratio and slight lean set air-fuel ratio are increased. Below, such control will be referred to as "learning promotion control".

In particular, in the present embodiment, when the difference ΔΣOED between the absolute value (lean oxygen amount cumulative value) $R_1$ of the cumulative oxygen excess/deficiency μOED at the oxygen increase time period Tinc and the absolute value (rich oxygen amount cumulative value) $F_1$ of the cumulative oxygen excess/deficiency μOED at the oxygen decrease time period Tdec is a predetermined promotion judged reference value or more, it is judged that it is necessary to promote updating of the learning value sfbg by learning control. In addition, in the present embodiment, if, after the air-fuel ratio adjustment amount AFC is switched to the rich set adjustment amount AFCrich, that is, the target air-fuel ratio is switched to the rich set air-fuel ratio, the output air-fuel ratio AFdwn of the downstream side air-fuel ratio sensor 41 is maintained in the middle region M over a predetermined stoichiometric air-fuel ratio promotion judged time (which is preferably stoichiometric air-fuel ratio maintenance judged time or less) or more, it is judged that it is necessary to promote updating of the learning value sfbg by learning control. Further, in the present embodiment, if, after the air-fuel ratio adjustment amount AFC is switched to the rich set adjustment amount AFCrich, the output air-fuel ratio AFdwn of the downstream side air-fuel ratio sensor 41 is maintained at the lean air-fuel ratio over a predetermined lean air-fuel ratio promotion judged time (which is preferably lean air-fuel ratio maintenance judged time or less) or more, it is judged that it is necessary to promote updating of the learning value sfbg by learning control. Similarly, if, after the air-fuel ratio adjustment amount AFC is switched to the lean set adjustment amount AFClean, the output air-fuel ratio AFdwn of the downstream side air-fuel ratio sensor 41 is maintained at the rich air-fuel ratio over a predetermined rich air-fuel ratio promotion judged time (which is preferably rich air-fuel ratio maintenance judged time or less) or more, it is judged that it is necessary to promote updating of the learning value sfbg by learning control. Note that, the lean air-fuel ratio promotion judged time and the rich air-fuel ratio promotion judged time are set to times shorter than the stoichiometric air-fuel ratio promotion judged time.

Figure 12:
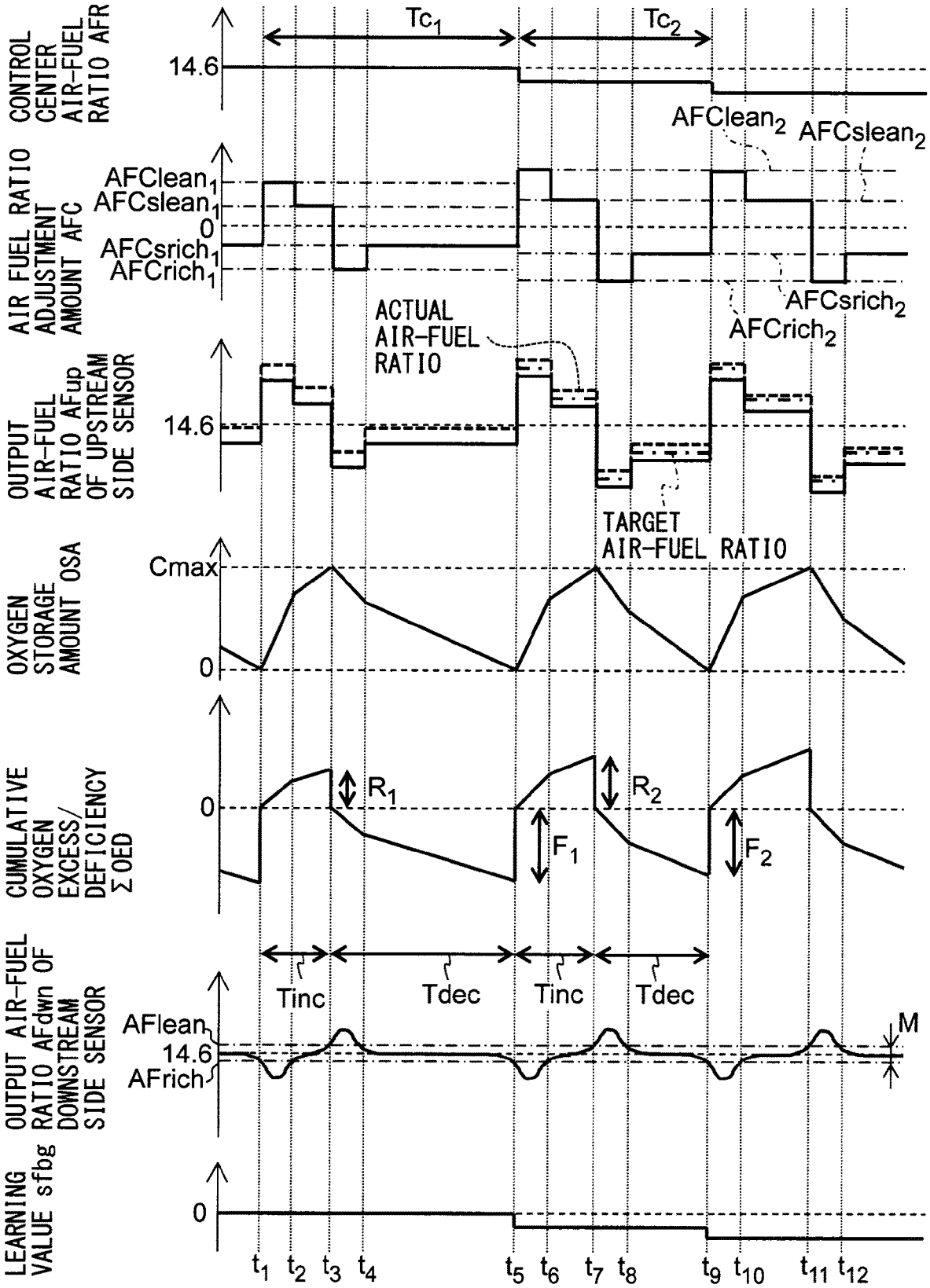
FIG. 12 is a time chart of air-fuel ratio adjustment amount, etc., when performing learning promotion control.

FIG. 12 is a time chart of the control center air-fuel ratio AFR, etc., similar to FIG. 7, etc. FIG. 12, like FIG. 7, etc., shows the case where the output air-fuel ratio AFup of the upstream side air-fuel ratio sensor 40 deviates to the low side (rich side).

In the illustrated example, in the state before the time $t_1$, the control center air-fuel ratio is set to the stoichiometric air-fuel ratio, and the air-fuel ratio adjustment amount AFC is set to the slight rich set adjustment amount $AFCsrich_1$ (value of an extent similar to slight rich set adjustment amount AFCsrich of example shown in FIG. 7). At this time, the output air-fuel ratio AFup of the upstream side air-fuel ratio sensor 40 becomes an air-fuel ratio which corresponds to the slight rich set air-fuel ratio. However, due to deviation of the output air-fuel ratio of the upstream side air-fuel ratio sensor 40, the actual air-fuel ratio of the exhaust gas becomes an air-fuel ratio leaner than the rich set air-fuel ratio (broken line of FIG. 12).

In the example shown in FIG. 12, during the time $t_1$ to the time $t_5$, control similar to the example shown in FIG. 7 is performed. Therefore, at the time $t_1$ when the output air-fuel ratio AFdwn of the downstream side air-fuel ratio sensor 41 becomes the rich judged air-fuel ratio AFrich or less, the air-fuel ratio adjustment amount AFC is switched to the lean set adjustment amount AFClean. Then, at the time $t_2$ when the output air-fuel ratio AFdwn of the downstream side air-fuel ratio sensor 41 becomes greater than the rich judged air-fuel ratio AFrich, the air-fuel ratio adjustment amount AFC is switched to the slight lean set air-fuel ratio AFCslean. In addition, at the time $t_3$ when the output air-fuel ratio AFdwn of the downstream side air-fuel ratio sensor 41 becomes the lean judged air-fuel ratio AFlean or more, the air-fuel ratio adjustment amount AFC is switched to the rich set adjustment amount AFCrich. Then, at the time $t_4$ when the output air-fuel ratio AFdwn of the downstream side air-fuel ratio sensor 41 becomes smaller than the lean judged air-fuel ratio AFlean, the air-fuel ratio adjustment amount AFC is switched to the slight rich set adjustment amount AFCsrich.

In this regard, at the time $t_5$, the absolute value of the cumulative oxygen excess/deficiency μOED at the oxygen increase time period Tinc (time $t_1$ to time $t_3$) is calculated as $R_1$. Similarly, the absolute value of the cumulative oxygen excess/deficiency μOED at the oxygen decrease time period Tdec (time $t_3$ to time $t_5$) is calculated as $F_1$. Further, in the example shown in FIG. 12, the difference (excess/deficiency error) ΔΣOED between the absolute value $R_1$ of the cumulative oxygen excess/deficiency at the oxygen increase time period Tinc and the absolute value $F_1$ of the cumulative oxygen excess/deficiency at the oxygen decrease time period Tdec becomes a predetermined promotion judgment reference value or more. Therefore, in the example shown in FIG. 12, at the time $t_5$, it is judged that it is necessary to promote updating of the learning value sfbg by learning control.

Therefore, in the present embodiment, at the time $t_5$, learning promotion control is started. Specifically, at the time $t_5$, the rich set adjustment amount AFCrich is decreased from $AFCrich_1$ to $AFCrich_2$, and the slight rich set adjustment amount AFCsrich is decreased from $AFCsrich_1$ to $AFCsrich_2$. Accordingly, the rich degrees of the rich set air-fuel ratio and the slight rich set air-fuel ratio are increased. In addition, at the time $t_5$, the lean set adjustment amount AFClean is increased from $AFClean_1$ to $AFClean_2$, and the slight lean set adjustment amount AFCslean is increased from $AFCslean_1$ to $AFCslean_2$. Accordingly, the lean degrees of the lean set air-fuel ratio and the slight lean set air-fuel ratio are increased.

Further, in the present embodiment, similarly to the example shown in FIG. 7, at the time $t_5$, the learning value sfbg is updated by using the above formula (2), and then the control center air-fuel ratio AFR is corrected by using the above formula (3). As a result, at the time $t_5$, the learning value sfbg is decreased, and the control center air-fuel ratio AFR is corrected to the rich side.

At the time $t_5$, if the air-fuel ratio adjustment amount AFC is switched to the increased lean set adjustment amount $AFClean_2$, the oxygen storage amount OSA of the upstream side exhaust purification catalyst 20 increases. The speed of increase of the oxygen storage amount OSA at this time is basically faster than the speed of increase during the times $t_1$ to $t_2$. Further, at the time $t_6$, after the air-fuel ratio adjustment amount AFC is switched to the increased slight lean set adjustment amount $AFCslean_2$, the speed of increase of the oxygen storage amount OSA is basically faster than the speed of increase during the times $t_2$ to $t_3$. Therefore, the time period from the time $t_5$ when the air-fuel ratio adjustment amount AFC is switched to the lean set adjustment amount AFClean to the time $t_7$ when the output air-fuel ratio AFdwn of the downstream side air-fuel ratio sensor 41 becomes the lean judged air-fuel ratio AFlean or more, becomes shorter compared with before the time $t_5$.

After that, if, at the time $t_7$, the air-fuel ratio adjustment amount AFC is switched to the decreased rich set adjustment amount $AFCrich_2$, the oxygen storage amount OSA of the upstream side exhaust purification catalyst 20 decreases. The speed of decrease of the oxygen storage amount OSA at this time is basically faster than the speed of decrease during the times $t_3$ to $t_4$. Further, after the air-fuel ratio adjustment amount AFC is switched to the increased slight rich set adjustment amount $AFCsrich_2$ at the time $t_8$, the speed of decrease of the oxygen storage amount OSA is basically faster than the speed of decrease during the times $t_4$ to $t_5$. Therefore, the time period from the times $t_7$ when the air-fuel ratio adjustment amount AFC is switched to the rich set adjustment amount AFCrich to the time $t_9$ when the output air-fuel ratio AFdwn of the downstream side air-fuel ratio sensor 41 becomes the rich judged air-fuel ratio AFrich or less, becomes shorter compared with before the time $t_5$.

At the time $t_9$, in the same way as the example shown in FIG. 7, the learning value sfbg is updated. That is, the time $t_5$ to the time $t_7$ corresponds to the oxygen increase time period Tinc. Accordingly, the absolute value of the cumulative oxygen excess/deficiency μOED in this time period can be expressed by the $R_2$ of FIG. 12. Further, the time $t_7$ to the time $t_9$ corresponds to the oxygen decrease time period Tdec. Accordingly, the absolute value of the cumulative oxygen excess/deficiency μOED in this time period can be expressed by the $F_2$ of FIG. 12. Further, based on the difference ΔΣOED ($=R_2-F_2$) of these absolute values $R_2$ and $F_2$, the learning value sfbg is updated using the above formula (2). In the present embodiment, after the time $t_9$ as well, similar control is repeated. Due to this, updating of the learning value sfbg is repeated.

Then, learning promotion control is repeated by a predetermined number of cycles (for example, the times $t_5$ to $t_9$ of FIG. 12) from when the output air-fuel ratio AFdwn of the downstream side air-fuel ratio sensor 41 reaches the rich judged air-fuel ratio AFrich or less, to when then it again reaches the rich judged air-fuel ratio AFrich or less, and then is ended. Alternatively, the learning promotion control may be ended after the elapse of a predetermined time from the learning promotion control. If the learning promotion control is ended, the rich set adjustment amount AFCrich is increased from $AFCrich_2$ to $AFCrich_1$, and the slight rich set adjustment amount AFCsrich is decreased from $AFCsrich_2$ to $AFCsrich_1$. Accordingly, the rich degrees of the rich set air-fuel ratio and the slight rich set air-fuel ratio are decreased. In addition, the lean set adjustment amount AFClean is increased from $AFClean_2$ to $AFClean_1$, and the slight rich set adjustment amount AFCslean is decreased from $AFCsrich_2$ to $AFCsrich_1$. Accordingly, the lean degrees of the lean set air-fuel ratio and the slight lean set air-fuel ratio are decreased.

In this regard, as explained above, by increasing the rich degree in the average value of the target air-fuel ratio (below, also referred to as "the average target air-fuel ratio") while the target air-fuel ratio is set to the rich air-fuel ratio after the time $t_5$, the time period from the time $t_5$ to the time $t_7$ becomes shorter. In addition, by increasing the lean degree in the average target air-fuel ratio while the target air-fuel ratio is set to the lean air-fuel ratio after the time $t_5$, the time period from the time $t_7$ to the time $t_9$ becomes shorter. Therefore, if considering these together, the time taken for one cycle from the time $t_5$ to the time $t_9$ becomes shorter (time $Tc_2$ of FIG. 12 becomes shorter than time $Tc_1$). On the other hand, as explained above, for updating the learning value sfbg, a cycle including an oxygen increasing time period Tinc and an oxygen decreasing time period Tdec is necessary. Therefore, in the present embodiment, it is possible to shorten the time duration of one cycle (for example, the time $t_5$ to the time $t_9$) necessary for updating the learning value sfbg, and thus is possible to promote updating of the learning value.

Further, as the method of promoting the updating of the learning value, it may be considered to increase the gains $k_b$ $k_2$, and $k_3$ at the above formulas (2), (4), (5). However, these gains $k_b$ $k_2$, and $k_3$ are normally set to values so that the learning value sfbg quickly converges to the optimal value. Therefore, if increasing these gains $k_1$, $k_2$, and $k_3$, the final convergence of the learning value sfbg is delayed. As opposed to this, when changing the lean set adjustment amount AFClean and rich set adjustment amount AFCrich, these gains $k_b$ $k_2$, and $k_3$ are not changed, and therefore delay of the final convergence of the learning value sfbg is suppressed.

<Modification of Learning Promotion Control>

Note that, in the above embodiment, while performing learning promotion control, compared with when not performing learning promotion control, all of the rich degrees of the rich set air-fuel ratio and the slight rich set air-fuel ratio and the lean degrees of the lean set air-fuel ratio and slight lean set air-fuel ratio are increased. However, in learning promotion control, it is not necessarily required to increase all of these rich degrees and lean degrees. It is also possible to increase only part of them.

Figure 13:
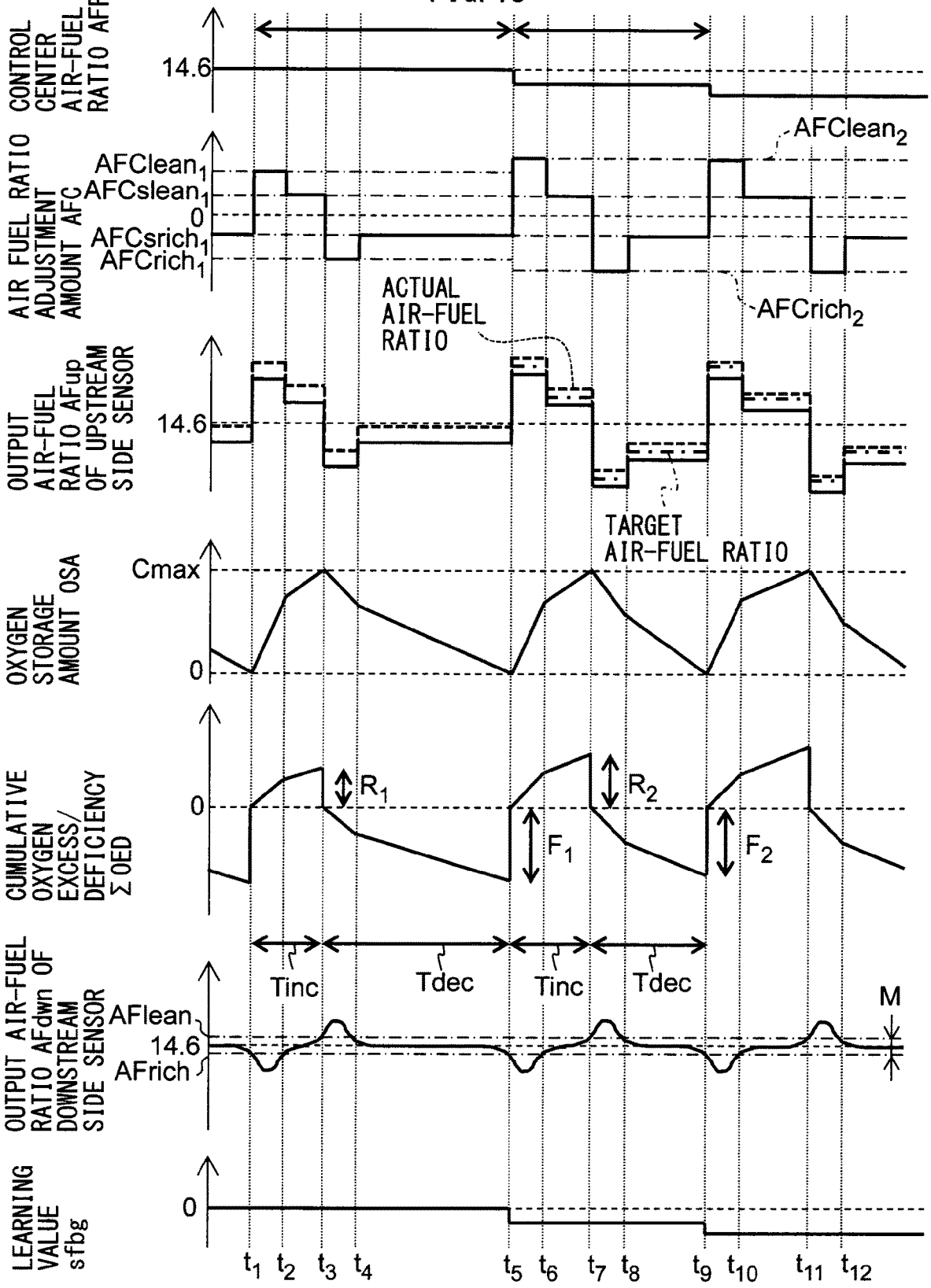
FIG. 13 is a time chart of air-fuel ratio adjustment amount, etc., when performing learning promotion control.
Figure 14:
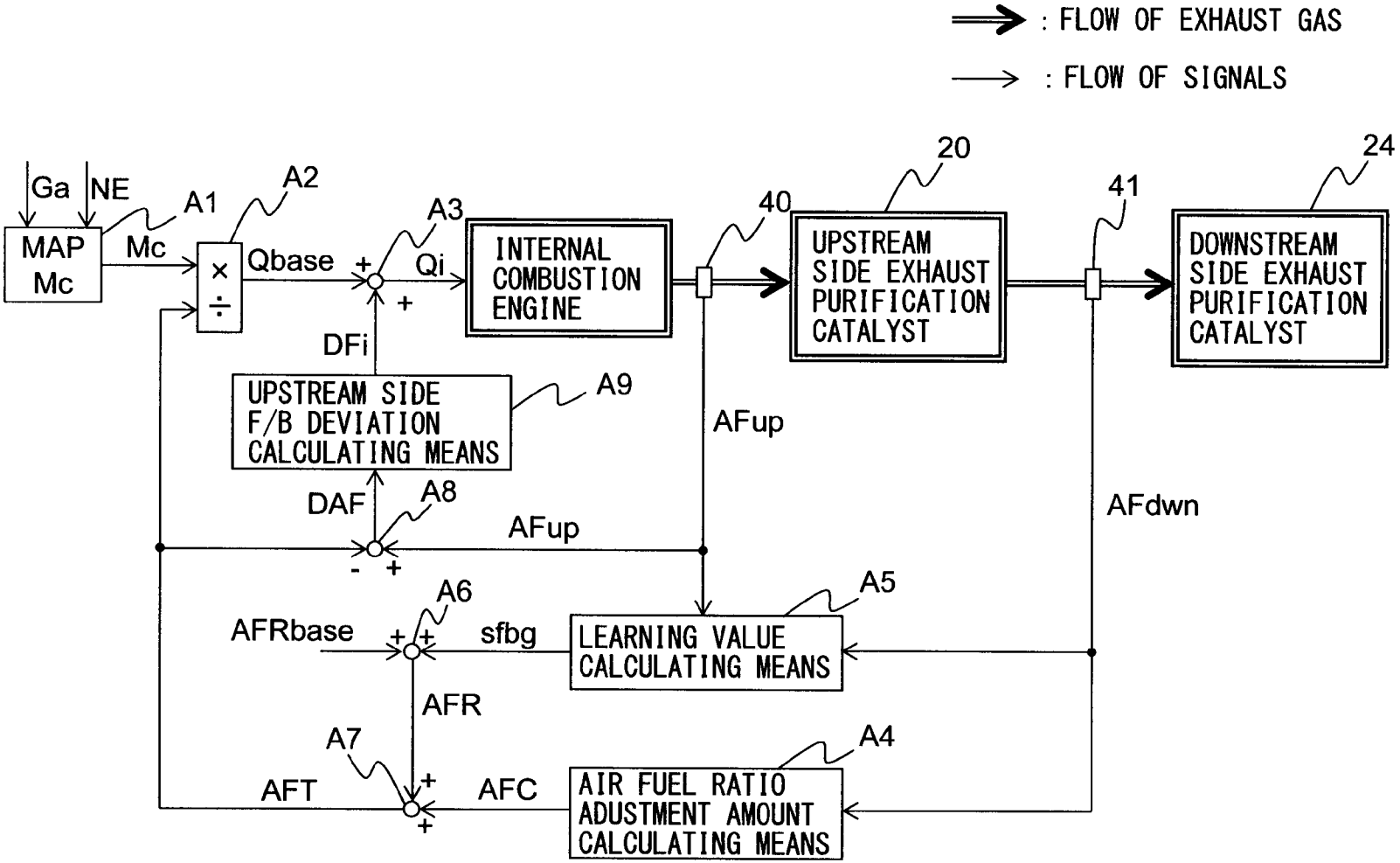
FIG. 14 is a functional block diagram of a control device.

For example, as shown in FIG. 13, during learning promotion control, it is possible to increase only the rich degree of the rich set air-fuel ratio and the lean degree of the lean set air-fuel ratio increase, and to maintain the rich degree of the slight rich set air-fuel ratio and the lean degree of the slight lean set air-fuel ratio as they are without increasing them. By maintaining the rich degree of the slight rich set air-fuel ratio and the lean degree of the slight lean set air-fuel ratio low as they are, even if unburned gas or $NO_x$ flows out from the upstream side exhaust purification catalyst 20 at the time $t_5$ or the time $t_7$, the amount of outflow can be kept small.

Further, for example, during learning promotion control, it is also possible to increase only the rich degrees of the rich set air-fuel ratio and the slight rich set air-fuel ratio, and to maintain the lean degrees of the lean set air-fuel ratio and slight lean set air-fuel ratio as they are without increasing them. In this case, by the lean degrees not being increased, the outflow of $NO_x$ from the upstream side exhaust purification catalyst 20 can be suppressed.

Similarly, for example, during learning promotion control, it is also possible to increase only the lean degrees of the lean set air-fuel ratio and slight lean set air-fuel ratio, and to maintain the rich degrees of the rich set air-fuel ratio and the slight rich set air-fuel ratio as they are without increasing them. In this case, by the rich degrees not being increased, the outflow of unburned gas from the upstream side exhaust purification catalyst 20 can be suppressed.

Further, in the above embodiment, in learning promotion control, the amounts or ratios for increasing the rich degrees of the rich set air-fuel ratio and the slight rich set air-fuel ratio and the lean degrees of the lean set air-fuel ratio and slight lean set air-fuel ratio are constant. However, the amounts or ratios for increasing these rich degrees and lean degrees may also differ from each other depending on the parameter.

In addition, in learning promotion control, the amount or ratio of increase of the rich degrees of the rich set air-fuel ratio and the slight rich set air-fuel ratio and the lean degrees of the lean set air-fuel ratio and slight lean set air-fuel ratio may be made smaller along with the elapse of time. That is, in learning promotion control, when increasing the lean degree of the average target air-fuel ratio while the target air-fuel ratio is set to the lean air-fuel ratio, the extent of increase of the lean degree may be set smaller the longer the elapsed time from when switching the target air-fuel ratio from the rich air-fuel ratio to the lean air-fuel ratio. Similarly, in learning promotion control, when increasing the rich degree of the average target air-fuel ratio while the target air-fuel ratio is set to the rich air-fuel ratio, the extent of increase of the rich degree may be set smaller the longer the elapsed time from when switching the target air-fuel ratio from the lean air-fuel ratio to the rich air-fuel ratio.

In addition, in learning promotion control, the rich degree change timing for switching the target air-fuel ratio from the rich set air-fuel ratio to the slight rich set air-fuel ratio may also be delayed. That is, the time period from when the target air-fuel ratio is switched from the lean air-fuel ratio to the rich set air-fuel ratio to the rich degree change timing may be longer. In this regard, in the above-mentioned embodiment, the rich degree is switched when the output air-fuel ratio AFdwn of the downstream side air-fuel ratio sensor 41 becomes smaller than the lean judged air-fuel ratio. As opposed to this, for example, it is also possible to switch the rich degree when a predetermined time has elapsed from when the output air-fuel ratio AFdwn of the downstream side air-fuel ratio sensor 41 becomes smaller than the lean judged air-fuel ratio. Alternatively, it is possible to switch the rich degree when the cumulative value of the amount of intake air or the cumulative oxygen excess/deficiency from when the output air-fuel ratio AFdwn of the downstream side air-fuel ratio sensor 41 becomes smaller than the lean judged air-fuel ratio, becomes a predetermined value or more. Further, it is similarly possible to delay the lean degree change timing for switching the target air-fuel ratio from the lean set air-fuel ratio to the slight lean set air-fuel ratio. That is, it is possible to lengthen the time period from when the target air-fuel ratio is switched from the rich air-fuel ratio to the lean set air-fuel ratio to the lean degree change timing.

Summarizing the above, in the present embodiment, it can be said that when the learning promoting condition stands, which stands when it is necessary to promote the correction of the parameters by learning control, compared to when the learning promoting condition does not stand, at least one of the lean degree of the average target air-fuel ratio while the target air-fuel ratio is set to the lean air-fuel ratio and the rich degree of the average target air-fuel ratio while the target air-fuel ratio is set to the rich air-fuel ratio is increased.

Further, in the above embodiment, even when learning promotion control is performed, the gains $k_1$, $k_2$, and $k_3$ at the above formulas (2), (4), and (5) are not changed. However, when learning promotion control is performed, compared with when learning promotion control is not performed, the gains $k_1$, $k_2$, and $k_3$ may also be increased. Even in this case, in the present embodiment, when learning promotion control is performed, the lean set adjustment amount and rich set adjustment amount are changed, and therefore compared with when increasing only the gains $k_1$, $k_2$, and $k_3$, the extent of making the gains $k_1$, $k_2$, and $k_3$ increase is kept low. Therefore, delay in the final convergence of the learning value sfbg is suppressed.

<Explanation of Specific Control>

Next, referring to FIG. 14 to FIG. 19, the control device in the above embodiment will be specifically explained. The control device in the present embodiment is configured so as to include the functional blocks A1 to A9 of the block diagram of FIG. 14. Below, while referring to FIG. 14, the different functional blocks will be explained. The operations of these functional blocks A1 to A9 are basically executed by the ECU 31.

<Calculation of Fuel Injection Amount>

First, calculation of the fuel injection amount will be explained. In calculating the fuel injection amount, the cylinder intake air calculating means A1, basic fuel injection calculating means A2, and fuel injection calculating means A3 are used.

The cylinder intake air calculating means A1 calculates the intake air amount Mc to each cylinder based on the intake air flow rate Ga, engine speed NE, and map or calculation formula which is stored in the ROM 34 of the ECU 31. The intake air flow rate Ga is measured by the air flow meter 39, and the engine speed NE is calculated based on the output of the crank angle sensor 44.

The basic fuel injection calculating means A2 divides the cylinder intake air amount Mc which was calculated by the cylinder intake air calculating means A1 by the target air-fuel ratio AFT to calculate the basic fuel injection amount Qbase (Qbase=Mc/AFT). The target air-fuel ratio AFT is calculated by the later explained target air-fuel ratio setting means A7.

The fuel injection calculating means A3 adds the later explained F/B correction amount DQi to the basic fuel injection amount Qbase which was calculated by the basic fuel injection calculating means A2 to calculate the fuel injection amount Qi (Qi=Qbase+DQi). An injection is instructed to the fuel injector 11 so that fuel of the thus calculated fuel injection amount Qi is injected from the fuel injector 11.

<Calculation of Target Air Fuel Ratio>

Next, calculation of the target air-fuel ratio will be explained. In calculating the target air-fuel ratio, air-fuel ratio adjustment amount calculating means A4, learning value calculating means A5, control center air-fuel ratio calculating means A6, and target air-fuel ratio setting means A7 are used.

The air-fuel ratio adjustment amount calculating means A4 calculates the air-fuel ratio adjustment amount AFC of the target air-fuel ratio, based on the output air-fuel ratio AFdwn of the downstream side air-fuel ratio sensor 41. Specifically, the air-fuel ratio adjustment amount AFC is calculated based on the flow chart shown in FIG. 15.

The learning value calculating means A5 calculates the learning value sfbg, based on the output air-fuel ratio AFup of the upstream side air-fuel ratio sensor 40, the output air-fuel ratio AFdwn of the downstream side air-fuel ratio sensor 41, intake air flow rate Ga (exhaust gas flow rate Ge is calculated), etc. Specifically, the learning value sfbg is calculated based on the flow chart shown in FIGS. 16-18.

The control center air-fuel ratio calculating means A6 calculates the control center air-fuel ratio AFR, based on the basic control center air-fuel ratio AFRbase and the learning value which was calculated by the learning value calculating means A5, by using the above mentioned formula (3).

The target air-fuel ratio setting means A7 adds the calculated air-fuel ratio adjustment amount AFC which was calculated by the target air-fuel ratio correction calculating means A4 to the control center air-fuel ratio AFR to calculate the target air-fuel ratio AFT. The thus calculated target air-fuel ratio AFT is input to the basic fuel injection calculating means A2 and later explained air-fuel ratio deviation calculating means A8.

<Calculation of F/B Correction Amount>

Next, calculation of the F/B correction amount based on the output air-fuel ratio AFup of the upstream side air-fuel ratio sensor 40 will be explained. In calculating the F/B correction amount, air-fuel ratio deviation calculating means A8, and F/B correction calculating means A9 are used.

The air-fuel ratio deviation calculating means A8 subtracts the target air-fuel ratio AFT which was calculated by the target air-fuel ratio setting means A7 from the output air-fuel ratio AFup of the upstream side air-fuel ratio sensor 40 to calculate the air-fuel ratio deviation DAF (DAF=AFup−AFT). This air-fuel ratio deviation DAF is a value which expresses the excess/deficiency of the amount of fuel feed to the target air-fuel ratio AFT.

The F/B correction calculating means A9 processes the air-fuel ratio deviation DAF which was calculated by the air-fuel ratio deviation calculating means A8 by proportional integral derivative processing (PID processing) to calculate the F/B correction amount DFi for compensating for the excess/deficiency of the fuel feed amount based on the following formula (7). The thus calculated F/B correction amount DFi is input to the fuel injection calculating means A3.

$$DFi=Kp\sim DAF+Ki\cdot SDAF+Kd\sim DDAF \quad (7)$$

Note that, in the above formula (7), Kp is a preset proportional gain (proportional constant), Ki is a preset integral gain (integral constant), and Kd is a preset derivative gain (derivative constant). Further, DDAF is the time derivative of the air-fuel ratio deviation DAF and is calculated by dividing the difference between the currently updated air-fuel ratio deviation DAF and the previously updated air-fuel ratio deviation DAF by a time corresponding to the updating interval. Further, SDAF is the time integral of the air-fuel ratio deviation DAF. This time derivative DDAF is calculated by adding the currently updated air-fuel ratio deviation DAF to the previously updated time integral DDAF (SDAF=DDAF+DAF).

<Flow Chart of Air-Fuel Ratio Adjustment Amount Calculation Control>

Figure 15:
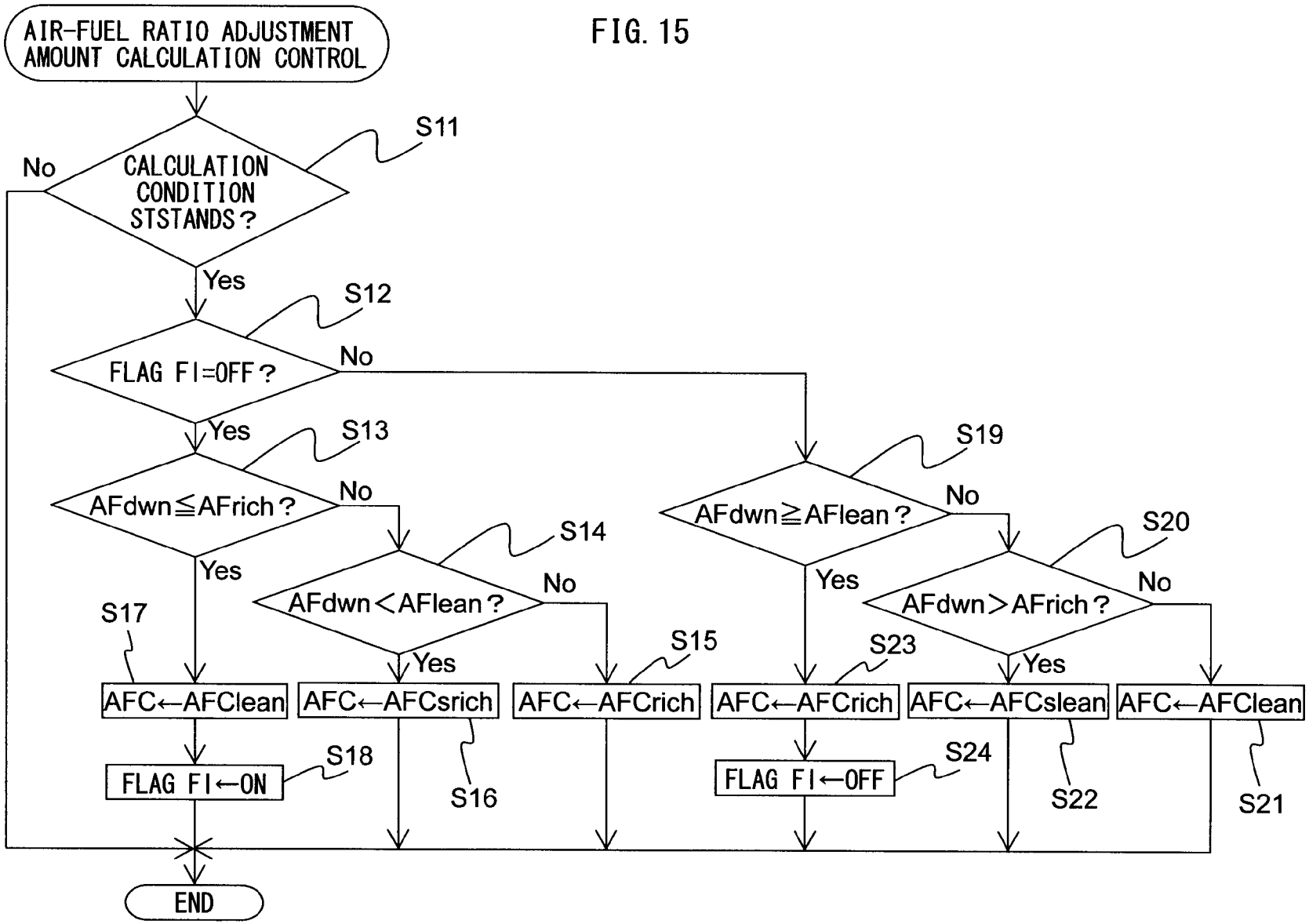
FIG. 15 is a flow chart which shows a control routine of control for calculation of an air-fuel ratio adjustment amount.

FIG. 15 is a flow chart which shows the control routine in control for calculation of the air-fuel ratio adjustment amount. The illustrated control routine is performed by interruption every certain time interval.

As shown in FIG. 15, first, at step S11, it is judged if the condition for calculation of the air-fuel ratio adjustment amount AFC stands. As the case where the condition for calculation of the air-fuel ratio adjustment amount AFC stands, normal operation being performed, for example, fuel cut control not being performed, etc., may be mentioned. When it is judged at step S11 that the condition for calculation of the air-fuel ratio adjustment amount AFC stands, the routine proceeds to step S12.

At step S12, it is judged if the lean set flag F1 is set to OFF. The lean set flag F1 is a flag which is set ON when the target air-fuel ratio is set to the lean air-fuel ratio, that is, the air-fuel ratio adjustment amount AFC is set to 0 or more, and is set OFF otherwise. When it is judged at step S12 that the lean set flag F1 is set OFF, the routine proceeds to step S13. At step S13, it is judged if the output air-fuel ratio AFdwn of the downstream side air-fuel ratio sensor 41 is the rich judged air-fuel ratio AFrich or less.

When, at step S13, it is judged that the output air-fuel ratio AFdwn of the downstream side air-fuel ratio sensor 41 is larger than the rich judged air-fuel ratio AFrich, the routine proceeds to step S14. At step S14, it is judged if the output air-fuel ratio AFdwn of the downstream side air-fuel ratio sensor 41 is smaller than the lean judged air-fuel ratio AFlean. When it is judged that the output air-fuel ratio AFdwn is the lean judged air-fuel ratio AFlean or more, the routine proceeds to step S15. At step S15, the air-fuel ratio adjustment amount AFC is set to the rich set adjustment amount AFCrich, and then the control routine is ended.

Then, if the output air-fuel ratio AFdwn of the downstream side air-fuel ratio sensor 41 approaches the stoichiometric air-fuel ratio and becomes smaller than the lean judged air-fuel ratio AFlean, at the next control routine, the routine proceeds from step S14 to step S16. At step S16, the air-fuel ratio adjustment amount AFC is set to the slight rich set adjustment amount AFCsrich, and then the control routine is ended.

Then, if the oxygen storage amount OSA of the upstream side exhaust purification catalyst 20 becomes substantially zero and the output air-fuel ratio AFdwn of the downstream side air-fuel ratio sensor 41 becomes the rich judged air-fuel ratio AFrich or less, at the next control routine, the routine proceeds from step S13 to step S17. At step S17, the air-fuel ratio adjustment amount AFC is set to the lean set adjustment amount AFClean. Next, at step S18, the lean set flag F1 is set ON, then the control routine is ended.

If the lean set flag F1 is set ON, at the next control routine, the routine proceeds from step S12 to step S19. At step S19, it is judged if the output air-fuel ratio AFdwn of the downstream side air-fuel ratio sensor 41 is the lean judged air-fuel ratio AFlean or more.

When it is judged at step S19 that the output air-fuel ratio AFdwn of the downstream side air-fuel ratio sensor 41 is smaller than the lean judged air-fuel ratio AFlean, the routine proceeds to step S20. At step S20, it is judged if the output air-fuel ratio AFdwn of the downstream side air-fuel ratio sensor 41 is larger than the rich judged air-fuel ratio AFrich. When it is judged that the output air-fuel ratio AFdwn is the rich judged air-fuel ratio AFrich or less, the routine proceeds to step S21. At step S21, the air-fuel ratio adjustment amount AFC continues to be set at the lean set adjustment amount AFClean, and then the control routine is ended.

Then, if the output air-fuel ratio AFdwn of the downstream side air-fuel ratio sensor 41 approaches the stoichiometric air-fuel ratio and becomes larger than the rich judged air-fuel ratio AFrich, at the next control routine, the routine proceeds to step S20 to step S22. At step S22, the air-fuel ratio adjustment amount AFC is set to the slight lean set air-fuel ratio AFCslean, and then the control routine is ended.

Then, if the oxygen storage amount OSA of the upstream side exhaust purification catalyst 20 becomes substantially the maximum storable oxygen amount and the output air-fuel ratio AFdwn of the downstream side air-fuel ratio sensor 41 becomes the lean judged air-fuel ratio AFlean or more, at the next control routine, the routine proceeds from step S19 to step S23. At step S23, the air-fuel ratio adjustment amount AFC is set to the rich set adjustment amount AFCrich. Next, at step S24, the lean set flag F1 is reset to OFF, and the control routine is ended.

<Flow Chart of Normal Learning Control>

Figure 16:
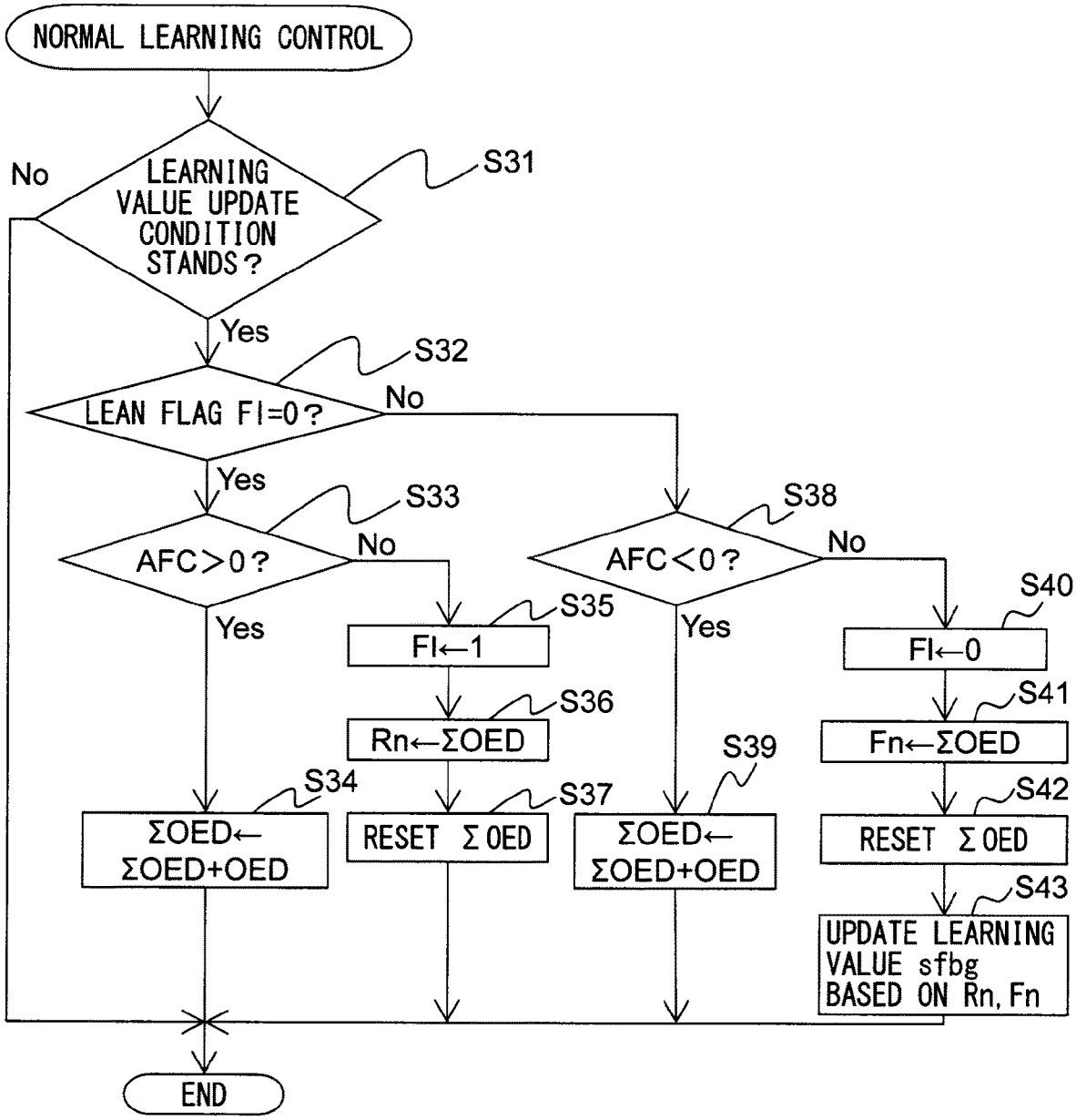
FIG. 16 is a flow chart which shows a control routine of normal learning control.

FIG. 16 is a flow chart which shows the control routine of normal leaning control. The illustrated control routine is performed by interruption every certain time interval.

As shown in FIG. 16, first, at step S31, it is judged if the condition for updating the learning value sfbg stands. As the case when the condition for updating stands, for example, normal control being performed, etc., may be mentioned. When it is judged at step S31 that the condition for updating the learning value sfbg stands, the routine proceeds to step S32. At step S32, it is judged if the lean flag F1 has been set to 0. When it is judged at step S32 that the lean flag F1 has been set to 0, the routine proceeds to step S33.

At step S33, it is judged if the air-fuel ratio adjustment amount AFC is larger than 0, that is, if the target air-fuel ratio is a lean air-fuel ratio. If, at step S33, it is judged that the air-fuel ratio adjustment amount AFC is larger than 0, the routine proceeds to step S34. At step S34, the cumulative oxygen excess/deficiency μOED is increased by the current oxygen excess/deficiency OED.

Then, if the target air-fuel ratio is switched to the rich air-fuel ratio, at the next control routine, at step S33, it is judged if the base air-fuel ratio adjustment amount AFCbase is 0 or less and thus the routine proceeds to step S35. At step S35, the lean flag F1 is set to 1, next, at step S36, Rn is made the absolute value of the current cumulative oxygen excess/deficiency μOED. Next, at step S37, the cumulative oxygen excess/deficiency μOED is reset to 0 and then the control routine is ended.

On the other hand, if the lean flag F1 is set to 1, at the next control routine, the routine proceeds from step S32 to step S38. At step S38, it is judged if the air-fuel ratio adjustment amount AFC is smaller than 0, that is, the target air-fuel ratio is the rich air-fuel ratio. When it is judged at step S38 that the air-fuel ratio adjustment amount AFC is smaller than 0, the routine proceeds to step S39. At step S39, the cumulative oxygen excess/deficiency μOED is increased by the current oxygen excess/deficiency OED.

Then, if the target air-fuel ratio is switched to the lean air-fuel ratio, at step S38 of the next control routine, it is judged that the air-fuel ratio adjustment amount AFC is 0 or more, then the routine proceeds to step S40. At step S40, the lean flag Fr is set to 0, then, at step S41, Fn is made the absolute value of the current cumulative oxygen excess/deficiency μOED. Next, at step S42, the cumulative oxygen excess/deficiency μOED is reset to 0. Next, at step S43, the learning value sfbg is updated based on Rn which was calculated at step S36 and the Fn which was calculated at step S41, then the control routine is ended.

<Flow Chart of Stuck Learning Control>

Figure 17:
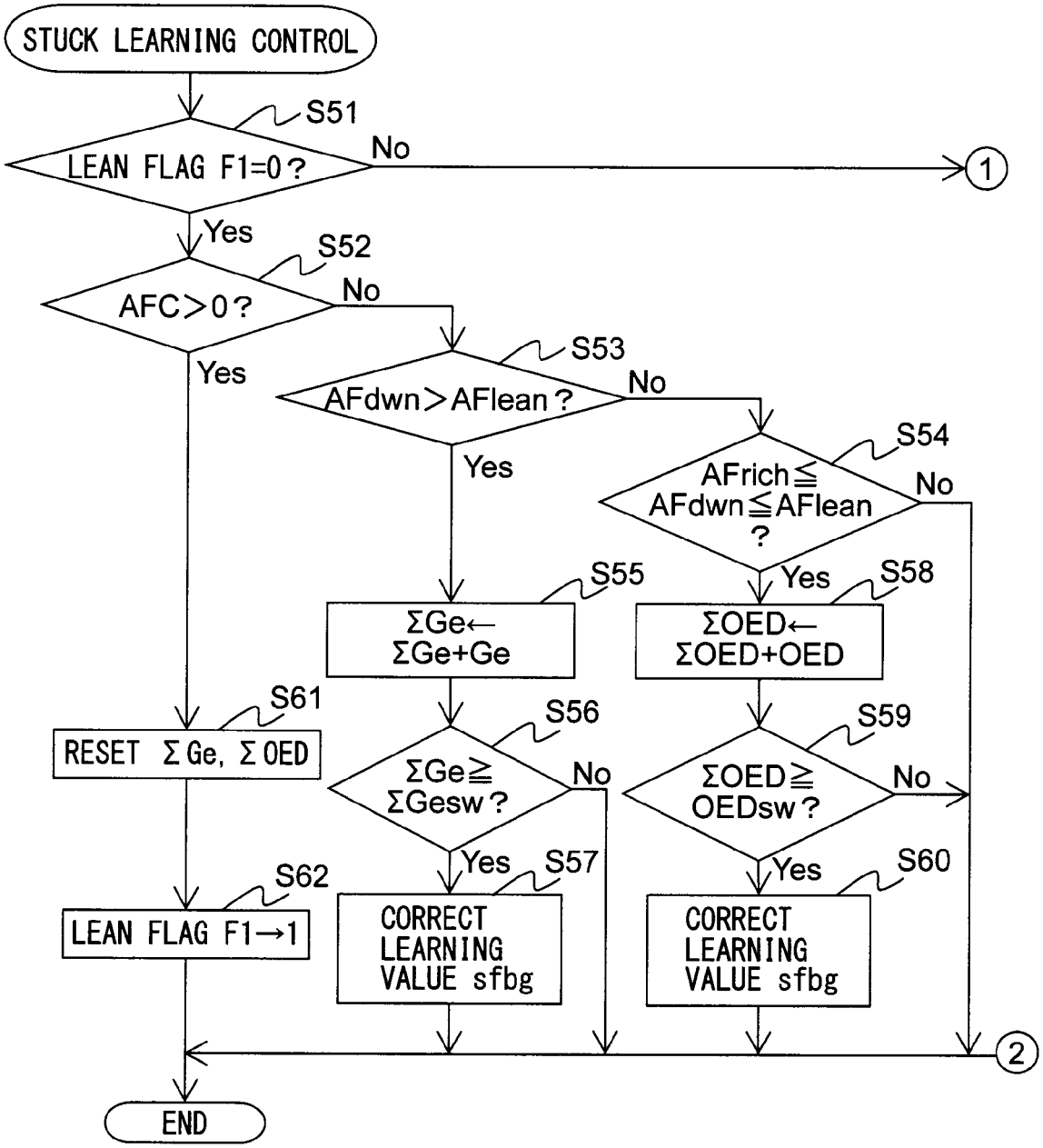
FIG. 17 is part of a flow chart which shows a control routine of stuck learning control.
Figure 18:
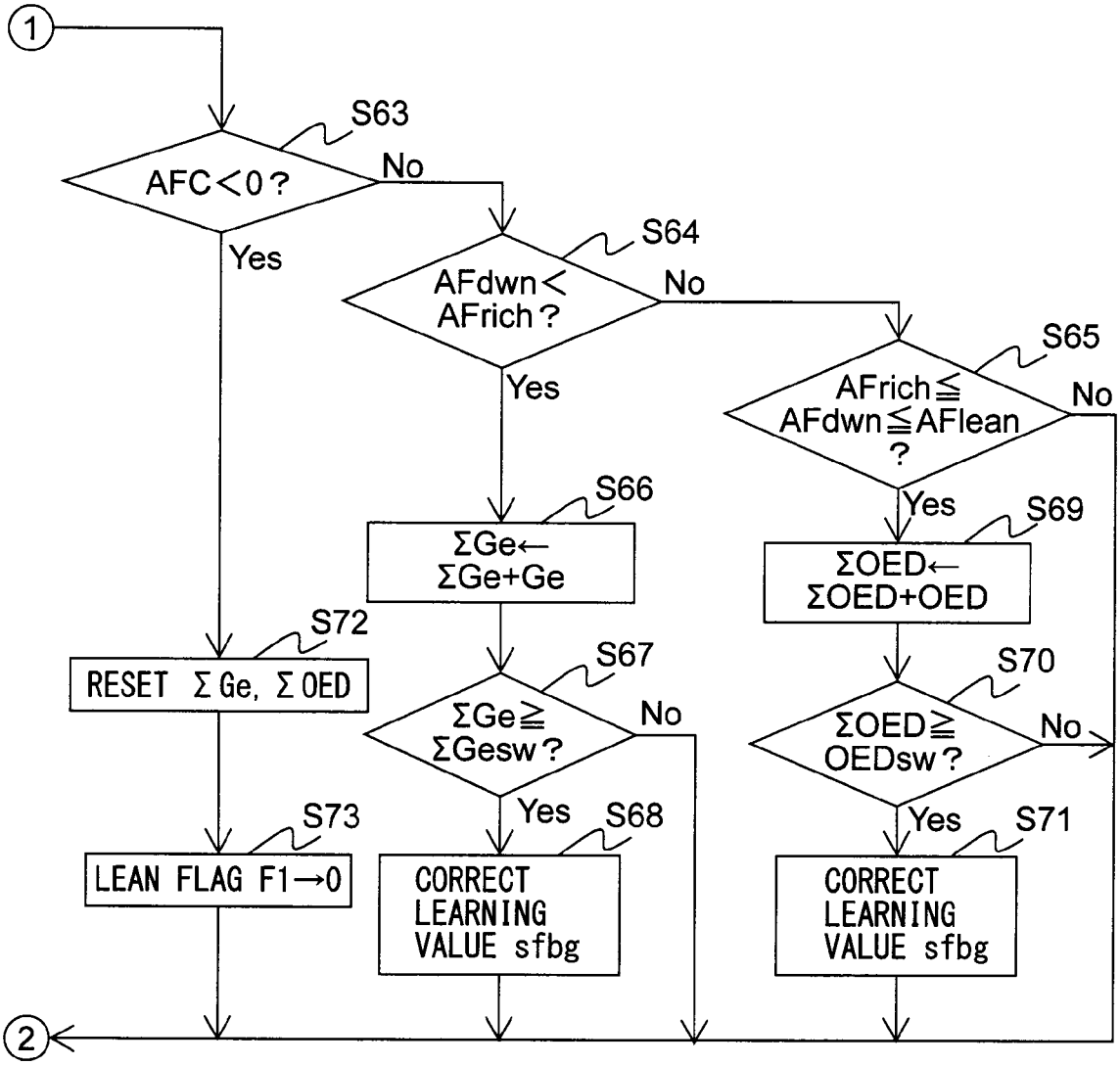
FIG. 18 is part of a flow chart which shows a control routine of stuck learning control.

FIGS. 17 and 18 are flow charts which show the control routine of stuck learning control (stoichiometric air-fuel ratio stuck control, rich stuck control, and lean stuck control). The illustrated control routine is performed by interruption every certain time interval.

As shown in FIGS. 17 and 18, first, at step S51, it is judged if the lean flag F1 is set to "0". If it is judged, at step S51, that the lean flag F1 is set to "0", the routine proceeds to step S52. At step S52, it is judged if the air-fuel ratio adjustment amount AFC is larger than 0, that is, if the target air-fuel ratio is the lean air-fuel ratio. If it is judged at step S52 that the air-fuel ratio adjustment amount AFC is 0 or less, the routine proceeds to step S53.

At step S53, it is judged if the output air-fuel ratio AFdwn of the downstream side air-fuel ratio sensor 41 is larger than the lean judged air-fuel ratio AFlean, and at step S54, it is judged if the output air-fuel ratio AFdwn is a value between the rich judged air-fuel ratio AFrich and the lean judged air-fuel ratio AFlean. If it is judged at steps S53 and S54 that the output air-fuel ratio AFdwn is smaller than the rich judged air-fuel ratio AFrich, that is, if it is judged that the output air-fuel ratio is the rich air-fuel ratio, the control routine is ended. On the hand, if it is judged at steps S53 and S54 that the output air-fuel ratio AFdwn is larger than the lean judged air-fuel ratio AFlean, that is, if it is judged that the output air-fuel ratio is the lean air-fuel ratio, the routine proceeds to step S55.

At step S55, the value acquired by adding the current exhaust gas flow amount Ge to the cumulative exhaust gas flow amount ΣGe is made the new cumulative exhaust gas flow amount ΣGe. Note that, the exhaust gas flow amount Ge is, for example, calculated based on the output of the air flow meter 39, etc. Next, at step S56, it is judged if the cumulative exhaust gas flow amount ΣGe which was calculated at step S55 is a predetermined amount ΣGesw or more. If it is judged at step S56 that ΣGe is smaller than ΣGesw, the control routine is ended. On the hand, if the cumulative exhaust gas flow amount ΣGe increases and it is judged at step S56 that ΣGe is ΣGesw or more, the routine proceeds to step S57. At step S57, the learning value sfbg is corrected by using the above-mentioned formula (5).

On the other hand, when it is judged at steps S53 and S54 that the output air-fuel ratio AFdwn is a value between the rich judged air-fuel ratio AFrich and the lean judged air-fuel ratio AFlean, the routine proceeds to step S58. At step S58, the value acquired by adding the current oxygen excess/deficiency OED to the cumulative oxygen excess/deficiency μOED is made the new cumulative oxygen excess/deficiency μOED. Next, at step S59, it is judged if the cumulative oxygen excess/deficiency μOED which was calculated at step S58 is a predetermined amount OEDsw or more. If it is judged at step S59 that μOED is smaller than OEDsw, the control routine is ended. On the other hand, if the cumulative oxygen excess/deficiency μOED increases and, at step S59, it is judged that μOED is OEDsw or more, the routine proceeds to step S60. At step S60, the learning value sfbg is corrected by using the above-mentioned formula (4).

Then, the target air-fuel ratio is switched, and thus when, at step S52, the air-fuel ratio adjustment amount AFC is larger than 0, the routine proceeds to step S61. At step S61, the cumulative exhaust gas flow amount ΣGe and cumulative oxygen excess/deficiency μOED are reset to 0. Next, at step S62, the lean flag F1 is set to "1".

If the lean flag F1 is set to "1", at the next control routine, the routine proceeds from step S51 to step S63. At step S63, it is judged if the air-fuel ratio adjustment amount AFC is smaller than 0, that is, if the target air-fuel ratio is the rich air-fuel ratio. If it is judged at step S63 that the air-fuel ratio adjustment amount AFC is 0 or more, the routine proceeds to step S64.

At step S64, it is judged if the output air-fuel ratio AFdwn of the downstream side air-fuel ratio sensor 41 is smaller than the rich judged air-fuel ratio AFrich, and at step S65, it is judged if the output air-fuel ratio AFdwn is a value between the rich judged air-fuel ratio AFrich and the lean judged air-fuel ratio AFlean. If at steps S64 and S65 it is judged that the output air-fuel ratio AFdwn is larger than the lean judged air-fuel ratio AFlean, that is, it is judged that the output air-fuel ratio is the lean air-fuel ratio, the control routine is ended. On the other hand, if it is judged at steps S64 and S65 that the output air-fuel ratio AFdwn is smaller than the rich judged air-fuel ratio AFrich, that is, it is judged that the output air-fuel ratio is the rich air-fuel ratio, the routine proceeds to step S66.

At step S66, the value acquired by adding the current exhaust gas flow amount Ge to the cumulative exhaust gas flow amount ΣGe is made the new cumulative exhaust gas flow amount ΣGe. Next, at step S67, it is judged if the cumulative exhaust gas flow amount ΣGe which was calculated at step S66 is the predetermined amount ΣGesw or more. When, at step S67, it is judged that ΣGe is smaller than ΣGesw, the control routine is ended. On the other hand, when the cumulative exhaust gas flow amount ΣGe increases and, at step S67, it is judged that ΣGe is ΣGesw or more, the routine proceeds to step S68. At step S68, the learning value sfbg is corrected by using the above-mentioned formula (5).

On the other hand, if it is judged at steps S64 and S65 that the output air-fuel ratio AFdwn is a value between the rich judged air-fuel ratio AFrich and the lean judged air-fuel ratio AFlean, the routine proceeds to step S69. At steps S69 to S71, control similar to steps S58 to S60 is performed.

Then, the target air-fuel ratio is switched, and thus when it is judged at step S63 that the air-fuel ratio adjustment amount AFC is smaller than 0, the routine proceeds to step S72. At step S72, the cumulative exhaust gas flow amount ΣGe and cumulative oxygen excess/deficiency μOED are reset to 0. Next, step S73, the lean flag F1 is set to "0" and the control routine is ended.

<Flow Chart of Learning Promotion Control>

Figure 19:
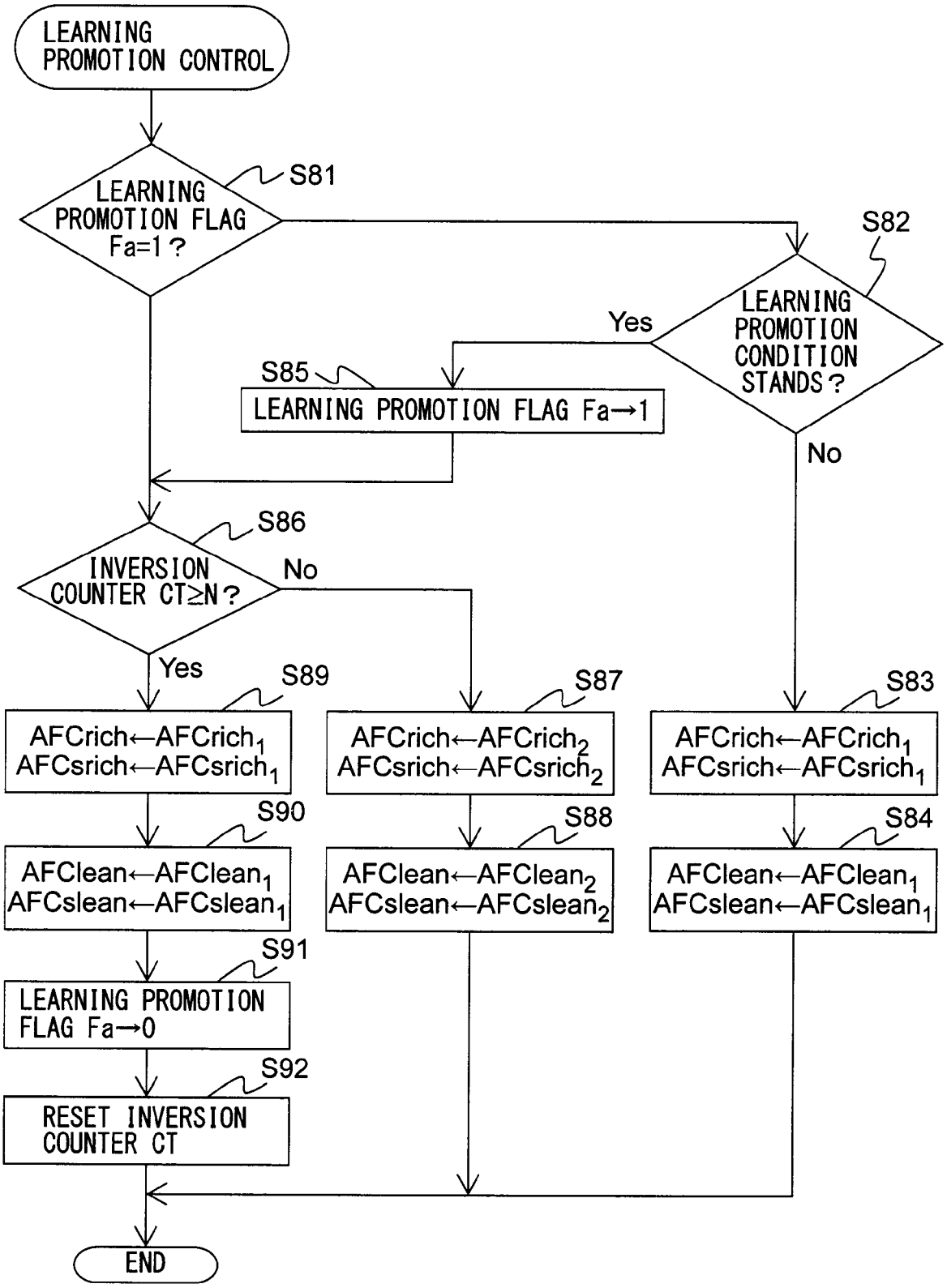
FIG. 19 is a flow chart which shows a control routine of learning promotion control.

FIG. 19 is a flow chart which shows the control routine of learning promotion control. The control routine which is shown in FIG. 19 is performed by interruption every certain time interval. As shown in FIG. 19, first, at step S81, it is judged if the learning promotion flag Fa has been set to "1". The learning promotion flag Fa is a flag which is set to "1" when learning promotion control is to be performed, while is set "0" otherwise. When it is judged at step S81 that the learning promotion flag Fa is set to "0", the routine proceeds to step S82.

At step S82, it is judged if the condition for promotion of learning stands. The condition for promotion of learning stands when it is necessary to promote updating of the learning value by learning control. Specifically, the condition for promotion of learning stands when the above-mentioned excess/deficiency error ΔΣOED is the promotion judgment reference value or more, when the output air-fuel ratio AFdwn of the downstream side air-fuel ratio sensor 41 is maintained in the middle region M over the stoichiometric air-fuel ratio promotion judged time or more, and when the output air-fuel ratio AFdwn of the downstream side air-fuel ratio sensor 41 is maintained at the lean air-fuel ratio or the rich air-fuel ratio over the lean air-fuel ratio promotion judged time or rich air-fuel ratio promotion judged time or more, etc. Alternatively, the condition for promotion of learning may stand when the value of the learning value update amount which is added to sfbg(n−1) in the above formulas (2), (4), and (5) is a predetermined reference value or more.

When it is judged at step S82 that the condition for promotion of learning does not stand, the routine proceeds to step S83. At step S83, the rich set adjustment amount AFCrich and slight rich set adjustment amount AFCrich are respectively set to $AFCrich_1$ and $AFCsrich_1$. Next, at step S84, the lean set adjustment amount AFClean and slight lean set adjustment amount AFClean are respectively set to $AFClean_1$ and $AFCslean_1$ and the control routine is ended.

On the hand, when it is judged at step S82, that the condition for promotion of learning stands, the routine proceeds to step S85. At step S85, the learning promotion flag Fa is set to "1". Next, at step S86, it is judged if the inversion counter CT is N or more. The inversion counter CT is a counter which is incremented by "1" each time the target air-fuel ratio is inverted between the rich air-fuel ratio and the lean air-fuel ratio.

When it is judged at step S86 that the inversion counter CT is less than N, that is, when it is judged that the number of times of inversion of the target air-fuel ratio is less than N, the routine proceeds to step S87. At step S87, the rich set adjustment amount AFCrich is set to $AFCrich_2$ which is larger in absolute value than $AFCrich_1$, and the slight rich set adjustment amount AFCsrich is set to $AFCsrich_2$ which is larger in absolute value than $AFCsrich_1$. Next, at step S88, the lean set adjustment amount AFClean is set to $AFClean_2$ which is larger in absolute value than $AFClean_1$, and the slight lean set adjustment amount AFCslean is set to $AFCslean_2$ which is larger in absolute value than $AFCslean_1$. After that, the control routine is ended.

If the target air-fuel ratio is inverted a plurality of times, at the next control routine, at step S86, it is judged that the inversion counter CT is N or more, and thus the routine proceeds to step S89. At step S89, the rich set adjustment amount AFCrich and the slight rich set adjustment amount AFCrich are respectively set to $AFCrich_1$ and $AFCsrich_1$. Next, at step S90, the lean set adjustment amount AFClean and the slight lean set adjustment amount AFClean are respectively set to $AFClean_1$ and $AFCslean_1$. Next, at step S91, the learning promotion flag Fa is reset to "0" and, at step S92, the inversion counter CT is reset to "0", and then the control routine is made to end.

Note that, in the above embodiment, as the basic air-fuel ratio control, control is performed so that while the target air-fuel ratio is set to the rich air-fuel ratio, the rich degree is dropped, and while the target air-fuel ratio is set to the lean air-fuel ratio, the lean degree is dropped. However, as the basic air-fuel ratio control, it is not necessarily required to employ such air-fuel ratio control. Control may also be performed so that while the target air-fuel ratio is set to the rich air-fuel ratio, the target air-fuel ratio is maintained at a certain constant rich air-fuel ratio, and while the target air-fuel ratio is set to the lean air-fuel ratio, the target air-fuel ratio is maintained at a certain constant lean air-fuel ratio.

REFERENCE SIGNS LIST

1 engine body
5 combustion chamber
7 intake port
9 exhaust port
19 exhaust manifold
20 upstream side exhaust purification catalyst
24 upstream side exhaust purification catalyst
31 ECU
40 upstream side air-fuel ratio sensor
41 downstream side air-fuel ratio sensor

The invention claimed is:

1. An internal combustion engine, comprising: an exhaust purification catalyst which is arranged in an exhaust passage of the internal combustion engine and which can store oxygen; a downstream side air-fuel ratio sensor which is arranged at a downstream side, in the exhaust flow direction, of said exhaust purification catalyst and which detects an air-fuel ratio of exhaust gas which flows out from said exhaust purification catalyst; and an ECU, wherein the ECU is configured to perform feedback control on the feed of fuel which is fed to the combustion chamber of the internal combustion engine so that said air-fuel ratio of the exhaust gas flowing into said exhaust purification catalyst becomes a target air-fuel ratio, and performs learning control which corrects a parameter relating to feedback control based on the output air-fuel ratio of the downstream side air-fuel ratio sensor, the ECU switches said target air-fuel ratio from a rich air-fuel ratio which is richer than the stoichiometric air-fuel ratio to a lean air-fuel ratio which is leaner than the stoichiometric air-fuel ratio when said output air-fuel ratio of the downstream side air-fuel ratio sensor becomes a rich judged air-fuel ratio, which is richer than the stoichiometric air-fuel ratio, or less, switches from the lean air-fuel ratio to the rich air-fuel ratio when said output air-fuel ratio of the downstream side air-fuel ratio sensor becomes a lean judged air-fuel ratio, which is leaner than the stoichiometric air-fuel ratio, or more, and, when a learning promotion condition stands, which stands when it is necessary to promote correction of said parameter by said learning control, compared with when said learning promoting condition does not stand, the ECU increases at least one of a lean degree of the average target air-fuel ratio while said target air-fuel ratio is set to the lean air-fuel ratio and a rich degree of the average target air-fuel ratio while said target air-fuel ratio is set to the rich air-fuel ratio, the ECU is configured to switch said target air-fuel ratio from the rich air-fuel ratio to a lean set air-fuel ratio which is leaner than the stoichiometric air-fuel ratio, when said output air-fuel ratio of the downstream side air-fuel ratio sensor becomes said rich judged air-fuel ratio or less, the ECU is configured to set said target air-fuel ratio to a lean air-fuel ratio with a smaller lean degree than said lean set air-fuel ratio, from a lean degree change timing after said target air-fuel ratio is set to said lean set air-fuel ratio and before said output air-fuel ratio of the downstream side air-fuel ratio sensor becomes said lean judged air-fuel ratio or more, to when said output air-fuel ratio of the downstream side air-fuel ratio sensor becomes a lean judged air-fuel ratio or more, the ECU is configured to switch said target air-fuel ratio from the lean air-fuel ratio to a rich set air-fuel ratio which is richer than the stoichiometric air-fuel ratio, when said output air-fuel ratio of the downstream side air-fuel ratio sensor becomes said lean judged air-fuel ratio or more, and the ECU is configured to set said target air-fuel ratio to a rich air-fuel ratio with a smaller rich degree than said rich set air-fuel ratio, from a rich degree change timing after said target air-fuel ratio is set to said rich set air-fuel ratio and before said output air-fuel ratio of the downstream side air-fuel ratio sensor becomes said rich judged air-fuel ratio or less, to when said output air-fuel ratio of the downstream side air-fuel ratio sensor becomes a rich judged air-fuel ratio or less.

2. The internal combustion engine according to claim 1, wherein the ECU is configured to, even when said learning promoting condition stands, to maintain the lean degree of the air-fuel ratio from said lean degree change timing to when said output air-fuel ratio of the downstream side air-fuel ratio sensor becomes the lean judged air-fuel ratio or more and the rich degree of the air-fuel ratio from said rich degree change timing to when said output air-fuel ratio of the downstream side air-fuel ratio sensor becomes the rich judged air-fuel ratio or less, without increasing them.

* * * * *